US008485359B2

(12) United States Patent
Anderson

(10) Patent No.: US 8,485,359 B2
(45) Date of Patent: Jul. 16, 2013

(54) SEAL ABSORBENT PAD-RFID-BAR CODE DEVICE FOR A DOSING CAP

(75) Inventor: Michael R. Anderson, Boca Raton, FL (US)

(73) Assignee: Blast Max LLC, Reno, NV (US)

( * ) Notice: Subject to any disclaimer, the term of this patent is extended or adjusted under 35 U.S.C. 154(b) by 734 days.

(21) Appl. No.: 12/174,107

(22) Filed: Jul. 16, 2008

(65) Prior Publication Data

US 2010/0000960 A1 Jan. 7, 2010

Related U.S. Application Data

(60) Provisional application No. 61/078,476, filed on Jul. 7, 2008.

(51) Int. Cl.

| | |
|---|---|
| ***B65D 85/00*** | (2006.01) |
| ***B65D 25/08*** | (2006.01) |
| ***G09F 3/00*** | (2006.01) |
| ***G08B 13/14*** | (2006.01) |

(52) U.S. Cl.

USPC ..... 206/459.1; 40/311; 206/219; 215/228; 340/572.8

(58) Field of Classification Search

USPC ..... 206/219–222, 459.1; 40/311; 340/309.16, 340/572.1–572.9, 568.1; 343/872, 873; 215/226, 227, 232, 341, 346–351, 365, 366, 215/DIG. 8, 228

See application file for complete search history.

(56) References Cited

U.S. PATENT DOCUMENTS

| | | | | |
|---|---|---|---|---|
| 4,813,564 | A * | 3/1989 | Cooper et al. | 215/366 |
| 5,128,104 | A * | 7/1992 | Murphy et al. | 215/DIG. 8 |
| 5,839,593 | A * | 11/1998 | McKedy | 215/350 |
| 6,504,481 | B2 * | 1/2003 | Teller | 340/572.1 |
| 6,945,393 | B2 * | 9/2005 | Cho | 206/219 |
| 7,061,382 | B2 * | 6/2006 | Claessens et al. | 340/572.8 |
| 7,176,796 | B2 * | 2/2007 | Chen et al. | 340/568.1 |
| 7,342,501 | B2 * | 3/2008 | Abbott | 340/572.8 |
| 7,503,453 | B2 * | 3/2009 | Cronin et al. | 206/221 |
| 7,782,212 | B2 * | 8/2010 | Burns et al. | 340/572.8 |
| 7,819,266 | B2 * | 10/2010 | Ross et al. | 215/232 |
| 7,839,288 | B2 * | 11/2010 | Wang et al. | 340/572.8 |
| 7,861,854 | B2 * | 1/2011 | Sharon et al. | 206/221 |
| 8,120,484 | B2 * | 2/2012 | Chisholm | 340/572.1 |
| 8,242,915 | B2 * | 8/2012 | Yan et al. | 340/572.8 |
| 2006/0124574 | A1 * | 6/2006 | Yousif et al. | 215/232 |
| 2007/0114140 | A1 * | 5/2007 | Portier | 206/204 |

* cited by examiner

*Primary Examiner* — Bryon Gehman
(74) *Attorney, Agent, or Firm* — Malin Haley DiMaggio & Bowen, P.A.

(57) ABSTRACT

A dosing cap for use with or without a separate container for combining two different ingredients at time of use by dispensing ingredient one from the dosing cap into a container with ingredient two. The dosing cap includes a moisture and waterproof seal to prevent the ingredients from receiving any moisture during storage, an absorbent material (desiccant) included with the seal to absorb any residual moisture in the container or that might be received into the container during storage to ensure a moisture free environment for the ingredient and a tracking device such as a radio frequency identifying chip (RFID) that is attached to the dosing cap for product identification and tracking purposes.

5 Claims, 51 Drawing Sheets

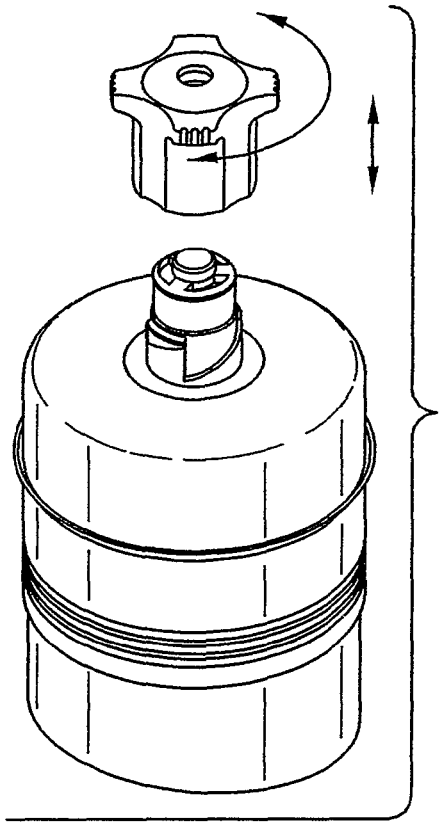
FIG. 17A
FIG. 17
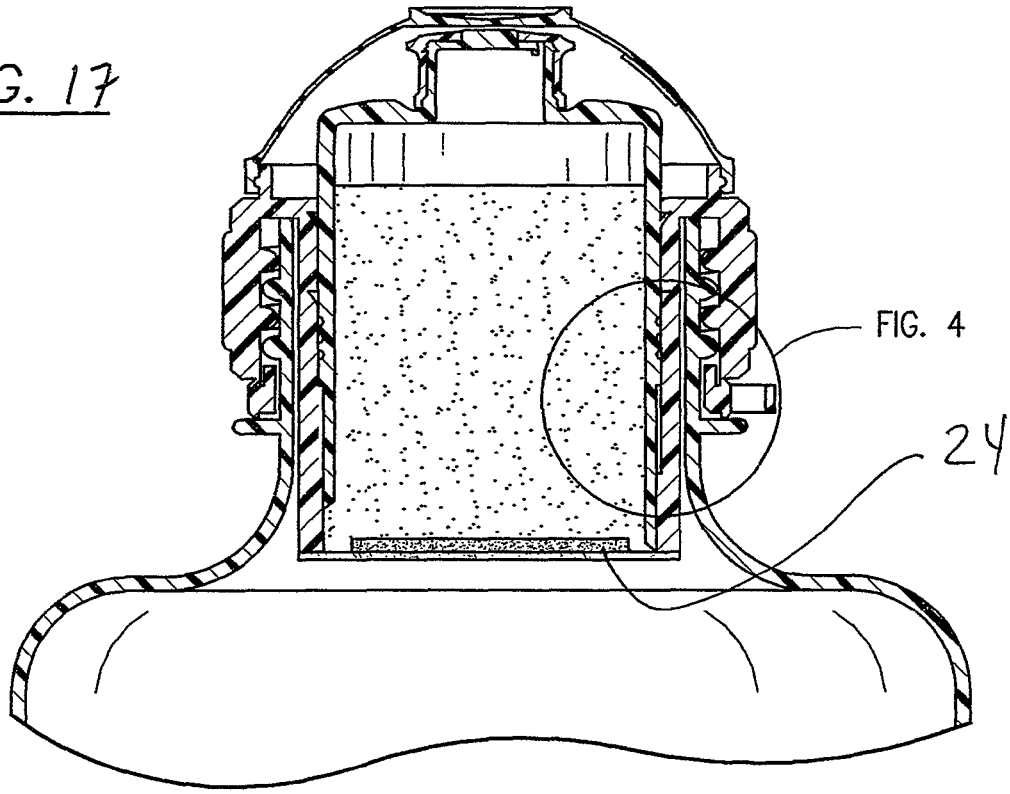

1A

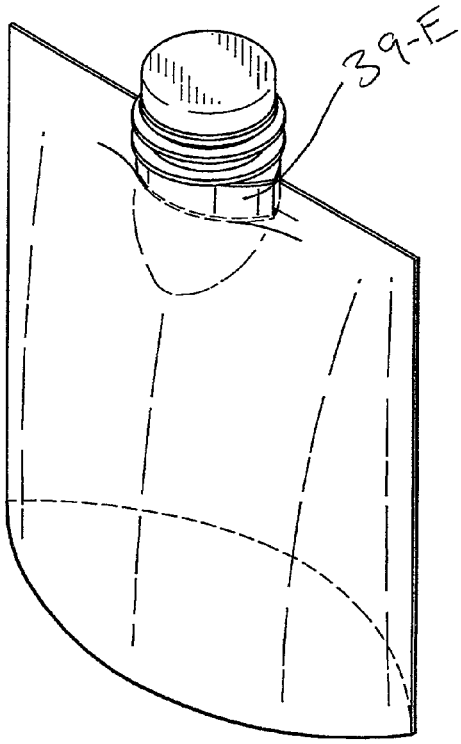
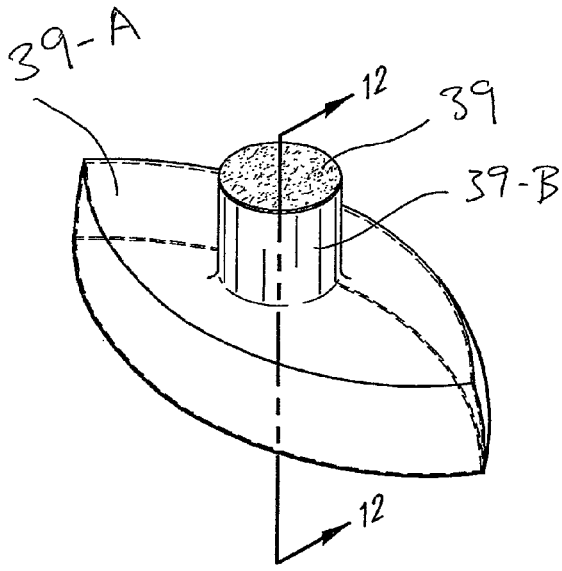
FIG. 30
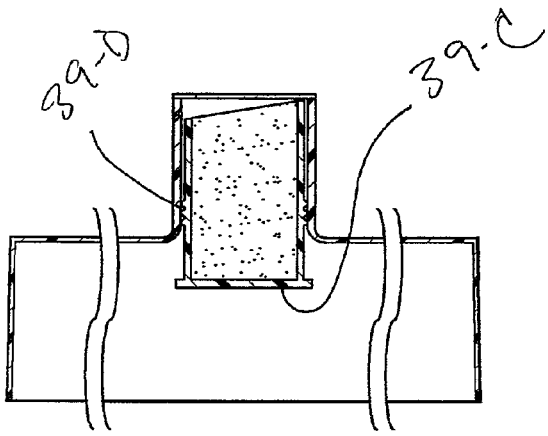
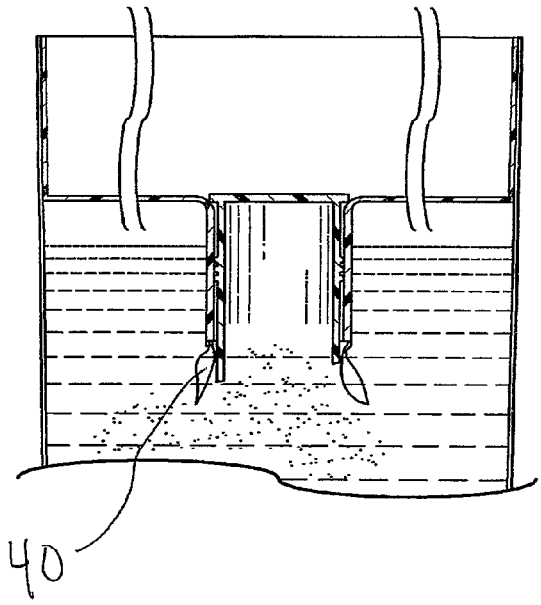

4

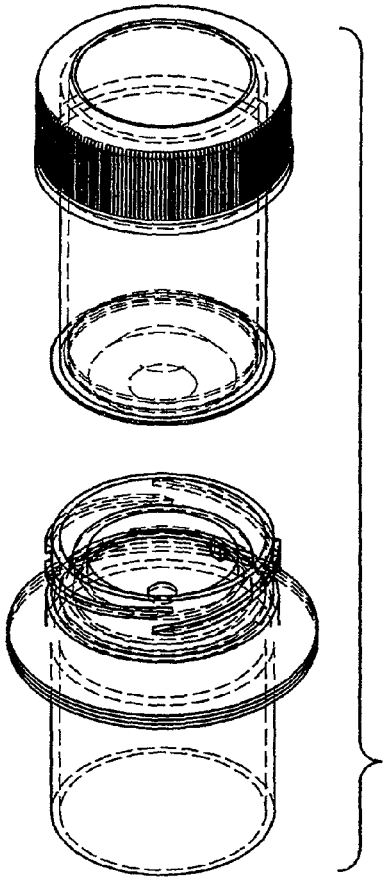
FIG. 33
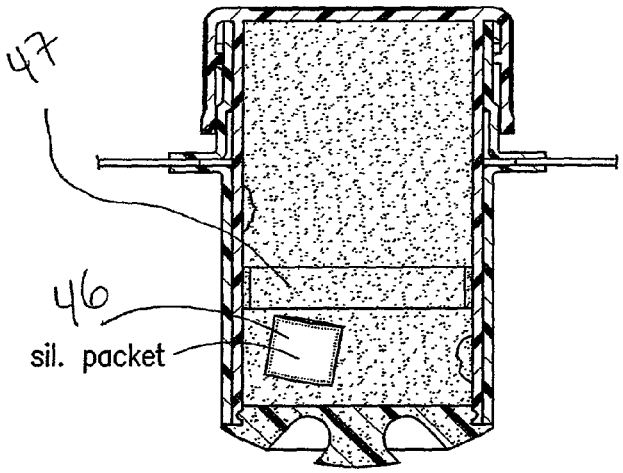
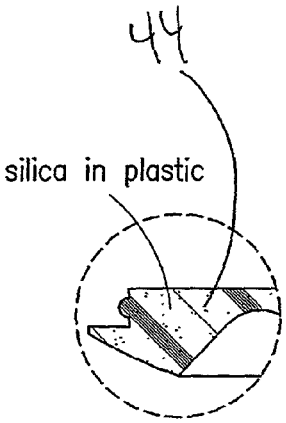
FIG. 35
FIG. 34
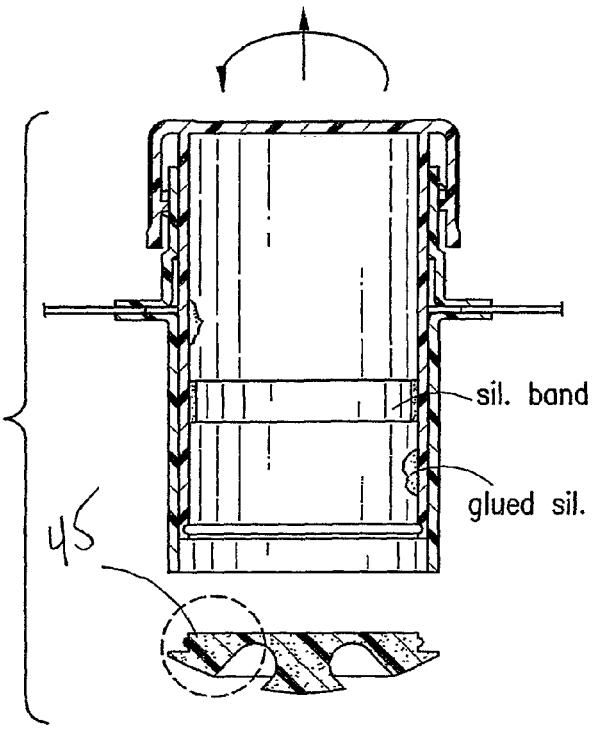

FIG. 40
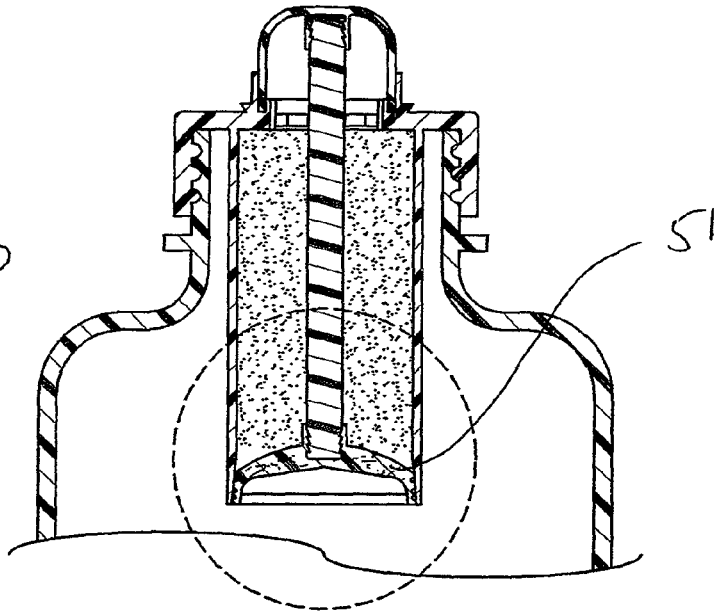
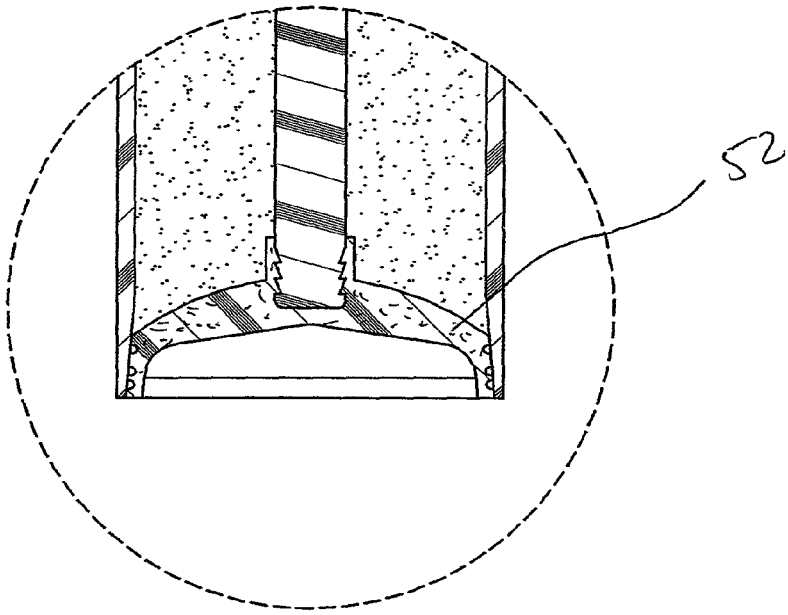
FIG. 41

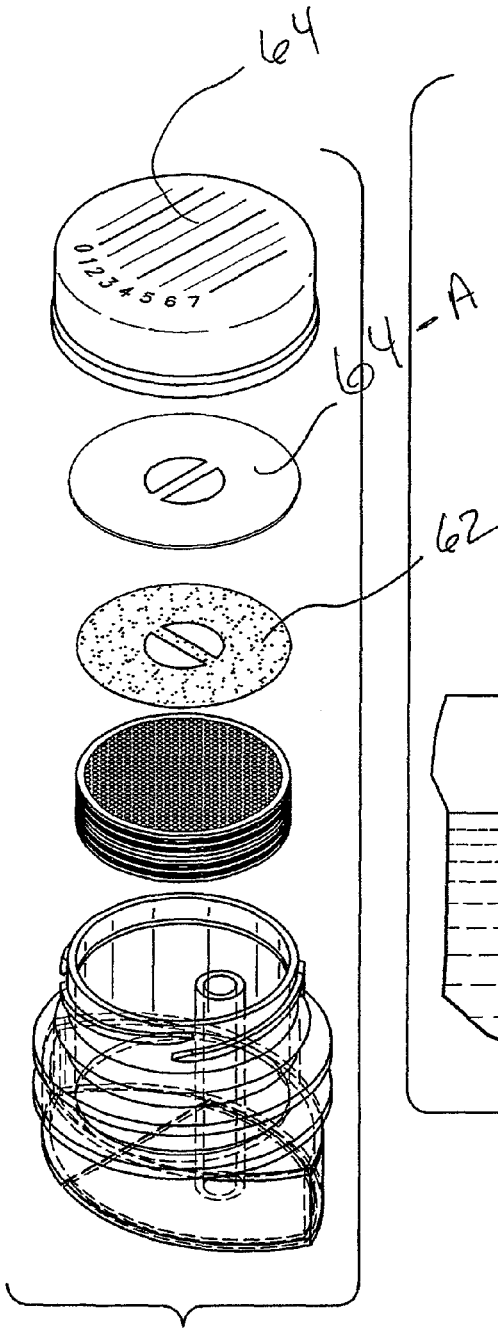
FIG. 48
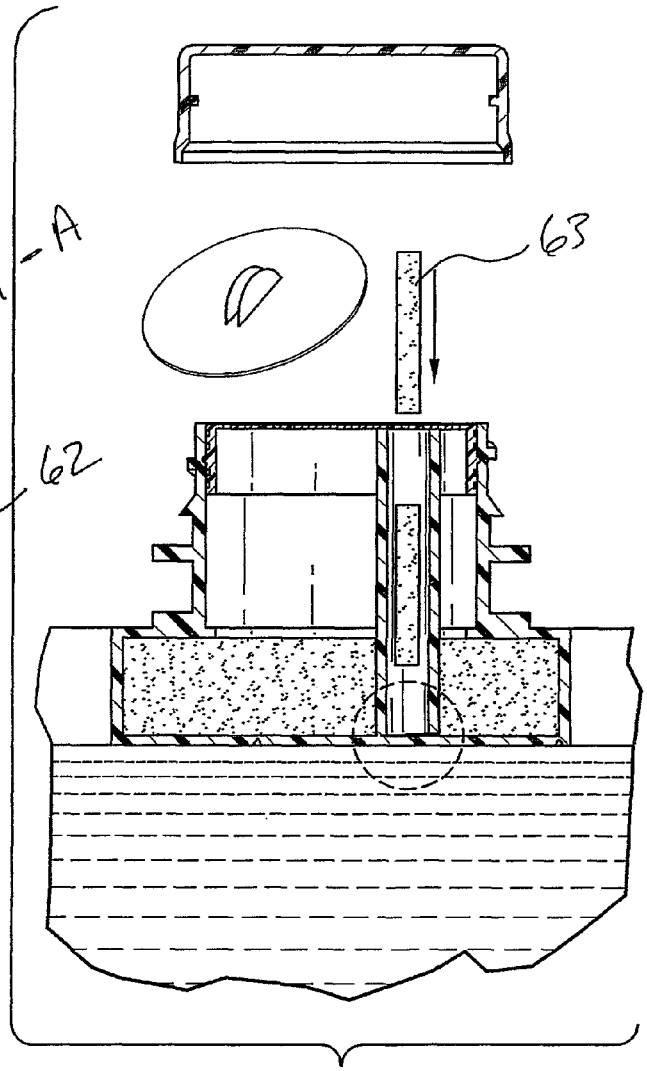
FIG. 49
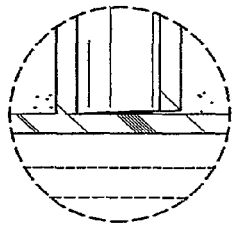

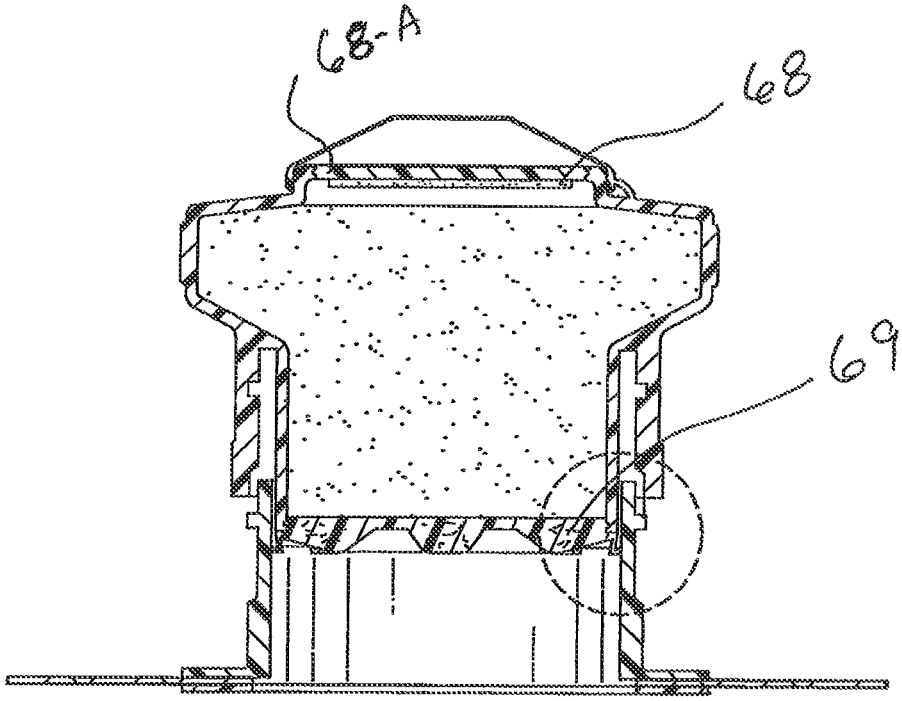
FIG. 52
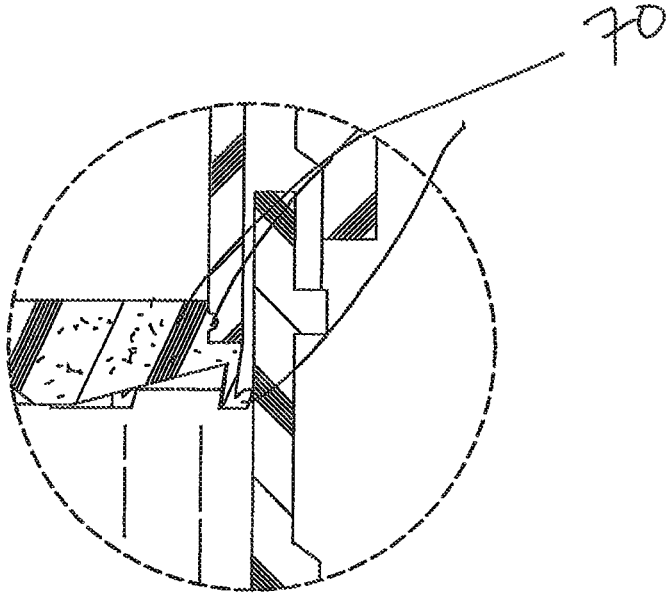

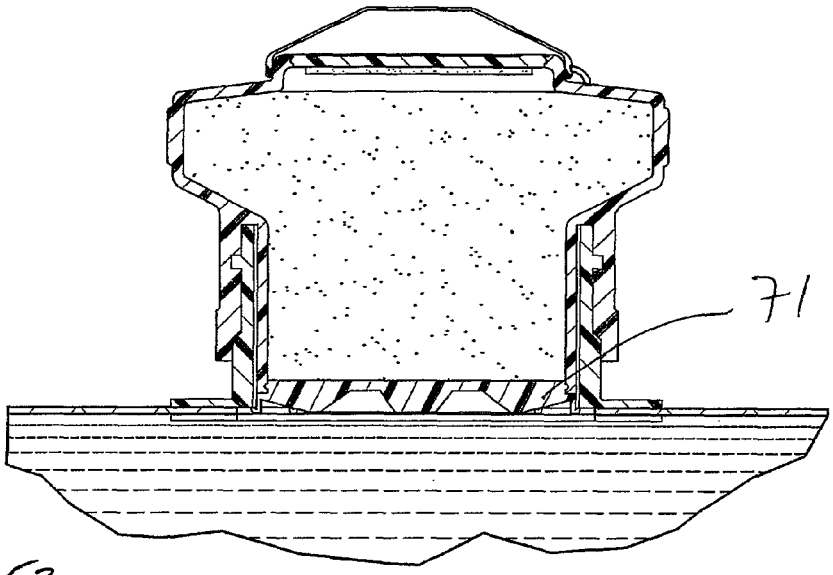
FIG. 53
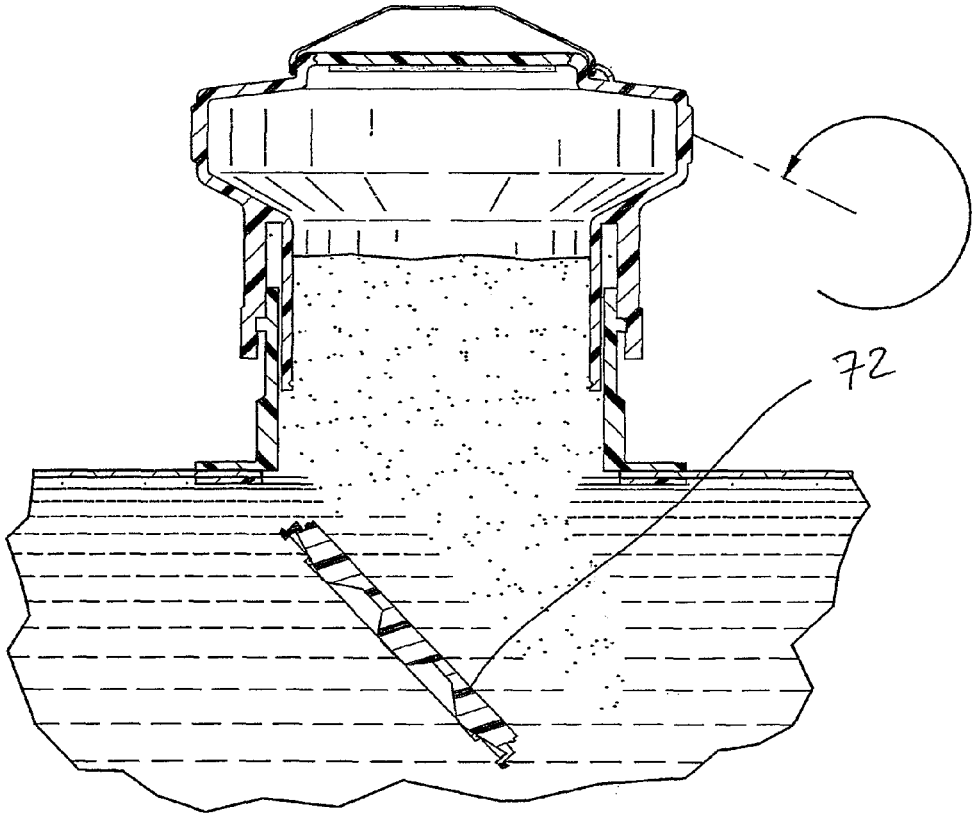

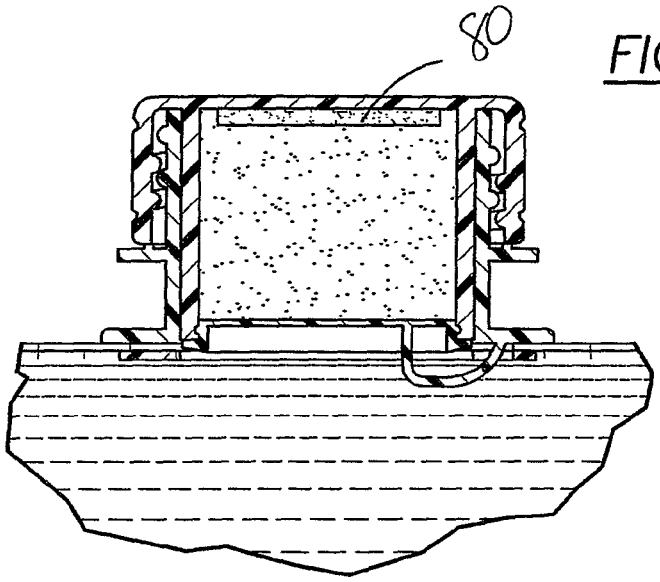
FIG. 61
FIG. 62
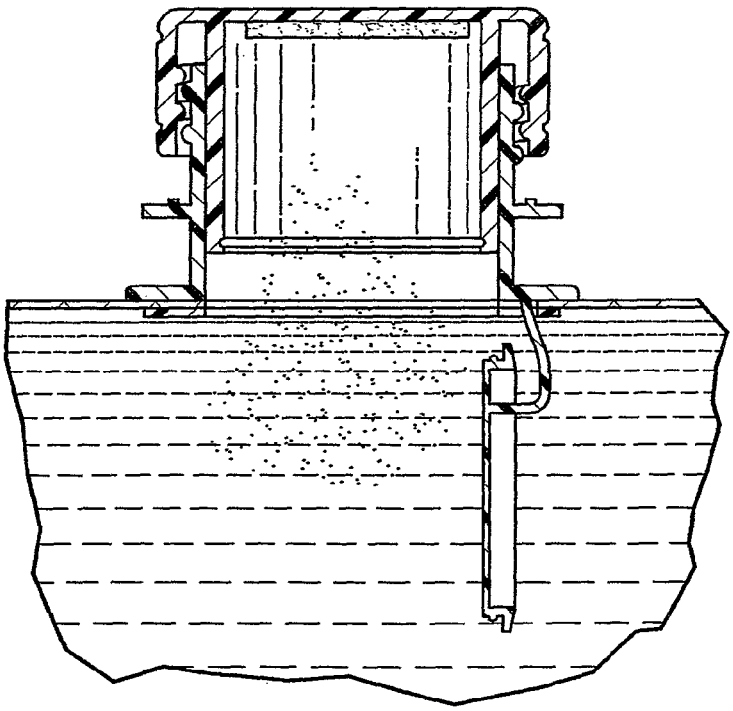

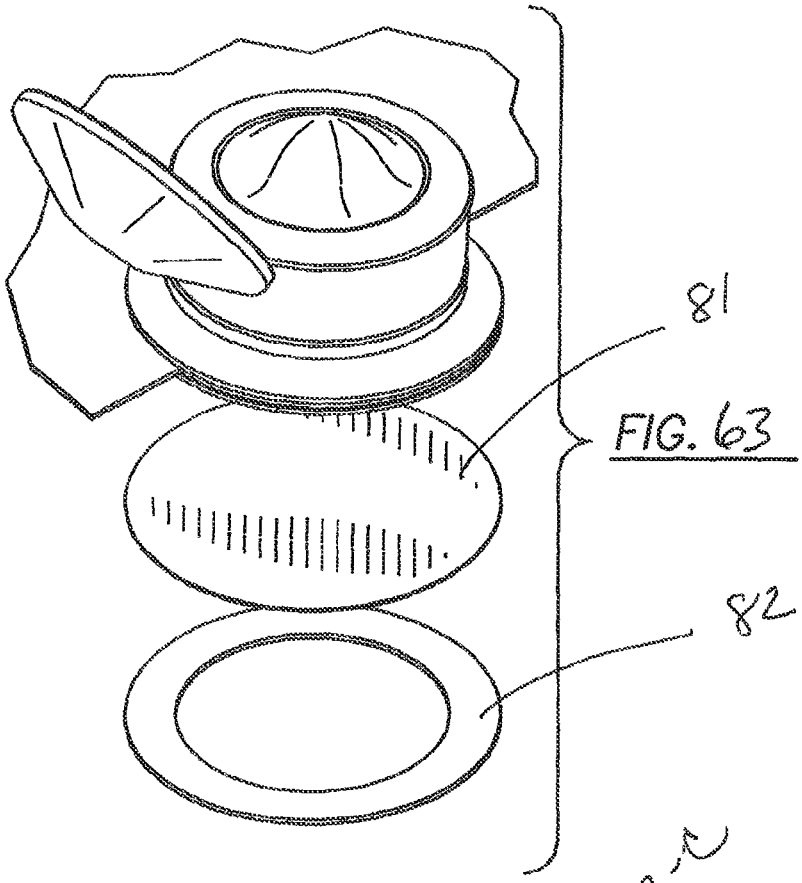
FIG. 63
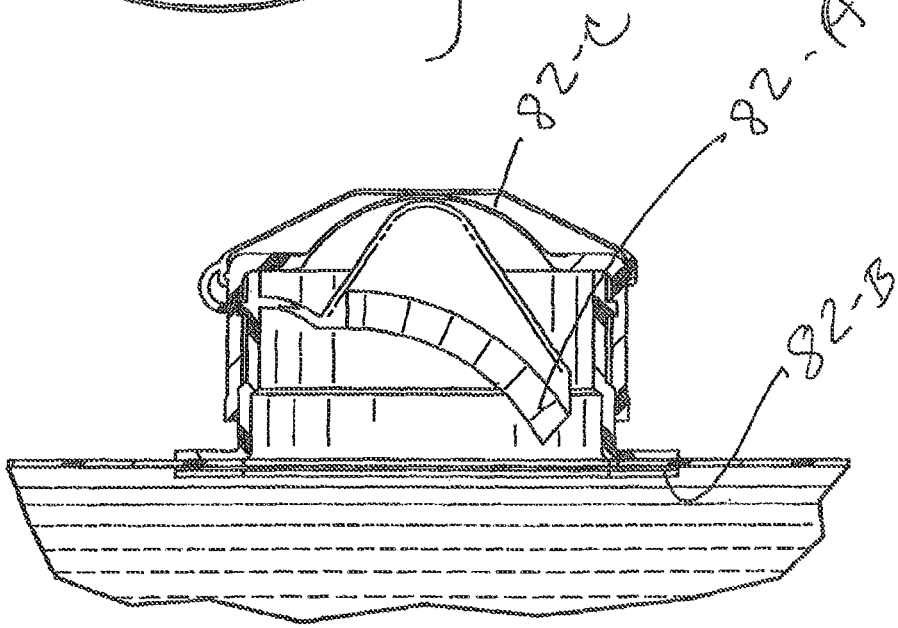

SEAL ABSORBENT PAD-RFID-BAR CODE DEVICE FOR A DOSING CAP

BACKGROUND OF THE INVENTION

1. Field of the Invention

A dosing cap for time of use combining two ingredients, said cap having tracking device including a Bar Code, RFID, Nano chip and or any other form of an information, security or tracking device and a moisture and or oxygen scavenger absorbent seal pad, seal, tape that can be made from any materials including laminations of plastic films and aluminum foil and cardboard materials, or coatings of plastic resins that can erect barriers and or breathable on one side or more for sealability of chemicals and allow oxygen, carbon dioxide, or other product degraders that can be attached in any location to an inner or outer container of any kind as well as electrical resistance properties incorporated into a seal and or dosing cap or cap including in the product packaging for sensitive electronic components to protect them from electrostatic discharge.

2. Description of Related Art

Many beverage, cleaning products, oil products, pharmaceuticals, and other chemicals and substances, do not retain their stability, strength, and effectiveness, for long after the ingredients have been mixed in a solution or suspension with a different liquid or substance. Most all liquids, gels, or acquiesce type solutions are formulated for shelf life rather than for quality, effectiveness, and potency of a product. In many cases, ingredients such as: stabilizers, fillers, preservatives, binders, and other types of chemicals and substances that now can be reduced or eliminated by this invention. This reduced shelf life after mixing mandates that the mixed product be utilized relatively soon after mixing to obtain full strength and effectiveness, to prevent loss of effective strength, deterioration, discoloration, interactions between ingredients and reduced effectiveness. In most cases in pouches, cartons, bottles and cans have added layers of certain types of films to better stabilize the already premixed substances in a bottle such as UV films or resins that can be eliminated due to this invention due to the fitment doing cap storing ingredients in the cap for at time of use activation. In other cases storage containers that have mechanisms that release ingredients at time of use have many problems on caking, clumping and limiting even shelf life due to moisture and condensation build up due to not having absorbent materials for proper barrier. Other dosing caps have an enormous problem with keeping the ingredients moisture and oxygen free and creates shelf life problems, caking and destruction of the stored ingredients or a period of time.

SUMMARY OF THE INVENTION

A dosing cap technology for information, security and tracking moisture and oxygen scavenger absorbent seal, pad, adhesive of any absorbent material also can be combined in the resin at manufacturing or material that can be attached in, into or on an ingredient(s) storage dosing chamber cap at any location of another container or separate for ingredients that can be used in a dosing/storage cap and fitment combined for releasing one or more ingredients into a pouch, carton, bottle, can, drum, tube, syringe, IV, and IV instruments, or any container that can hold any substance or substances for storing any ingredients used by a human being or animal to keep the ingredients moisture and oxygen free to allow the ingredients to remain effective and fresher for longer periods of time and can have a bar code and or a RFID, NANO chip or any other type of information and tracking devise that is part of the invention. RFID applications sometimes referred to as "tags" or "labels," are tiny semiconductor chips that emit radio-level signals. These signals are picked up by "readers" in distribution centers or stores which, in turn, relay data to computers to indicate the location of shipments in the supply chain. A dosing cap can be part of a molded bottle, be separate, made with screw, snap in rims, rims, flexible or non flexible shoulders on the outside of the body for allowing one size fits all, plugs or any other way of attaching to a container or being able to dispense from a dosing cap chamber that can be made of any biodegradable material including but not limited to PPA from corn, potato, any vegetable, bean, seed, root, leaf or fiber or other natural substance originally derived from in any combination including but not limited to using plastics, rubbers, metals or any other substances in any combination to be mixed with that holds ingredients separately until an at time of use activation. Release properties can be added to the dosing cap resin or cap to prevent food or other materials from sticking to the packaging. The invention can be used for any type of dosing, dispensing or self activation type caps or containers that can include a substance storage chamber having a no line of weakening, line of weakening, frangible, or tearable base, screw, twist, push or pull opening mechanism for a sealed unit or a non sealed unit including any type of cap like device. The invention can also have added UV protection and heat and moisture additives either pre and or post manufacturing of the dosing caps. The invention can also work with fitment cap bodies that also includes but not limited to: a threaded area, snap-in area, elongated pouch fitment or carton bottom, that be placed in, over, on top, or around openings or attached to such as: a pouch, carton, bottle neck, can, tube, ring or any other holding, attaching and seal ring device. Seal rings located throughout the invention can have expandable rubber or plastic in a double molding process thereby allowing a tighter air tight fit so when air, water or humidity tries to enter into the container the seal rings can expand to have a tighter seal. The invention can also have venting systems on the body and or on the plunger to allow air or gasses to escape during assembly. The invention of the information, RFID, tracking, holograms, color or tracking ingredients to resin, metal cardboard or glass, bar code absorbent seal, pad, tape or can be attached or adhered or manufactured in to or on the dosing cap at any location and or the seal at any location by pressure, adhesive, heat, in the resin of the chamber or body or cap or by any other method and can be made of any materials and any combination including but not limited to breathable material, foam, metal, plastic, absorbent material natural and or synthetic, charcoal, PLA, potato, corn, vegetable, glucomannon, calcium, magnesium, chitosan, card board and adhesives. This multi invention can also have located at any location of the invention attached by any means a nano chip, RFID and bar code for information and tracking of the invention. Electrical resistance properties can be incorporated into product packaging for sensitive electronic components to protect them from infrastructure capable of supporting RFID applications as they become commercially viable technologies over the next few years. Over time, RFID will offer compelling advantages over the barcode systems currently in use because it delivers a higher level of information and requires a lower level of human intervention. RFID applications, sometimes referred to as tags or labels, are tiny semiconductor chips that emit radio-level signals. These signals are picked up by readers in distribution centers or stores which, in turn, relay data to computers to indicate the location of shipments in the supply chain. While supply chain tracking is an initial application, the benefits of RFID will multiply over time to generate a complete revolution in the production, distribution, and even marketing of products. One benefit of RFID is that it will enable retailers to track "product velocity," the pace at which product is moving off store shelves. Further, RFID-tagged packages will facilitate improved price consistency across stores, allow more fluid pricing practices, monitor product shelf-life, and deter theft and counterfeiting. additional anti counterfeiting measures can be added are laser coding or molding, which provides a permanent barcode, alphanumeric code, or other identifying mark on the package, usually by burning or molding away ink in the relevant areas. Other, overt solutions can include hard-to-duplicate color shifting inks or barcodes with chip devices applied over specific molded tagged areas and embedded electronic sensors, which can be applied during the commercial printing process. An absorbent seal, pad or seal that can be attached by any means to an inner or outer container that holds ingredients in chamber container type cap can be used for any container used to store different substances that can accept and hold different products and ingredients including a dosing cap to release ingredients into another container. The seal pad or seal that can be attached to an inner or outer container that holds ingredients for any fitment cap includes its own substance storage and release chamber. Any substance or substances that are stored in the fitment cap can be dispensed into any container for mixing with the container contents manually by an individual when ready for use. The shelf life of the combined substance in this invention can be extended indefinitely. The invention can be used as an absorbent storage chamber for any substances or ingredients that can be admixed with any other substance that is stored in a container and then used by an individual. The invention can also have an anti microbial film or ingredients added.

In accordance with these and other objects which will become apparent hereinafter, the instant invention will now be described with particular reference to the accompanying drawings.

BRIEF DESCRIPTION OF THE DRAWINGS

FIG. 17 shows a front sectional view of an attached absorbent seal to a dosing push pull chamber.

FIG. 17A shows a front view of a dosing chamber with a twist top on a dosing cap and identification materials can be imbedded in the resin for any type of dosing cap.

FIG. 30 shows a front view of the absorbent seal attached to a bottom area of a container that can hold substances separate until time of use and a separate molded part of any material that can include the body area of a doing cap that can be applied to any type of container, pouch, bottle or brick pack.

FIG. 33 shows a front sectional view of a packet of the invention that can be placed into a dosing container of any kind.

FIGS. 34 and 35 shows a front sectional view whereby the absorbent seal can be imbedded in the resin or raw material at manufacturing in any portion of a dosing capsule.

FIG. 40 shows a front sectional view whereby the invention can be added into a structural area of a dosing cap.

FIG. 41 shows a blown up sectional view and shows a front sectional view of FIG. 40.

FIG. 48 shows a front view of a dosing cap with an absorbent seal that can be attached to a pouch or carton with one or more seal areas for the attachment with a bar code and RFID that can be attached to a dosing fitment capsule for a flexible or non flexible material.

FIG. 49 shows a front sectional view of a pole like devise that is made of the an absorbent material whereby it can be placed at any location of a dosing capsule with a line of weakening bottom that can be attached to a flexible pouch or carton like container.

FIG. 52 shows a front sectional view a dosing cap where an absorbent seal can be attached and a plug like bottom with snap in position bottom.

FIG. 53 shows a front sectional view a dosing cap where an absorbent seal can be attached and a plug like bottom with snap in position bottom.

FIGS. 61 and 62 shows a front sectional view of a dosing cap that an absorbent seal pad can be attached on the upper area of a dosing cap with a bottom that remains attached to the dosing cap after activation.

FIG. 63 shows a front view of a dosing cap that can be attached to any surface area of a container and can be depressed from the top to open the bottom into a container with a blade like devise that remains connected to the inside area of the body.

FIG. 70 shows a plunging mechanism for a dosing cap that can have one or more venting channels of any size, width, or height to allow air and gases to escape while assembly of the dosing cap and seal rings for a tight seal and positioning and a flat or any shape top portion that can include any type of push pull, flip top, twisting top to allow liquid to flow from.

PREFERRED EMBODIMENT OF THE INVENTION

Figure 1:
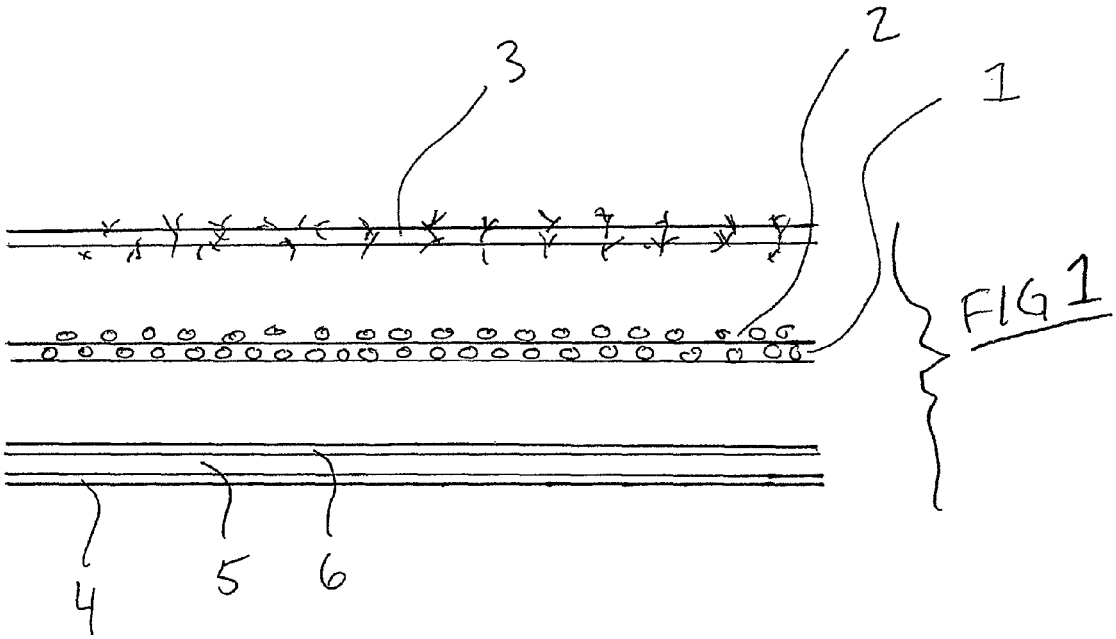
FIG. 1 shows a front sectional view of a seal that has an absorbent material of any kind or combination of any kind and other layers of materials such as a metal foil like sheet that can be coated with a plastic like material to be able to adhere to another layer and to a surface and able to breath from a breathable material from at least one side one side if preferable.

FIG. 1 shows a laminate or layers of materials in which elements 1 and 2 are a layer of an absorbent material that absorbs moisture (desiccant) from the outside environment.

Figure 2:
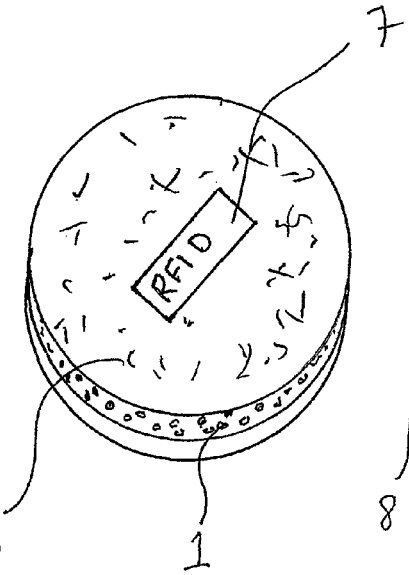
FIG. 2 shows a top side view of the invention with breathable surface, nylon or any other materials and barrier or semi barrier coating to allow moisture and oxygen flow to be trapped by the absorbent material(s) and RFID of Nano type devices to allow for information, tracking color shifting inks and or barcodes with chip devices and can be applied over specific molded tagged areas in, under or on the dosing cap or cap or bottle or label or any other location of the finished product if desired.

FIG. 2 shows a representative dosing cap in which there is a mesh layer 3 and the absorbent material 1 which also may include embedded therein an RFID identification cap, all of which can be placed or attached to a dosing cap.

Figure 3:
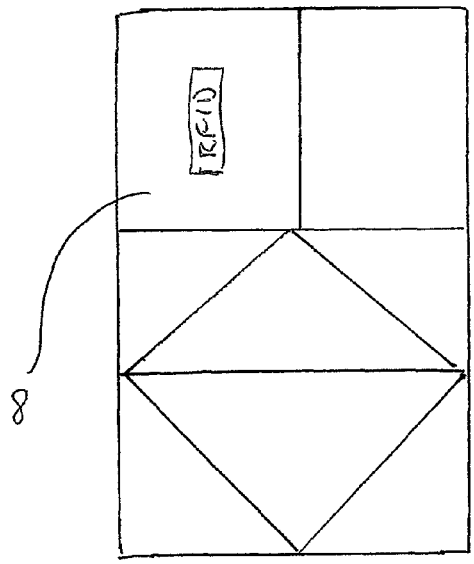
FIG. 3 shows an upper top view and can be made of any shape including round. The more strait cuts in manufacturing will have less waste and can incorporate. Also RFID of Nano type devices can be applied to allow for information, tracking color shifting inks and or barcodes with chip devices and can be applied over specific molded tagged areas

FIG. 3 may be some type of mesh that covers the absorbent materials 1 and 2 that engages the ingredients inside a dosing cap as if this were a bottom layer. FIG. 3 shows a seal that could be used to seal a dosing cap.

Figure 4:
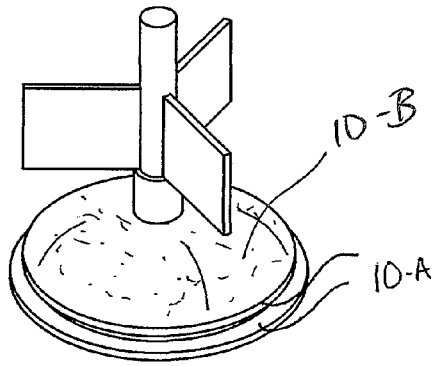
FIG. 4 shows a bottom of a dosing cap that can incorporate absorbent materials in the resin or applied to with expandable seal rings.
Figure 6:
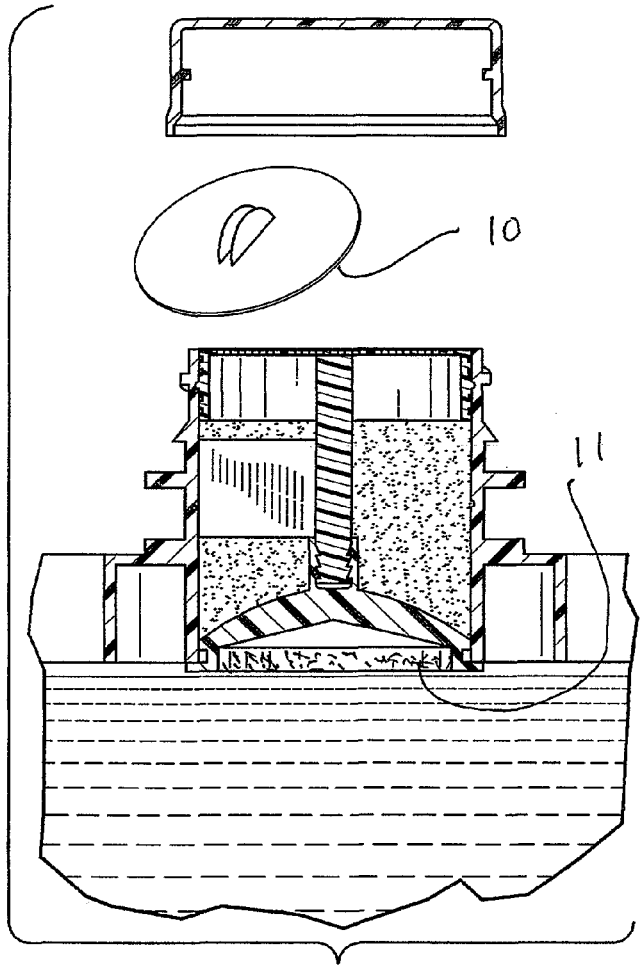
FIG. 6 shows a sectional view and upper view of the invention incorporated I a container cap.

FIGS. 4 and 6 represent seals or inner sealing layers that constitute the base of a insert into a dosing cap.

FIG. 4 represents a plunger inside a dosing cap with the sealable layer that includes the extra materials 10*b* that would be placed inside the dosing cap for the absorbent and the sealing of the chamber so that it is airtight and watertight.

FIGS. 5 through 11 show representative dosing caps that include the absorbent layer (desiccant) and RFID and a seal so that the contents which have ingredients in them cannot get exposed to any moisture during storage.

FIGS. 12 through 21 show a plurality of different styles of dosing caps that can be actuated differently, that all contain ingredients that are protected by an absorbent layer and air and watertight seal and include a RFID tracking device.

Figure 22:
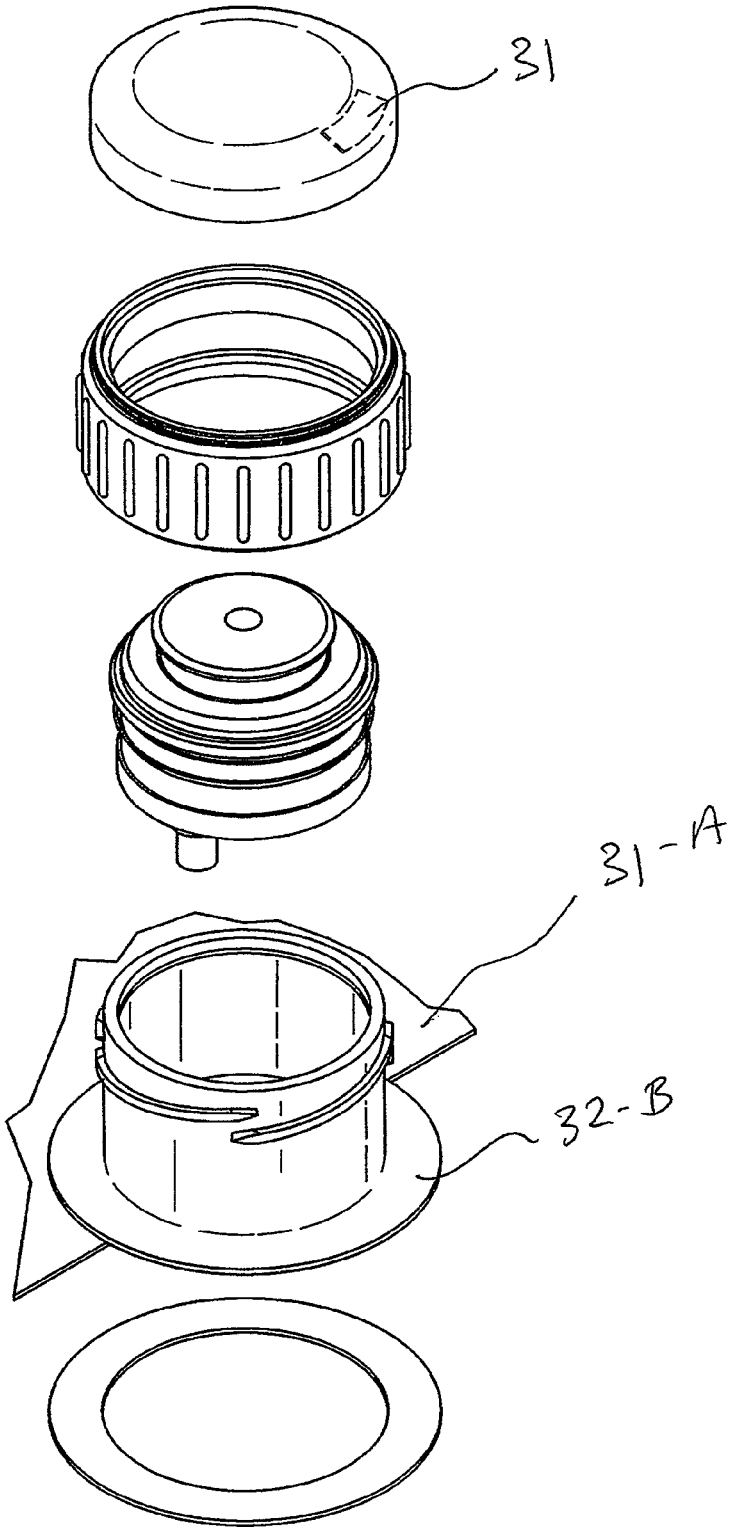
FIG. 22 shows a front view whereby an absorbent seal and or RFID or identification or information devise can be attached to any location of a dosing cap.

FIG. 22 shows an exploded view of a manually actuated dosing cap.

Figure 23:
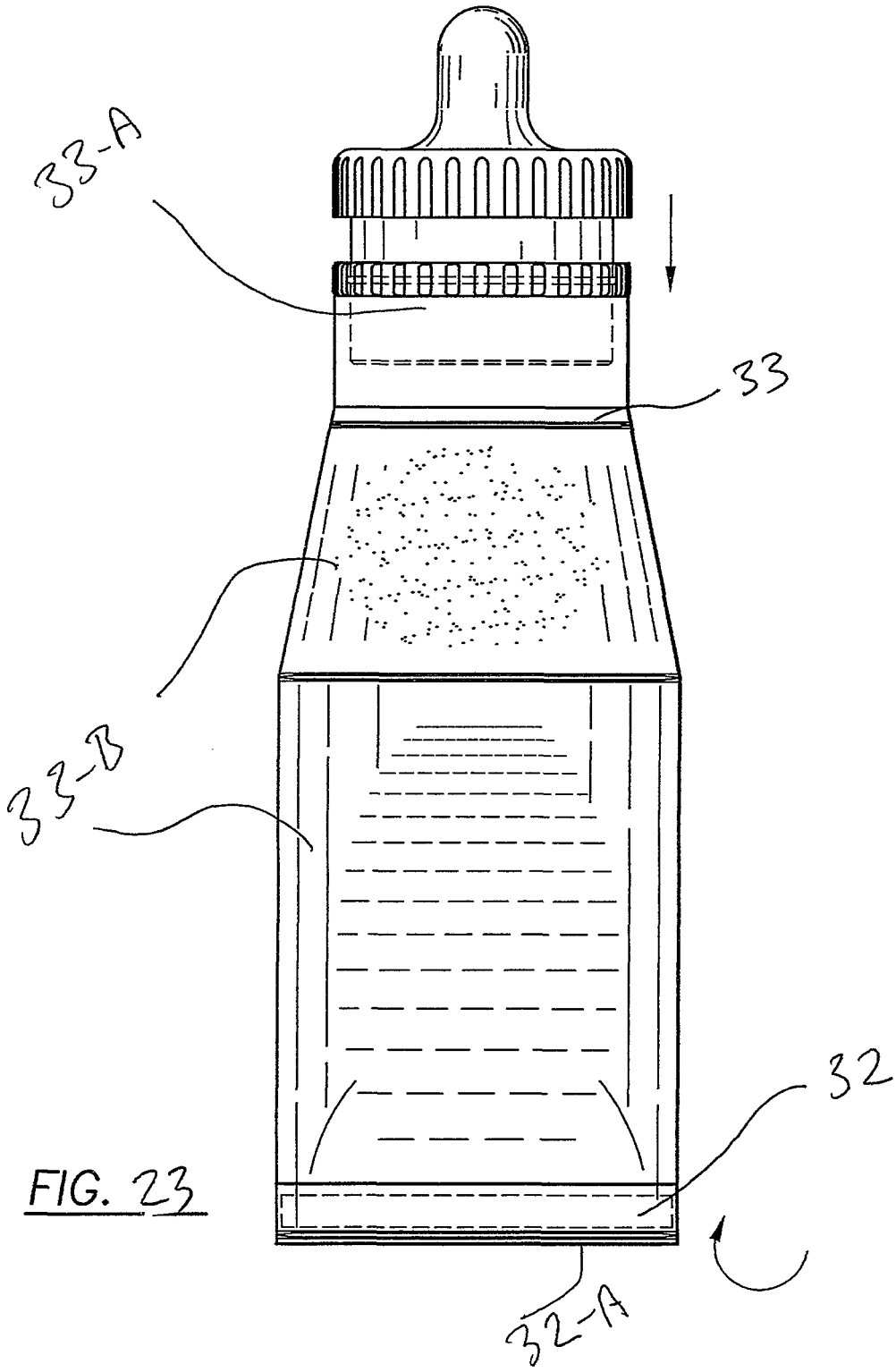
FIG. 23 shows a front view of the absorbent seal that can be attached by way of adhesive or heat for a pouch or carton (flexible or non flexible surface area).

FIG. 23 shows the adaptation of a dosing cap included in a baby bottle.

FIGS. 24 through 31 show a plurality of dosing caps that can be manually actuated for use with pouches. The dosing caps also include an absorbent layer material, adequate seals and a RFID tracking chip.

FIGS. 32 through 43 show alternate embodiments using dosing caps that all include seals, absorbent material (desiccant) and RFID tracking chips.

FIG. 44 through 54 show a plurality of dosing caps attached to pouches with each of the dosing caps including a seal to prevent air and moisture from reaching the cap, an absorbent (desiccant) placed in the dosing cap and a RFID tracking chip connected to the cap.

FIGS. 55 through 69 show various embodiments of dosing caps with seals, absorbent material layers to prevent moisture from reaching the ingredients inside and RFID tracking devices.

Figure 70:
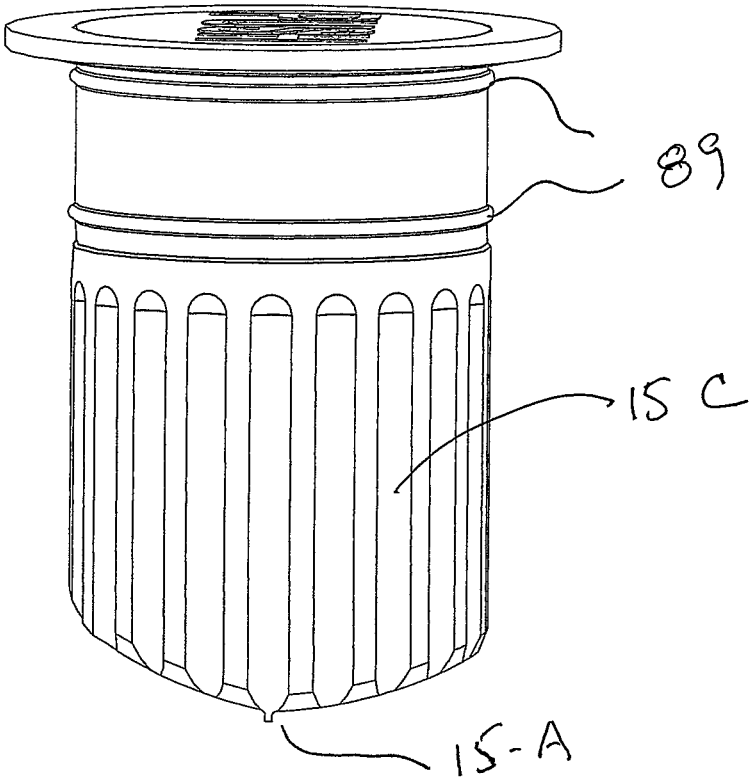
Figure 71:
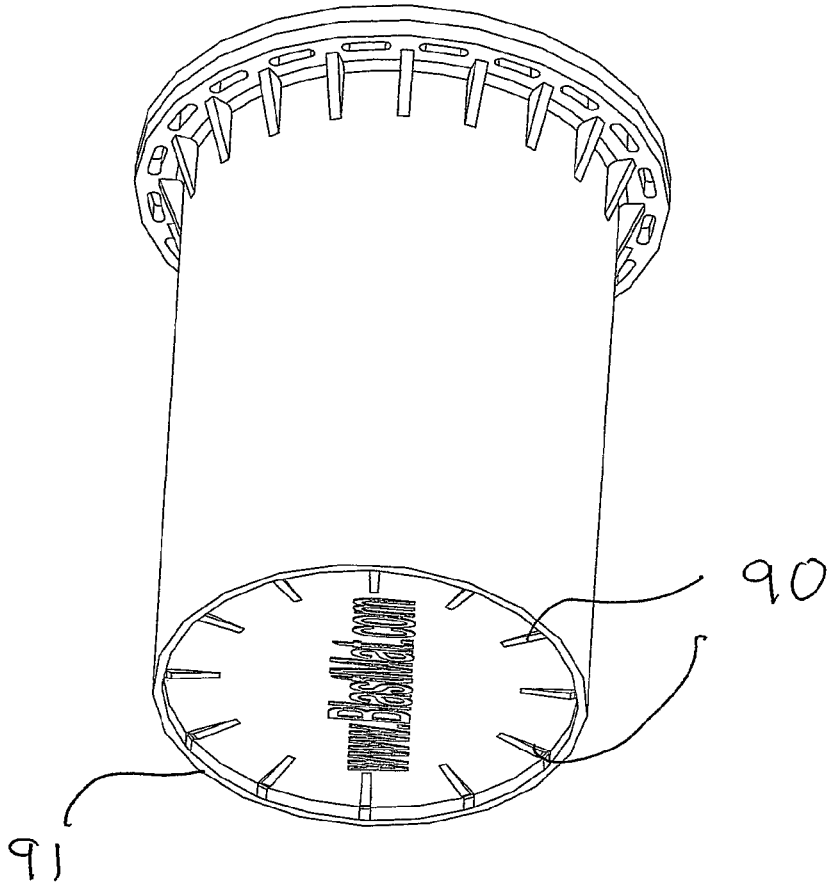
FIG. 71 shows a bottom front view of a dosing cap that has flanges or hinges that remain attached to the body area after activation with a raised bottom area for an additional sealing area for a seal.

FIGS. 70 and 71 show dosing caps that include air vents or venting channels to allow air and gases to escape while assembling the dosing cap and sealing rings for a tight seal.

Referring now to the preferred embodiment, FIG. 1, a dosing cap with an absorbent seal with a RFID chip, nano chip or any other means of a information and or tracking device including a permanent barcode, alphanumeric code, or other identifying mark on the package, including by burning or molding away ink in the relevant areas of a dosing cap, cap or container that can be part of or added to the seal or dosing cap at any location including that can be used in a storage cap container comprised of a molded body from any material including corn resin, potato resin and by products any combination of one or more ingredients of biodegradable natural resins and conventional resins including any kind of moisture resistant resins and UV resins including non stick agents can be added to the dosing cap by means of in the resin or coating and a venting system of one or more channels that can be at any location of a plunging and or body of a dosing body to allow air or gas to escape during assembly and molded in seal rings or expandable seal rings that can be double molded in place.

Now referring to FIG. 71, shows a bottom of a dosing cap that has hinge and or flange areas of one or more to allow the attached bottom-to stay attached after activated by a consumer and a raised area on the bottom for a seal to be attached.

Now referring to FIG. 3, refers to a seal that can be square, rectangular, or triangular in shape to eliminate any waste of excess material; it also can be round in shape to fit any location inside or outside a dosing cap, including: rubber expandable type seal rings that can be placed throughout areas of a dosing cap for moisture prevention.

Now referring to FIG. 4, shows a moisture and or oxygen scavenger absorbent 10B that can be added in or on any location on or in a dosing cap. Expandable rubber or plastic or any other material seal rings 10A can be added at any location on a dosing cap.

Figure 5:
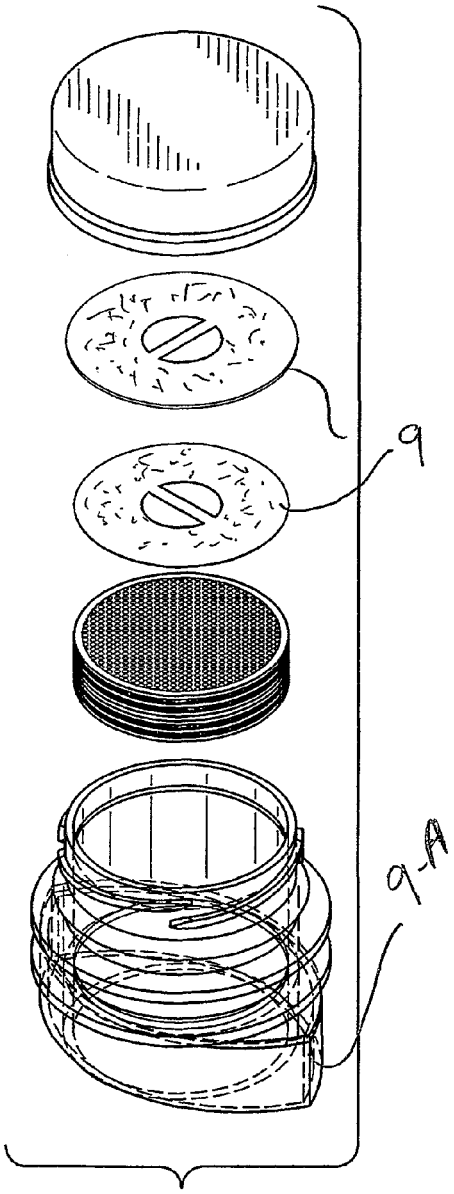
FIG. 5 shows a front view of one or more absorbent seals that can be attached to a container.

Now referring to FIG. 5, shows an absorbent seal 9 that can be added at any location of a dosing cap including for a pouch, carton, or any other packaging material that has one or more angles for attachment 9A that can be made out of a natural or non-natural biodegradable or non-biodegradable material or any combination thereof.

Now referring to FIG. 6, shows an absorbent material that can be made from a seal like material of any materials one or more in combination 11 as well as expandable and moisture an air resistant seals.

Figure 7:
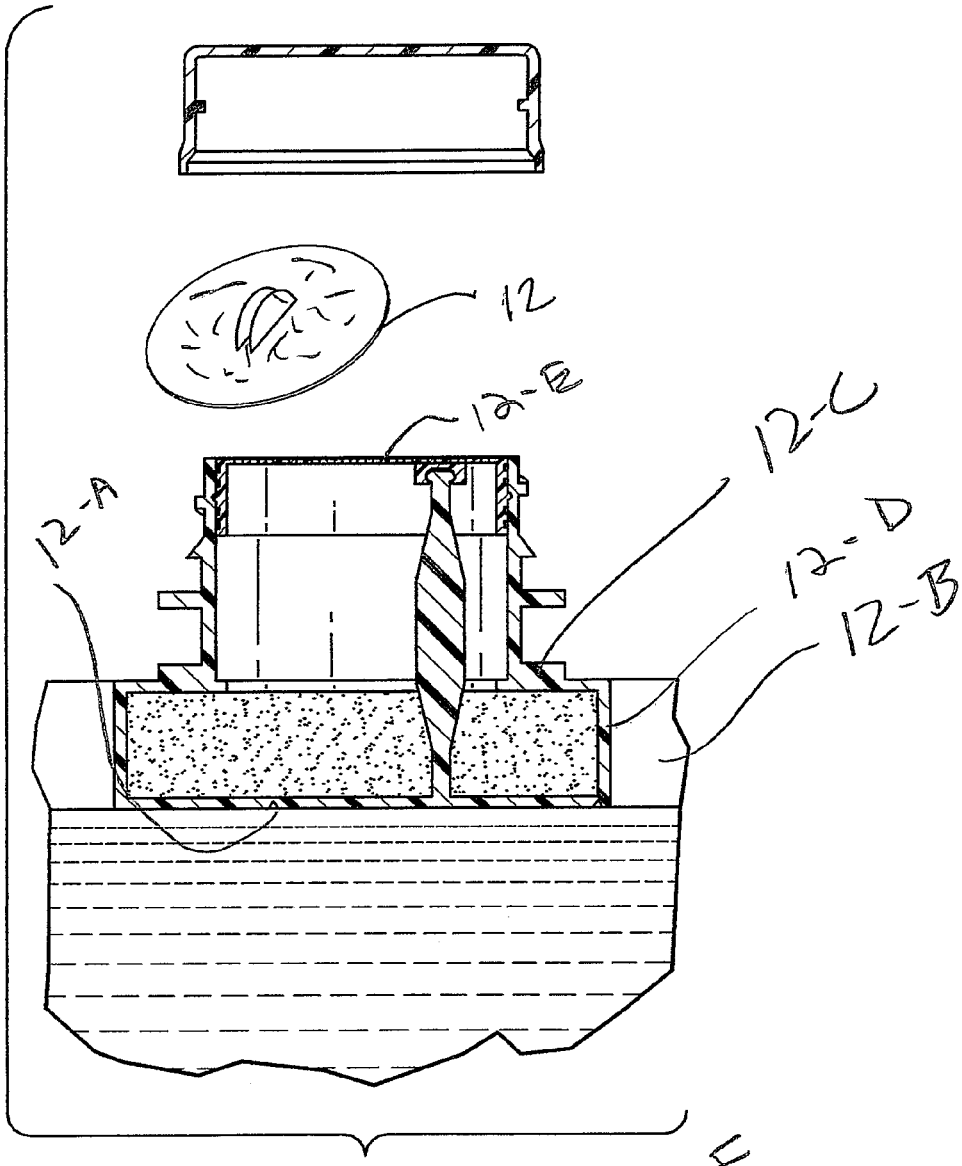
FIG. 7 shows a sectional view and side view of an absorbent seal with RFID that can be attached to a container or under a cap.
Figure 8:
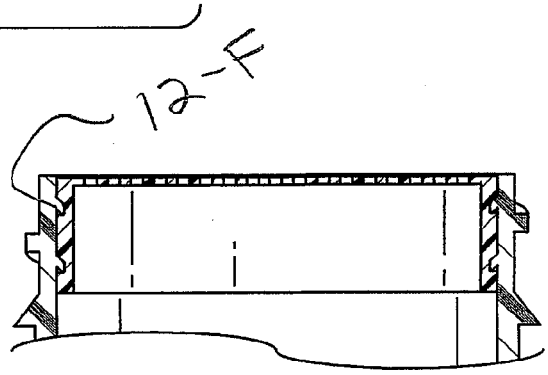
FIG. 8 is an enlarged cut-away view of the cap top shown in FIG. 7.

Now referring to FIGS. 7 and 8, an absorbent seal 12 can be added on the top of or at any location of a dosing cap that also can consist of biodegradable or non-biodegradable or any combination of thereof materials 12C that can be attached to any fitment of any container including a flexible container 12B with one or more angles for attachments to a container 12D and can have a line of weakening on the bottom or on any location 12A so that when the upper portion 12E is plunged downwardly it opens the bottom line of weakening or attached seal of any kind. The plunger mechanism 12E can have angled edge rings of any direction 12F to ensure the plunger cannot be disassembled by an individual.

Figure 9:
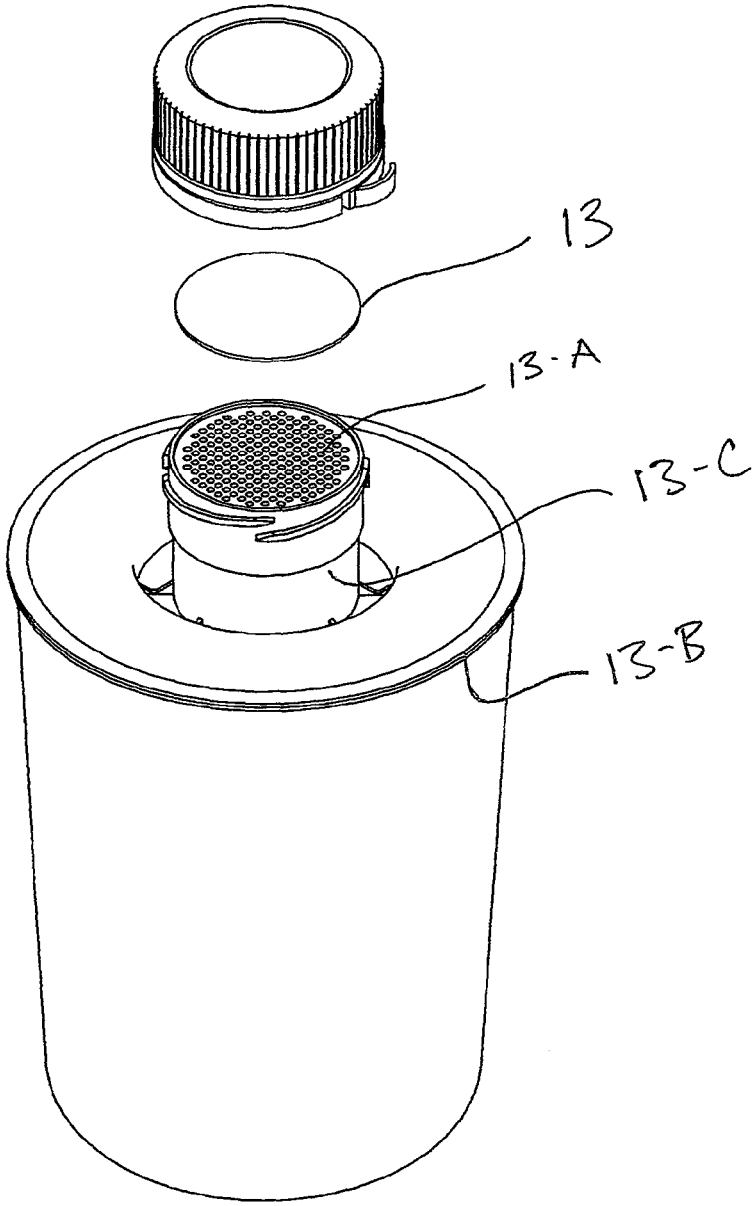
FIG. 9 shows a side view of an absorbent seal that can be attached to a filter system dosing cap.

Now referring to FIG. 9, an absorbent seal can be added under a cap including for the use of a dosing cap 13 that can fit and be attached to a screen-like plunger mechanism 13A with a holding dosing chamber cap 13C whereby one or more pieces of a blow-mold, thermal-mold, or injection-mold can be attached 13B by an means including but not limited to ultrasonic, heat, force, glue, or any other single or combination thereof.

Figure 10:
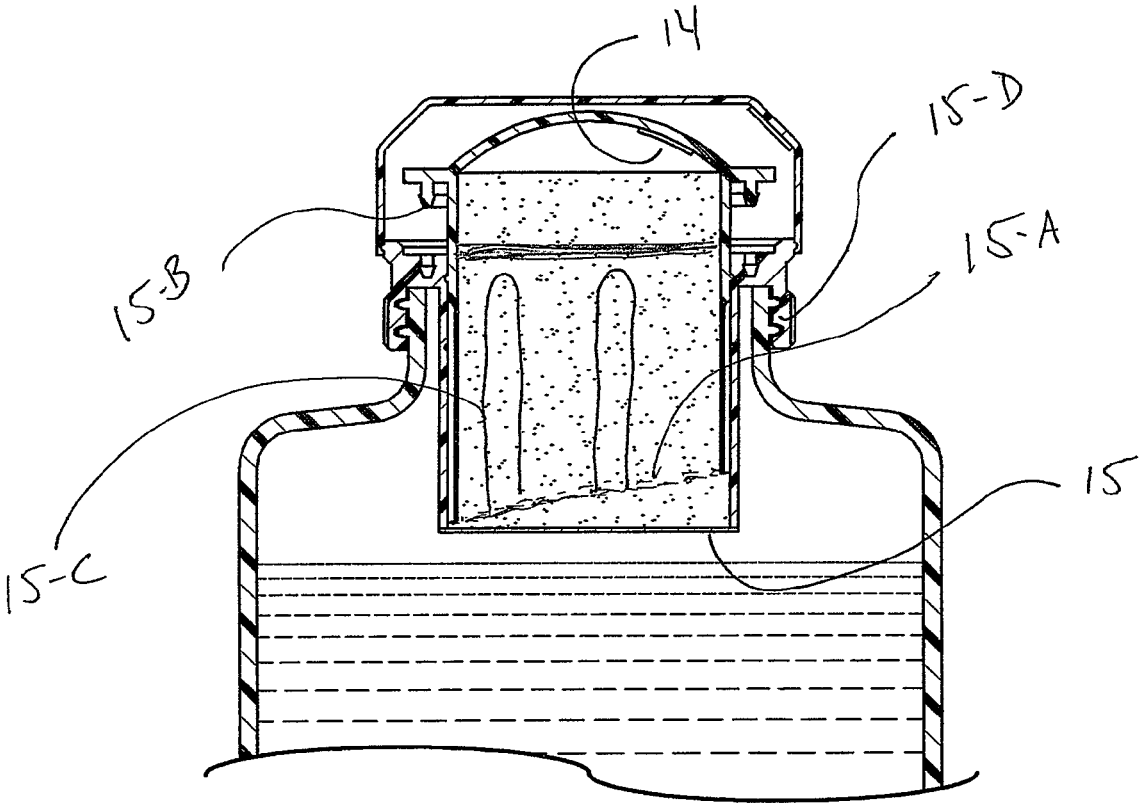
FIGS. 10 and 11 shows a front sectional view of an absorbent seal and or RFID that can be attached to a bottom, on the inside top or any other location of a dosing container. And a venting system to allow air, gases and moisture to escape while assembly of a dosing cap and seal rings that also can be double molded with expandable materials for a tight fit and an angled bottom to start the initial opening of a bottom of a dosing cap and having a closed line of weakening bottom or a sealed bottom with a seal.
Figure 11:
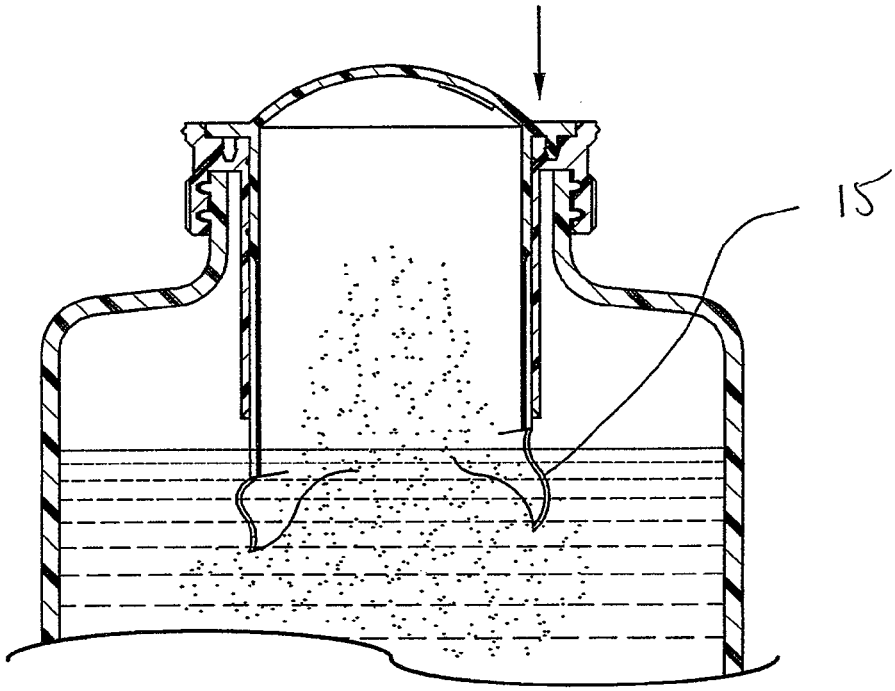
Figure 60:
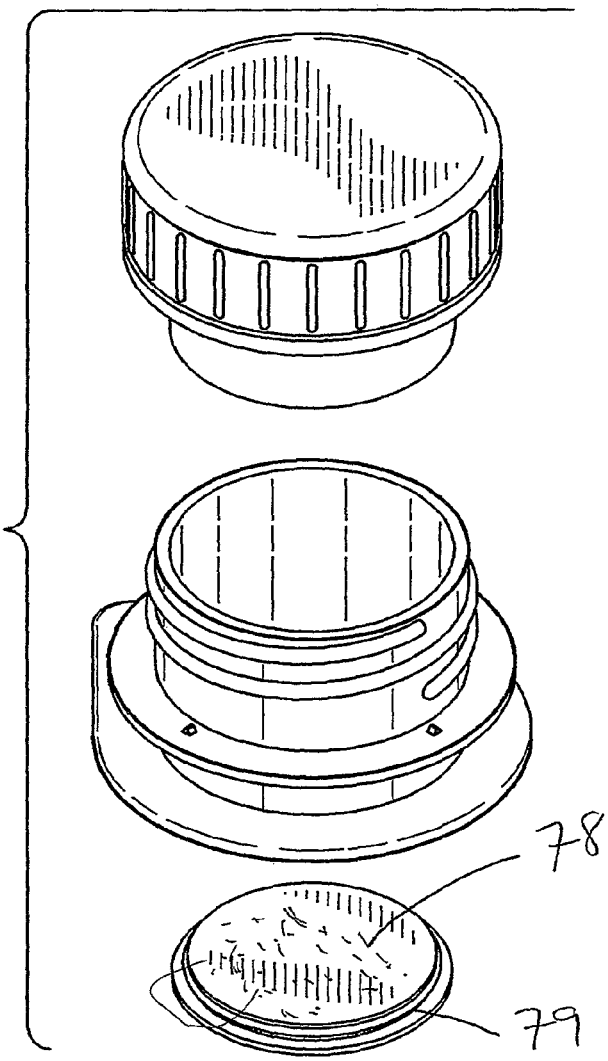
FIG. 60 shows a front view whereby the invention can be of a bottom plug like dives for a dosing cap.

Now referring to FIGS. 10 and 11, an absorbent seal and/or tracking device can be added under the upper portion of the chamber area or at any other location 14 including the bottom of the holding chamber 15 and can be opened by depressing the upper portion downwardly with an angled bottom area 15A to start the initial opening of the holding chamber and indented air vents located on the plunger and or the body area to allow air or gases to escape when assembly of the dosing cap 15C and better shown FIG. 60 can be added to the plunging device to allow air to escape during assembly of a dosing cap. After activation there can be click-in rim areas 15B not allowing the upper portion to removed by an individual and then can be manually unscrewed 15D to utilize ingredients inside.

Figure 12:
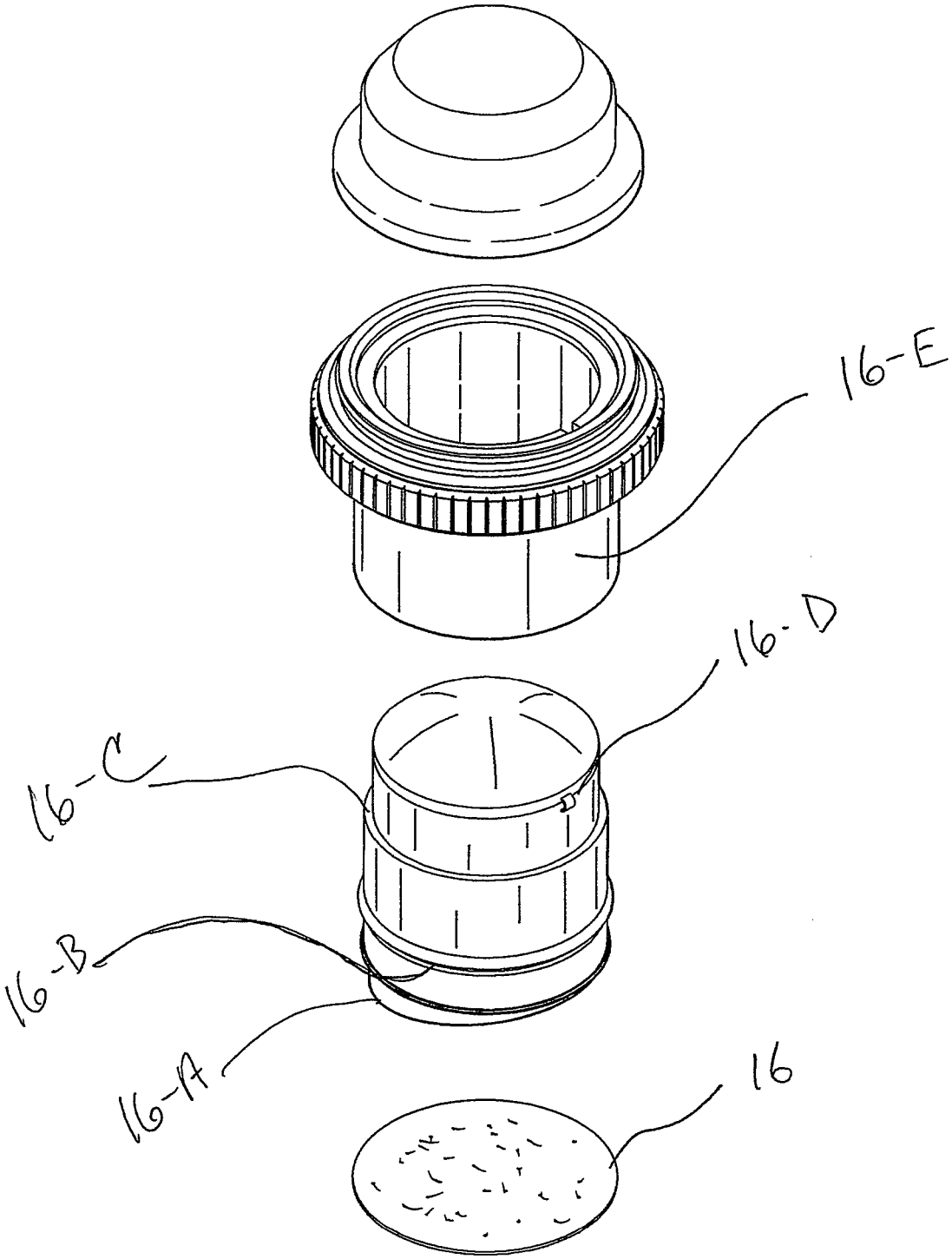
FIG. 12 shows an absorbent seal that can be attached to a dosing container of any size or shape with a one way click in barb like ring on the body of the plunger a flip lid if desired that can be attached to a treaded, non threaded, screw or snap in rim area.

Now referring to FIG. 12, shows an absorbent seal 16 that can be attached to a threaded dosing cap 16E that would be assembled from the bottom upwardly and has an edge for a one-way stop for into position 16C and that, when activated by an individual 16A, can have an angled to open the bottom seal area and having an automatic stop position for the chamber when activated 16B.

Figure 13:
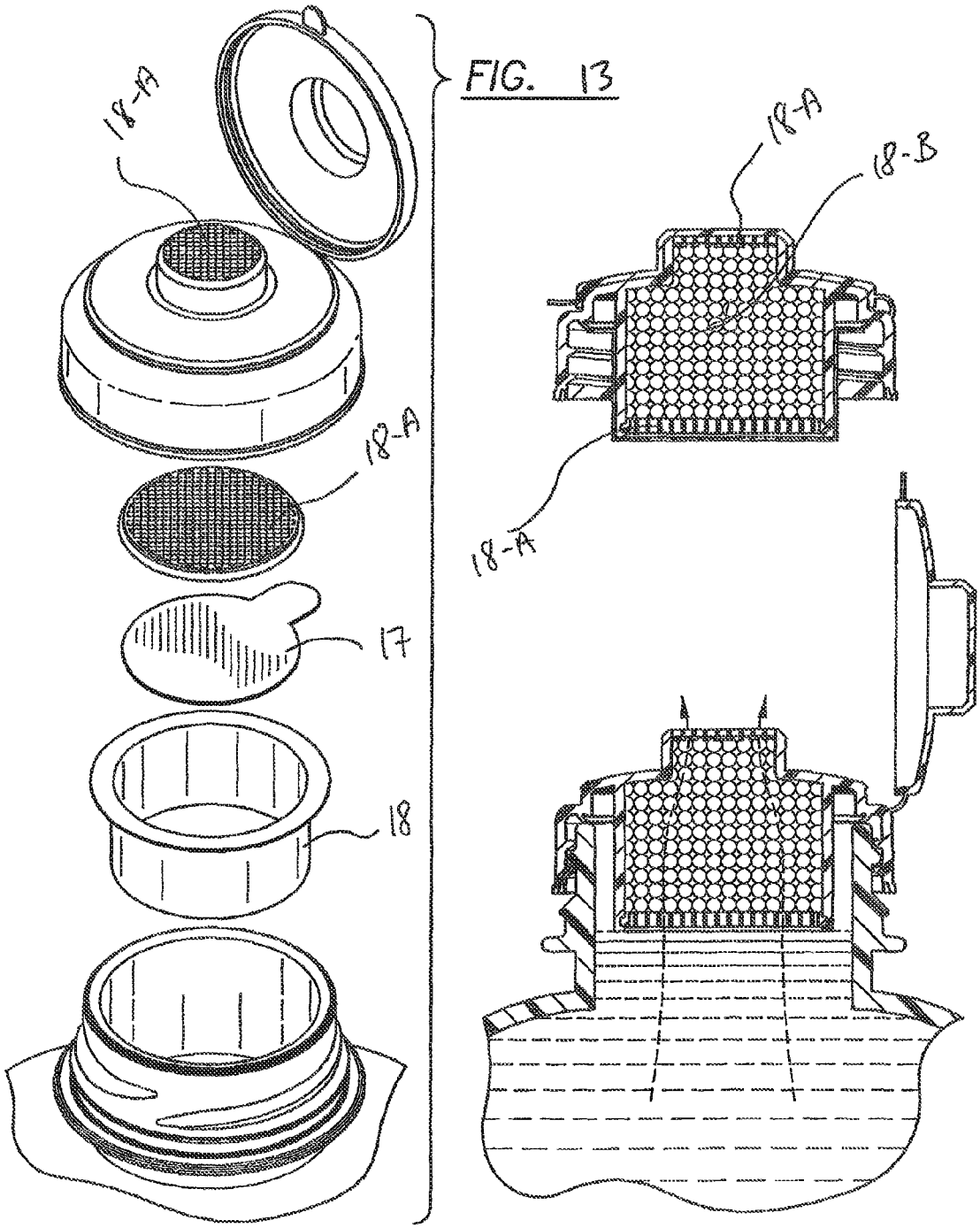
FIG. 13 shows a front view of an absorbent seal that can be attached to a dosing cap with mesh or screen like and can have a single serve cup like chamber to more ensure freshness and that can be on both top and bottom with screen or mesh like openings on the top and or bottom. The inside container can hold dissolvable or non dissolvable materials including but not limited to including but not limited to micro encapsulation, tea, coffee, bark, roots, or any other materials such as carbon, activated carbon, and KDF that can be stored in the holding chamber for specific release of ingredients so when liquid flows through the dosing cap the ingredients stored inside may activate the inside ingredients

Now referring to FIG. 13, shows an absorbent seal 17 that can be attached at any location such as a screen mesh-like area 18A that can be placed into a container similar to that of a cup-like device of single serve creamers, to ensure freshness and the holding chamber area with a screen mesh-like upper and lower area can hold products such as: any dissolvable materials including but not limited to micro encapsulation, tea, coffee, bark, roots, or any other materials that can be stored in the holding chamber for specific release of ingredients 18B.

Figure 14:
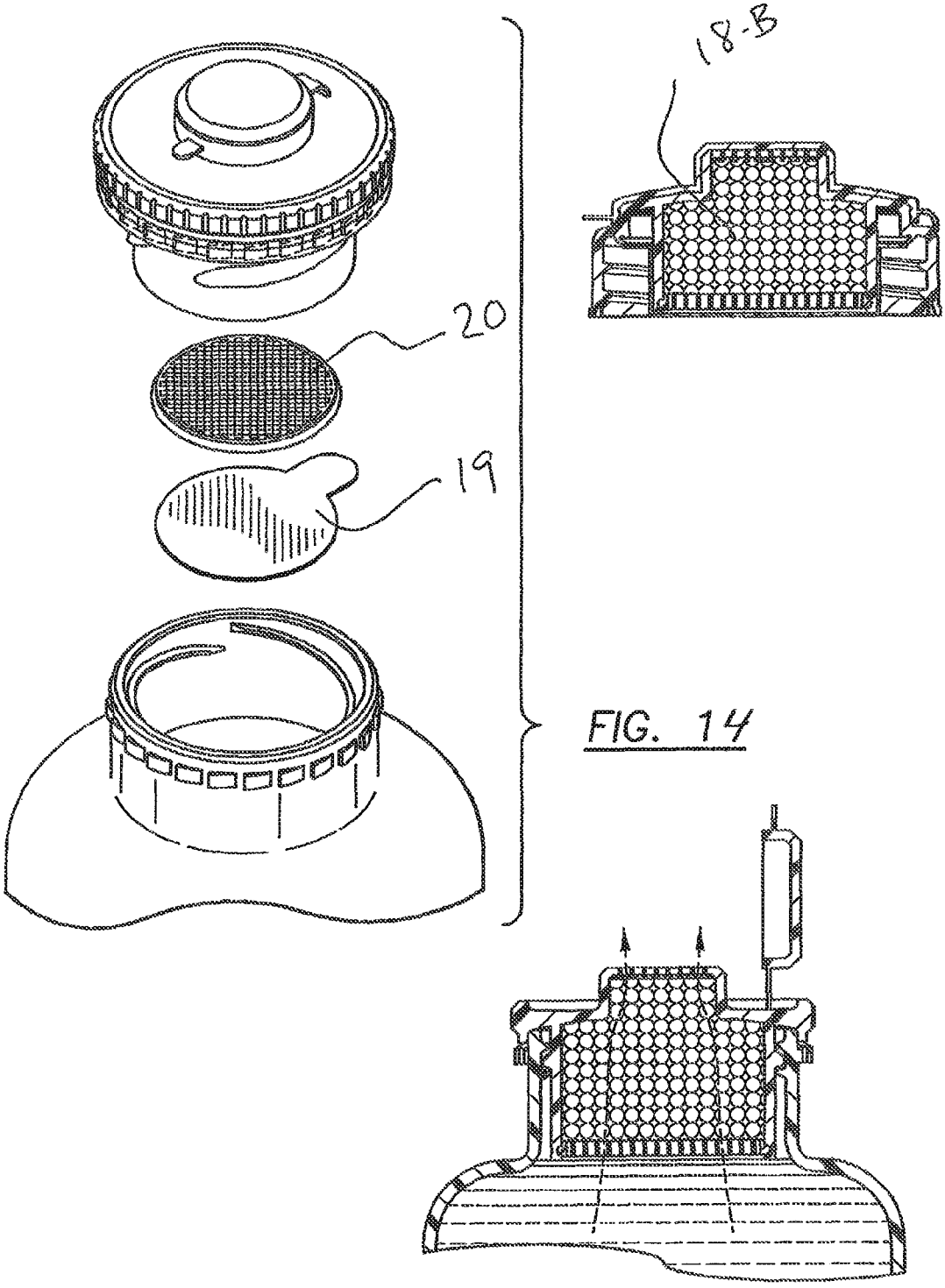
FIG. 14 shows a front view of an absorbent seal that is attached to a screen mechanism to hold any size granular, powders, leaves or beans or root or bark or any other substance.

Now referring to FIG. 14, shows an absorbent seal that can be attached to another holding type dosing container.

Figure 15:
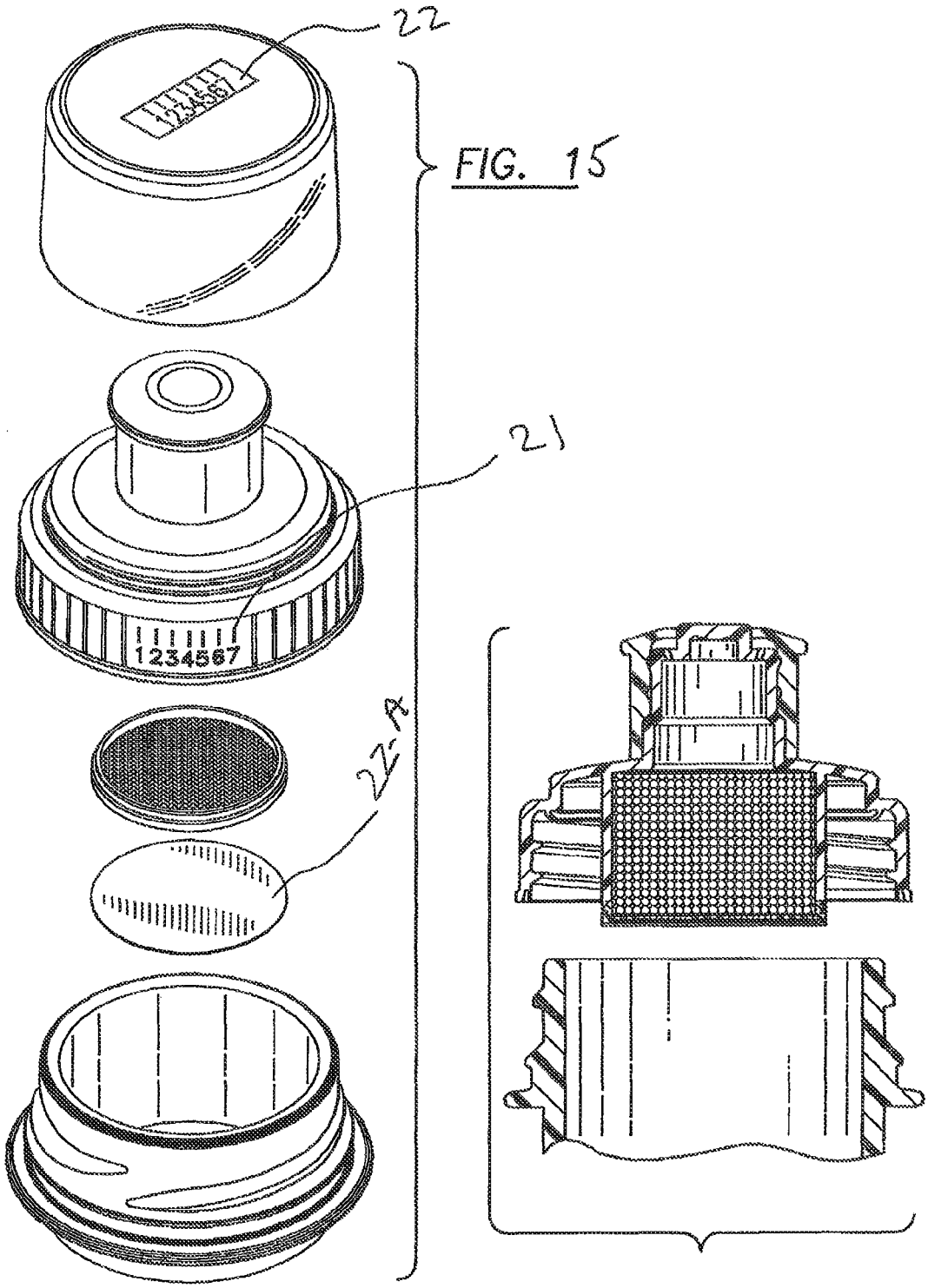
FIG. 15 shows a front view of an absorbent seal that is attached to a cap that holds product with a bar code and or RFID type tracking devise and or laser coding or molding, which provides a permanent barcode, alphanumeric code, or other identifying mark on the package, including by burning or molding away ink in the relevant areas

Now referring to FIG. 15, shows an absorbent seal that yet can be attached to another holding dosing type container 21A whereby an imbedded or printed barcode color shifting inks or with chip devices applied over specific molded tagged areas. Can be part of the dosing cap area itself at any location 21 including: a barcode and nano-type information deice 22 can be placed on a dust cover or at any other location of a dosing cap 22 including 22A.

Figure 16:
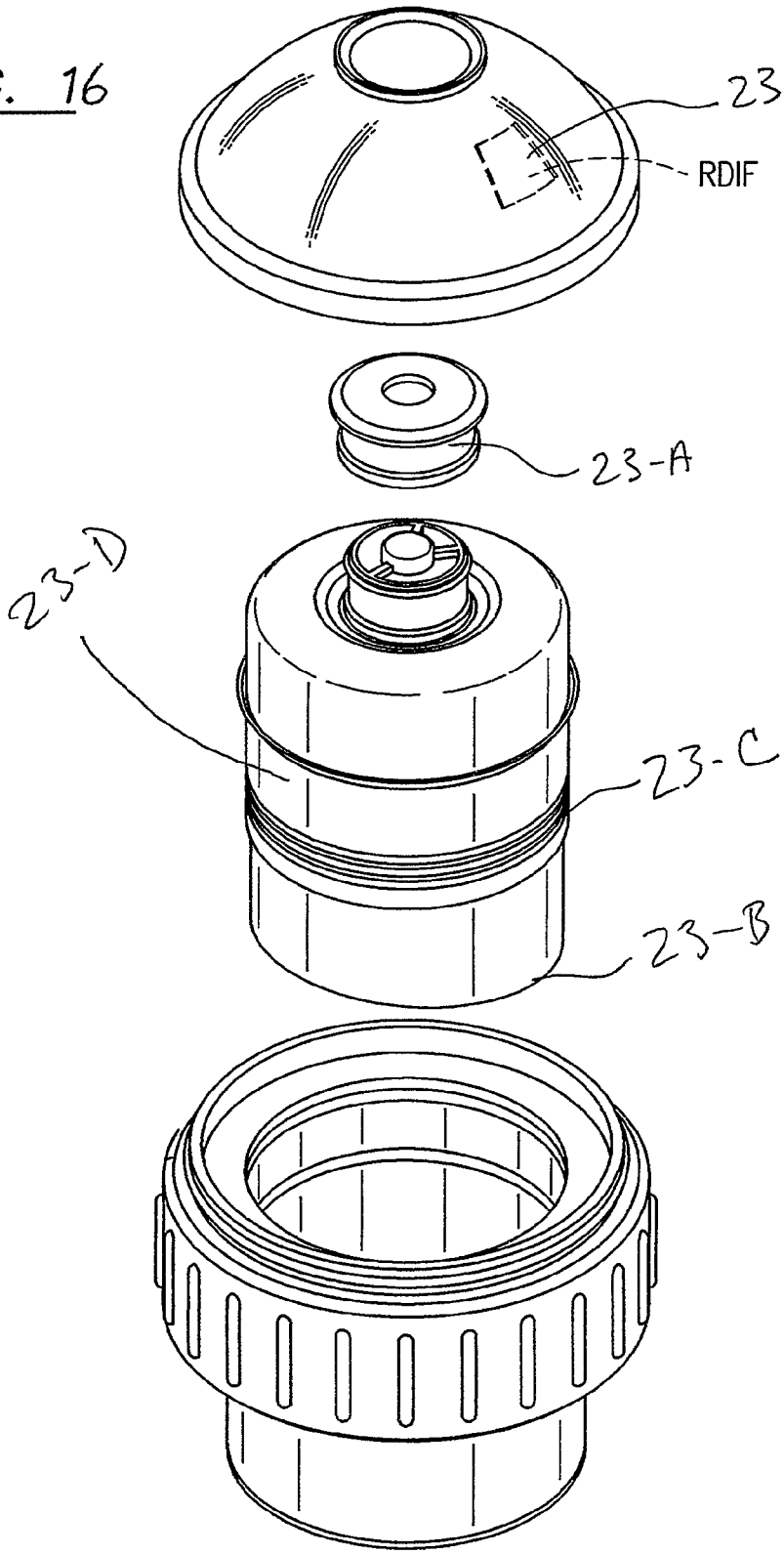
FIG. 16 shows a front view of a tracking device with an absorbent that can be attached to a container of any kind of container. Laser coding or molding, which provides a permanent barcode, alphanumeric code, or other identifying mark on the package, including by burning or molding away ink in the relevant areas and seal rings with a push pull top

Now referring to FIG. 16, shows a tracking and absorbent seal and or holograms designed especially for anti-counterfeiting measures by incorporating hidden images, micro imagery, bar codes and other features that make it difficult for counterfeiters to duplicate 23 that can be placed at any location of a dosing cap, including: a push-pull plunger 23A and 23D that can have expandable seal rings made from any material 23C and can activate the bottom by 23B with any angled position.

Now referring to FIG. 17, shows an absorbent pad/seal that can be attached to any location of any size in a dosing chamber including a chamber area that can open through a twisting motion 17A.

Figure 18:
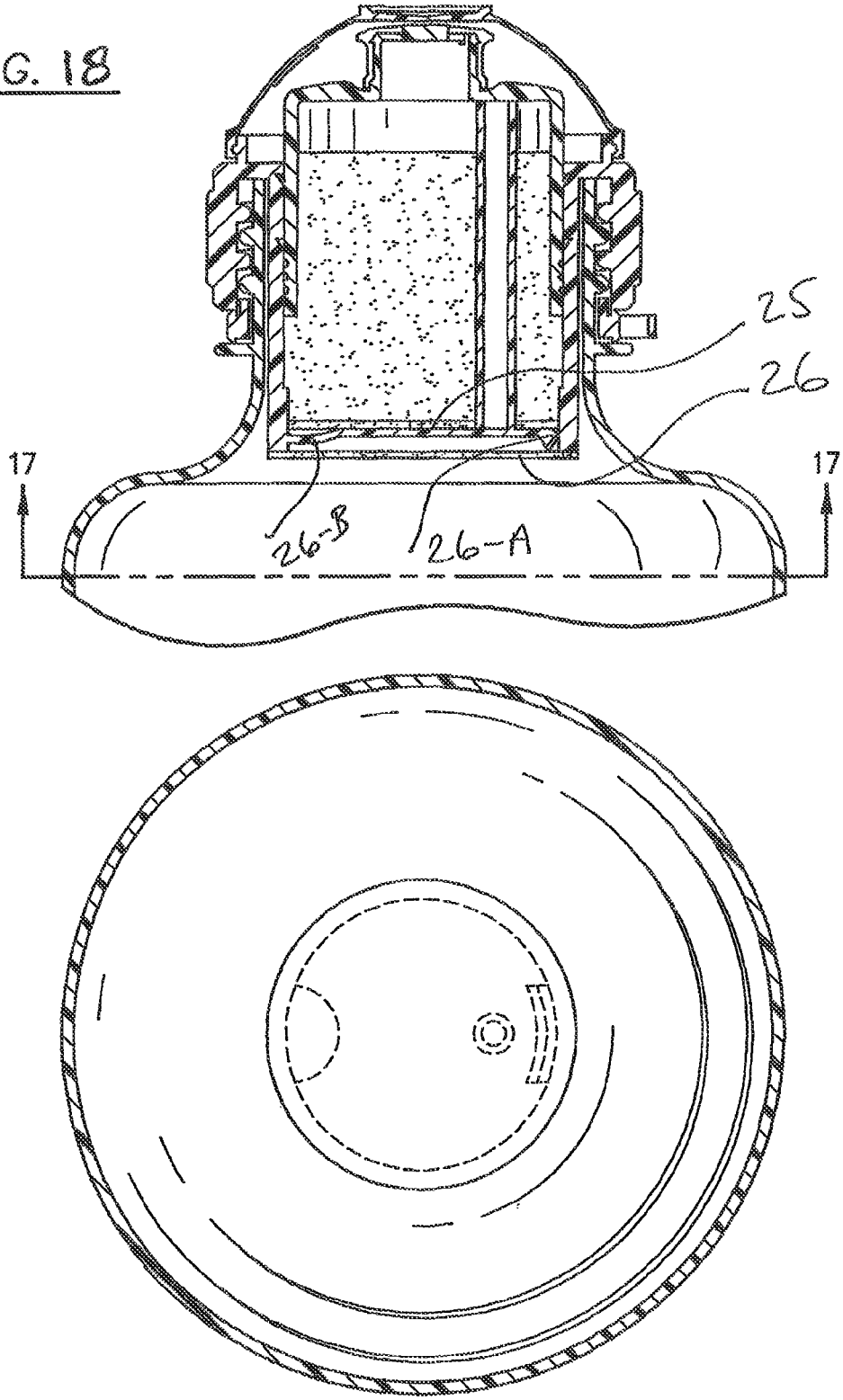
FIG. 18 shows a front sectional view of the invention attached to a dosing cap with a double sealed bottom, one having a seal attached and another with a line of weakening as part of the body of the doing cap with a flexible hinge to stay attached to the dosing cap after activated by a human.

Now referring to FIG. 18, shows an absorbent seal pad that can be attached from the inside and/or the outside of a dosing cap 26 to ensure freshness of any ingredients that is to be stored inside and a force area 26A can start the initial opening of the bottom with the bottom staying attached to the dosing chamber 26B by means of the flexible type hinge.

Figure 19:
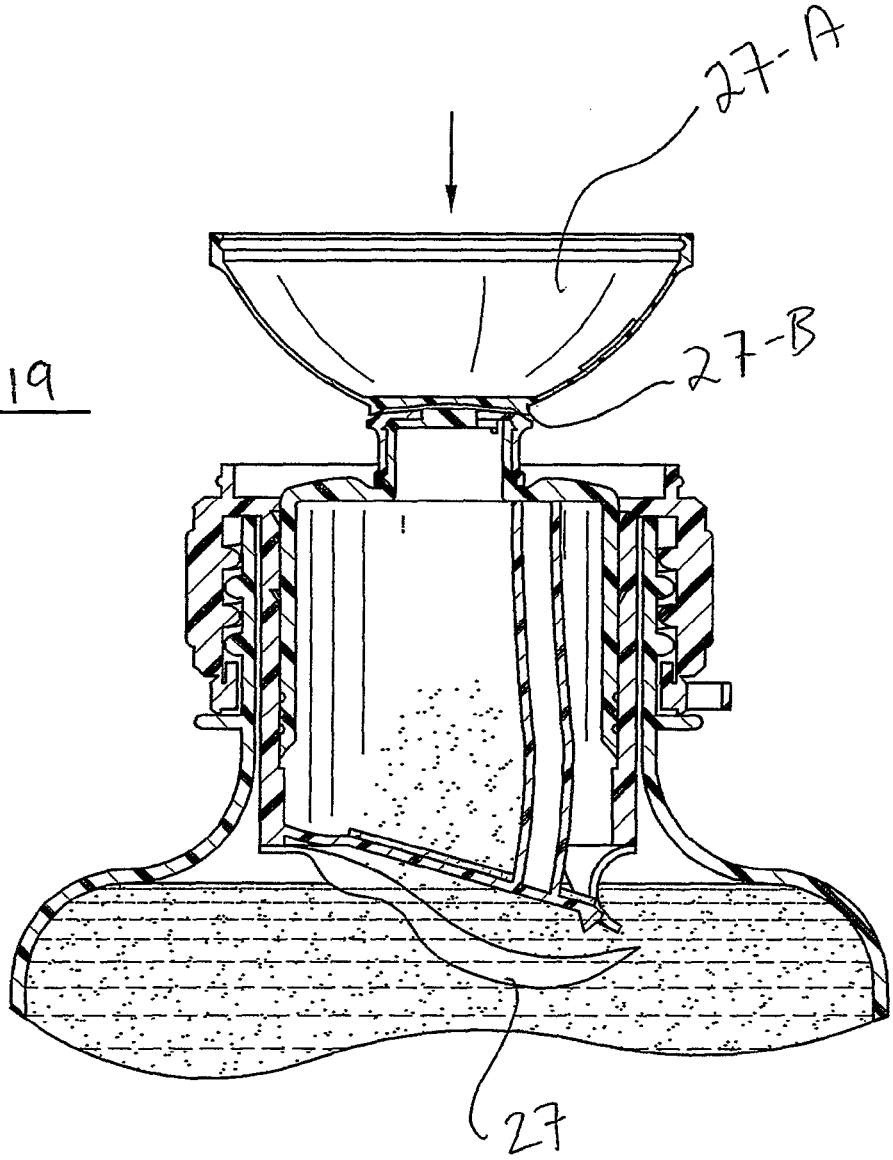
FIG. 19 shows a dosing cap with the invention after activation by any means.

Now referring to FIG. 19, shows an absorbent seal 27 being opened from plunging from above by turning the dust cover upside down and placing on a post opening area for fluid flow.

Figure 20:
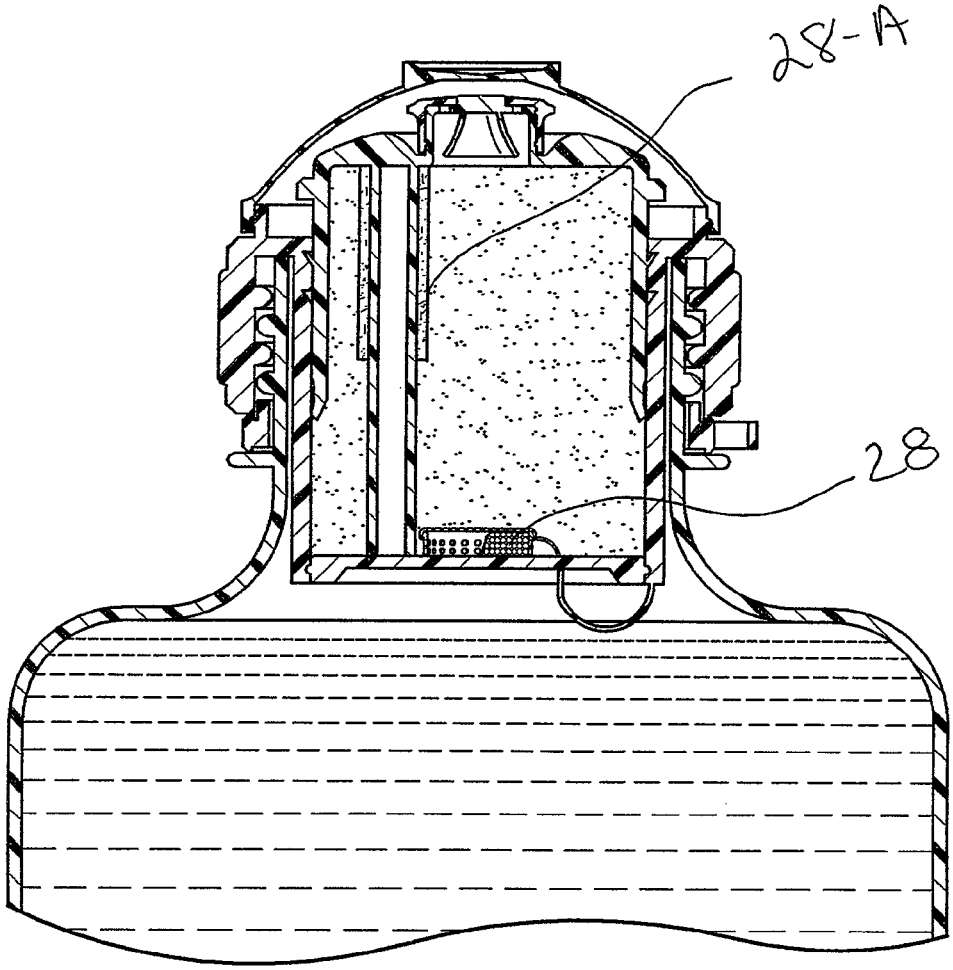
FIGS. 20 and 21 shows a front view and sectional view whereby the absorbent materials can be placed into a separate container of any means in a separate hosing inside the dosing cap area.

Now referring to FIG. 20, shows a holding area inside a dosing cap that can hold any sized particle or pouch of an absorbent 28 and also an absorbent ring-type 28A can be added.

Figure 21:
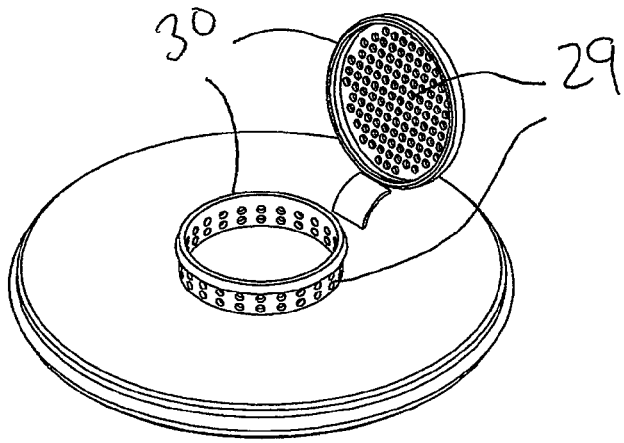

Now referring to FIG. 21, an absorbent holding chamber area that can be placed at any location on a dosing cap that can be filled and sealed with absorbent and tracking materials 29 and 30.

Now referring to FIG. 22, a tracking and/or absorbent seal or sticker can be added at any location of a dosing device 31 that can have a flat surface area 32B to be attached to any flexible or non-flexible material.

Now referring to FIG. 23, shows an absorbent area 32 and 33 whereby an absorbent tape-like application can be applied to a pouch or carton flexible type area so that a consumer can add it's own product and seal with a zip like seal 32A and can have a reusable or non-reusable holding ingredient chamber 33A and 33B.

Figure 24:
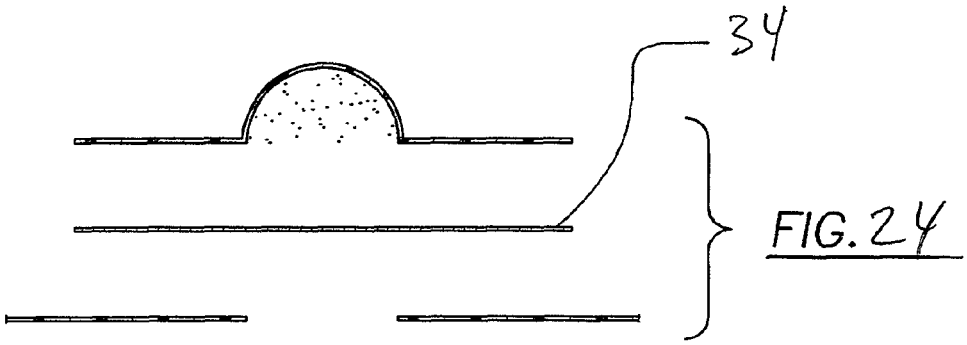
FIG. 24 shows a front view of the absorbent seal whereby the invention can be attached to a surface area on a pouch/carton like surface.
Figure 25:
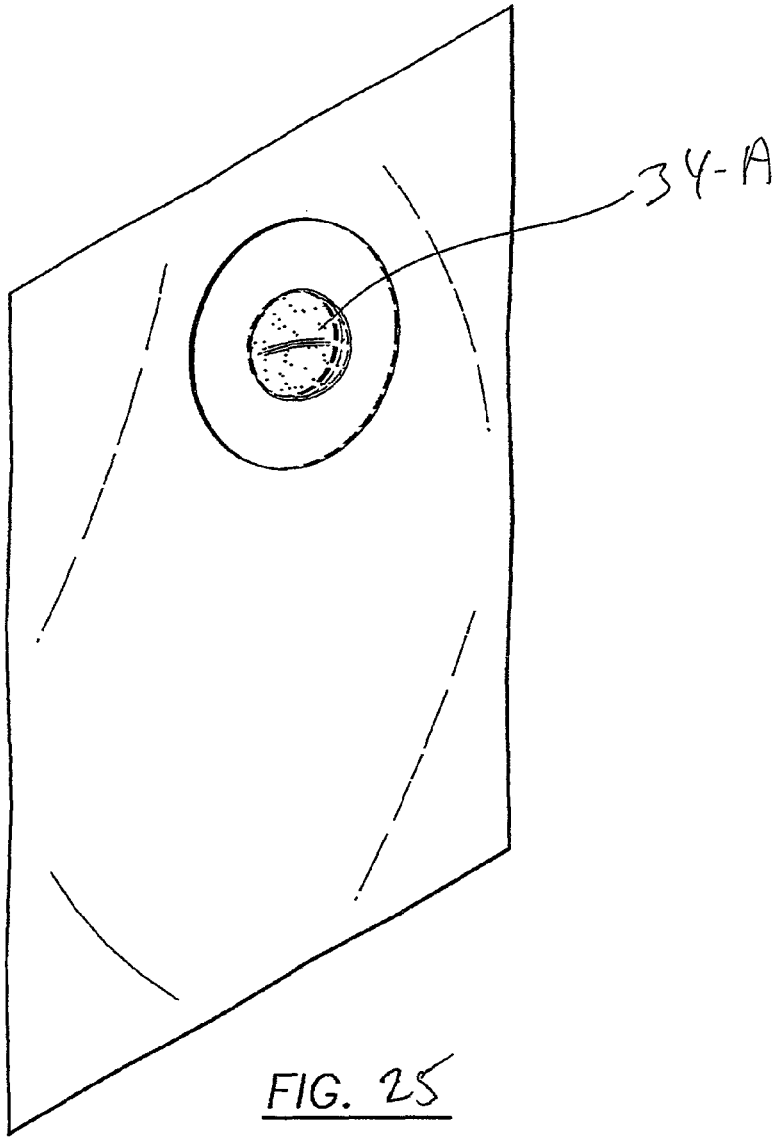
FIG. 25 shows a front view of the absorbent seal that can be attached to a surface area below, on top, or in between a zip like closure to prevent moisture/air intake.

Now referring to FIG. 24, shows an absorbent film seal-like flexible material that can be added on top of a flexible or non-flexible container 34 that can be broken by activating 34A as shown in FIG. 25.

Figure 26:
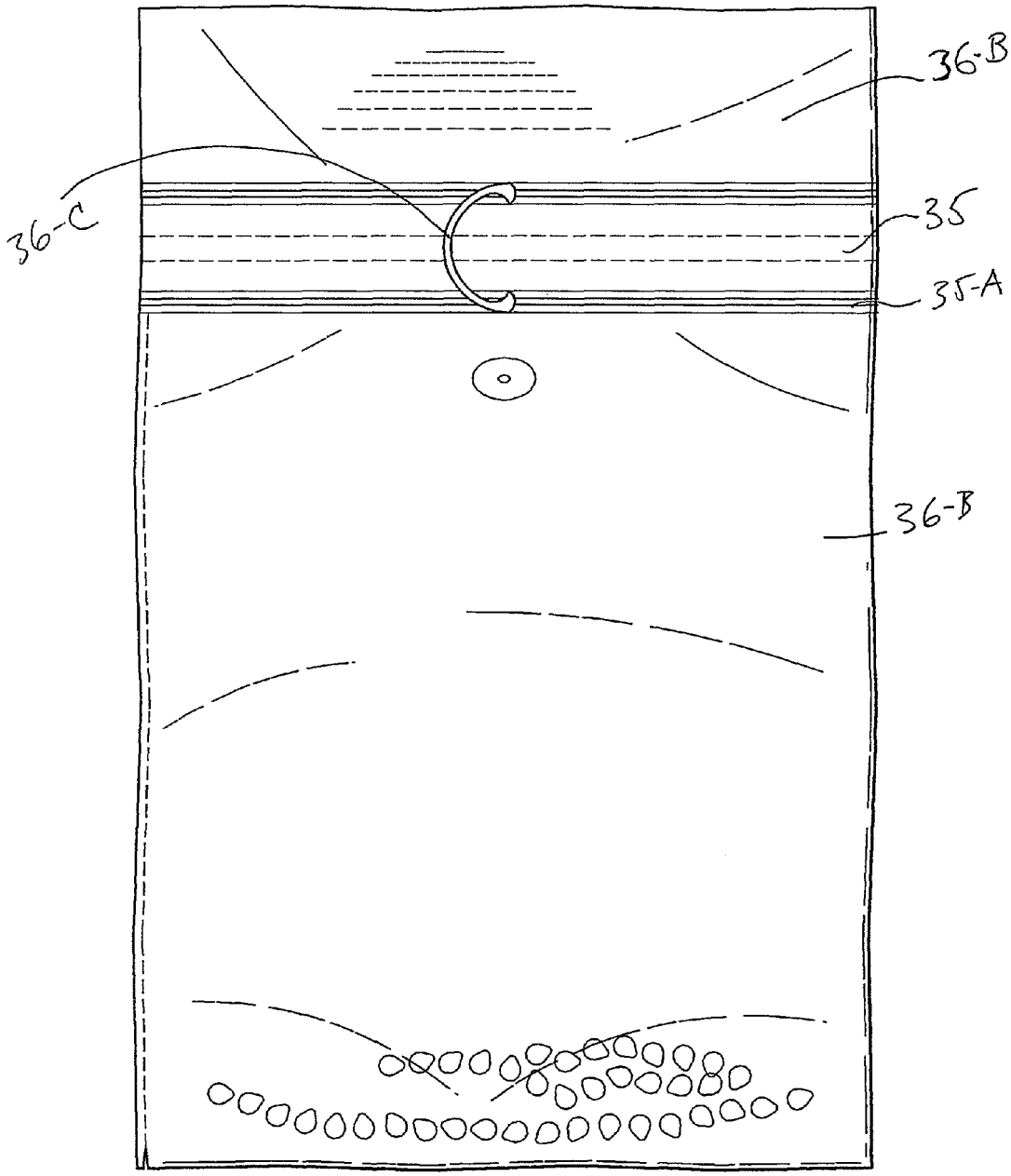
FIG. 26 shows a front elevational view of a pouch having a zip lock type seal with ingredients stored separately.

Now referring to FIG. 26, shows an absorbent area 35 that can be attached to a flexible material and having a zip lock type seal on one or both sides 35A whereby the ingredients can be stored separately 36B until activated by either squeezing or pulling 36C.

Figure 27:
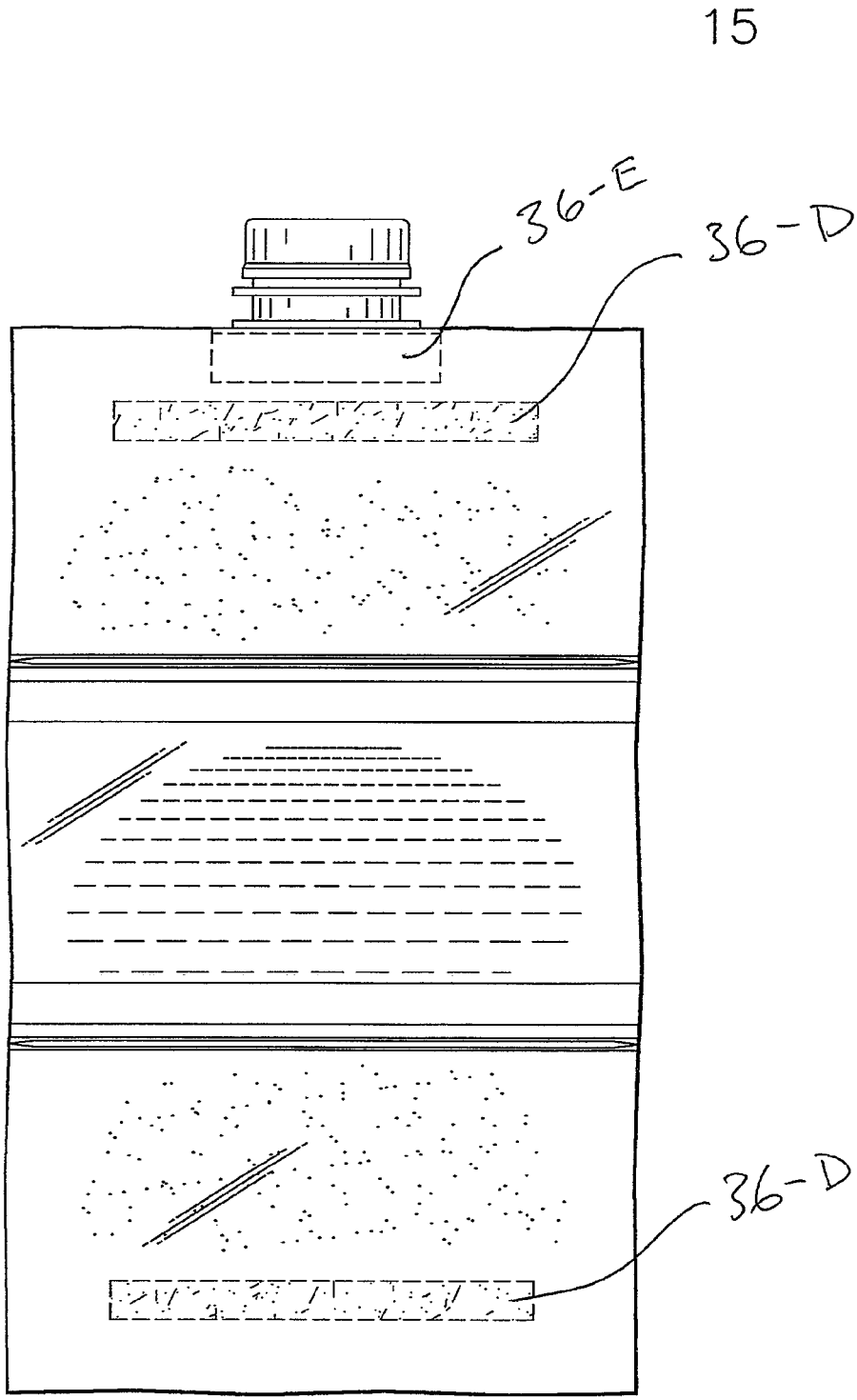
FIG. 27 shows a front view of the absorbent seal attached either on top and or on the bottom of a flexible container.

Now referring to FIG. 27, shows an adhesive type absorbent tape like seal 36D that can be added at any location in a flexible container which also can contain a fitment dosing cap 36E.

Figure 28:
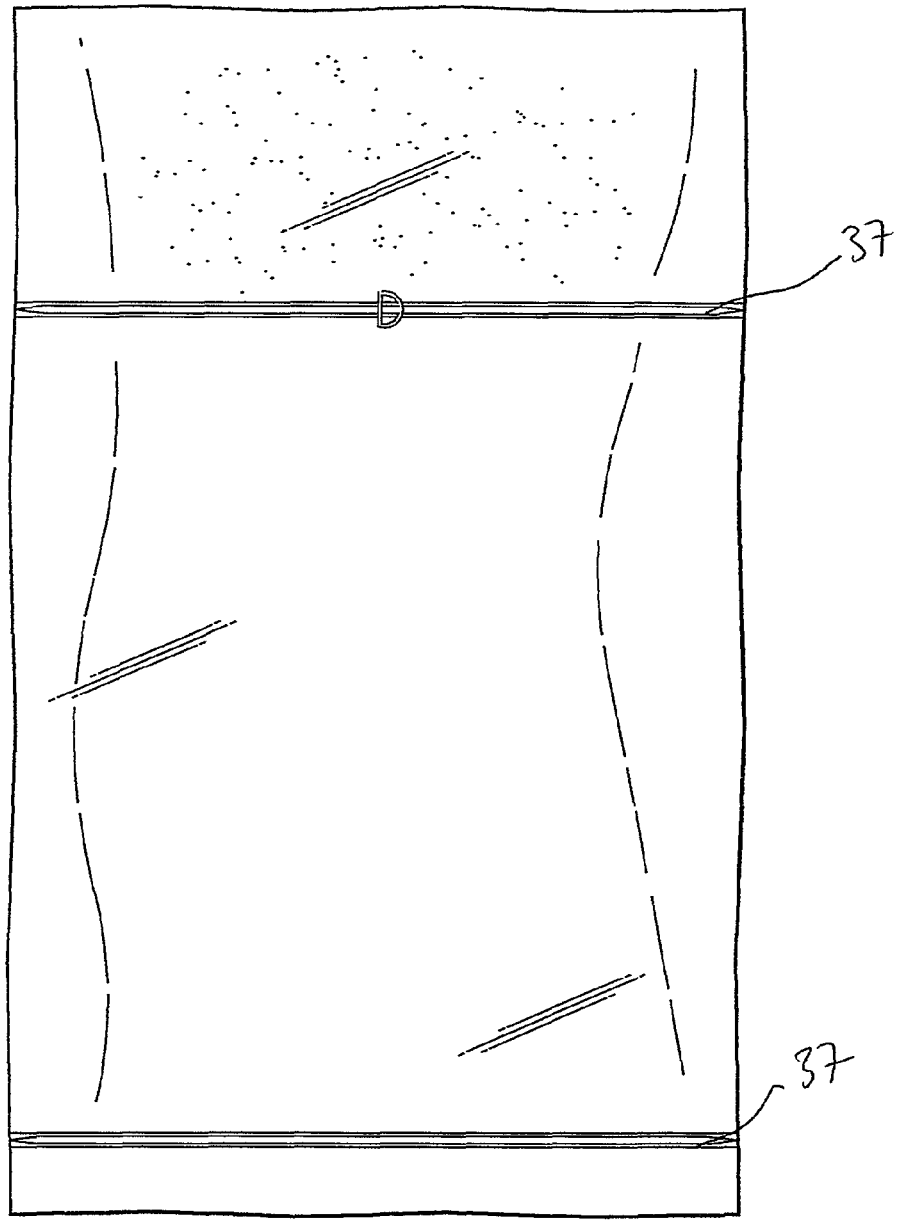
FIG. 28 shows a front view of the absorbent seal attached to and in between a zip like seal.

Now referring to FIG. 28, shows an area where absorbent material 37 can be added.

Figure 29:
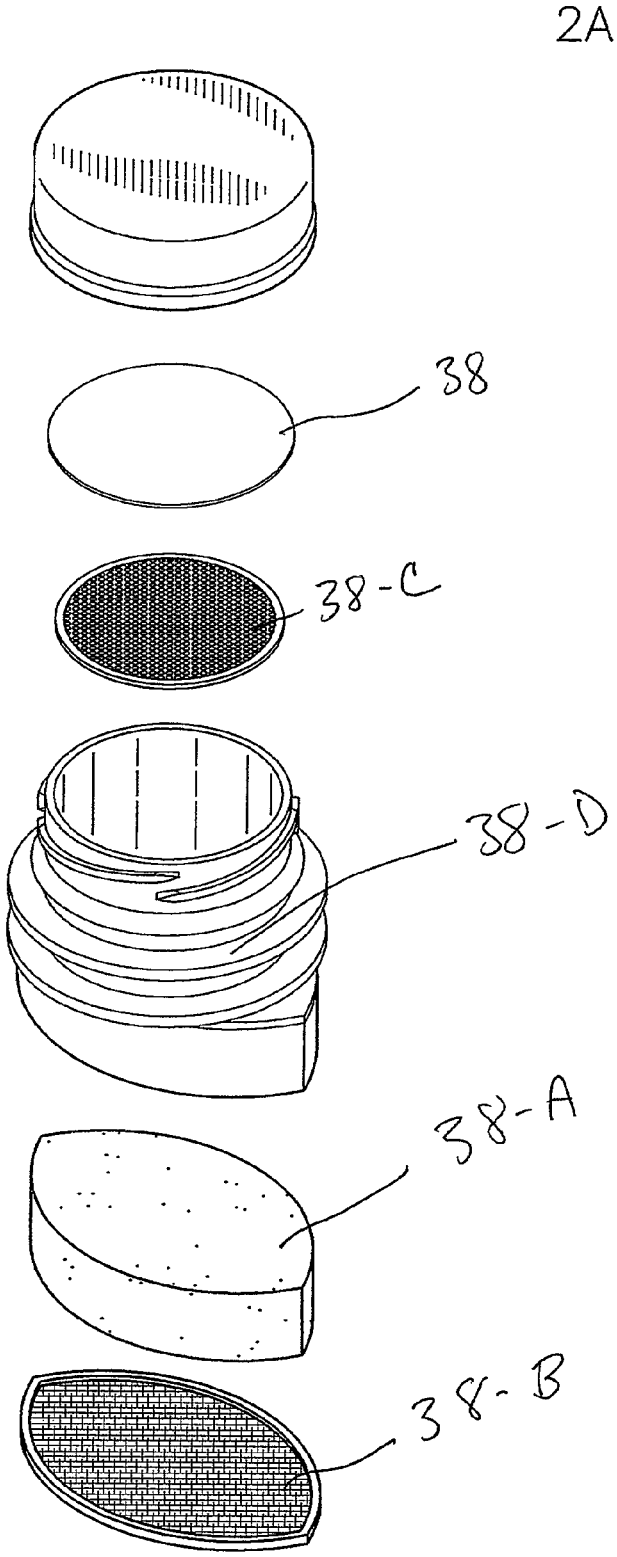
FIG. 29 shows a front view of the invention whereby it can be attached to a fitment dosing cap to flexible material and the holding dosing cap area can have any materials added including but not limited to carbon, activated carbon or KDF.

Now referring to FIG. 29, shows an absorbent seal 38 that can be attached to a dosing container at any location to a water filter like device whereby carbon, silver impregnated carbon, and/or KDF or any other filtration medium 38A can be added in a dosing like chamber device 38D that can be attached to any container with a pre-filter 38B and a post-filter 38C.

Now referring to FIG. 30, shows an absorbent seal 39 that can be attached to a molded bottom piece with one or more angles 39A that has a dosing chamber area imbedded in the bottom area mold 39B whereby a plunger-like device 39C with seal rings 39D can be activated by depressing manually 39E also can have a storage chamber area. The bottom area of a container that can hold substances separate until time of use and a separate molded part of any material that can include the body area of a doing cap that can be applied to any type of container, pouch, bottle or brick pack.

Figure 31:
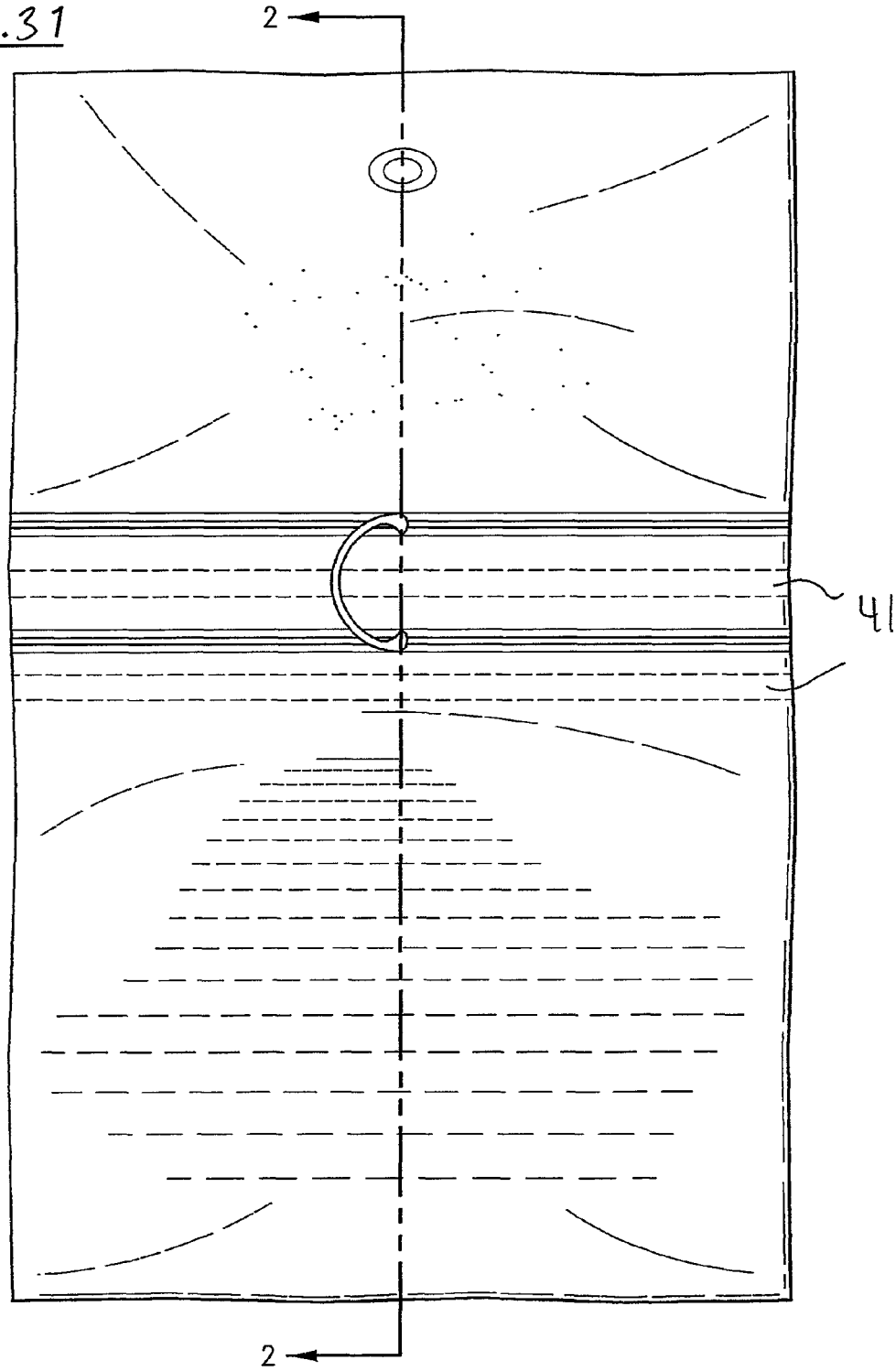
FIG. 31 shows yet another embodiment of the invention to be attached to a flexible container.

Now referring to FIG. 31, shows where an absorbent area can be added to a flexible material 41 before, during, and/or after sealed areas of keeping ingredients separate.

Figure 32:
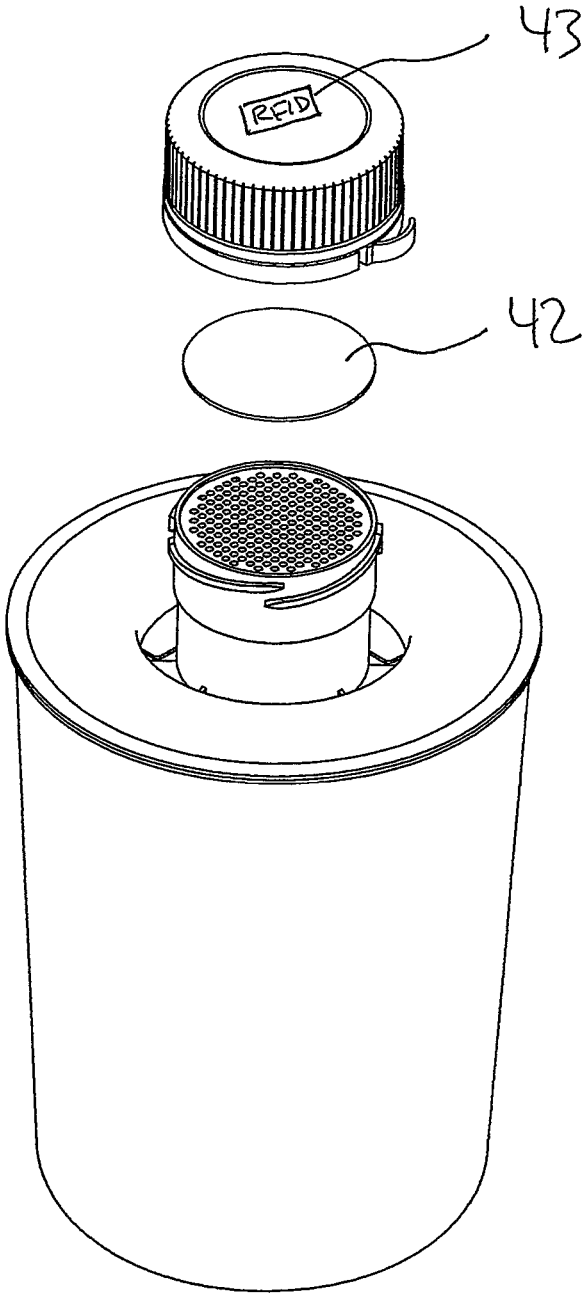
FIG. 32 shows a front view of the absorbent seal that can be attached to a container that dispenses a product with a RFID chip on a cap.

Now referring to FIG. 32, shows an absorbent seal 42 that can be applied to a dosing storage cap with an outside cap 43 having a tracking and information device imbedded and/or attached thereto.

Now referring to FIG. 33, shows an absorbent pad 46 or taped seal pad 47 that can be attached inside a dosing, cap.

Figure 44:
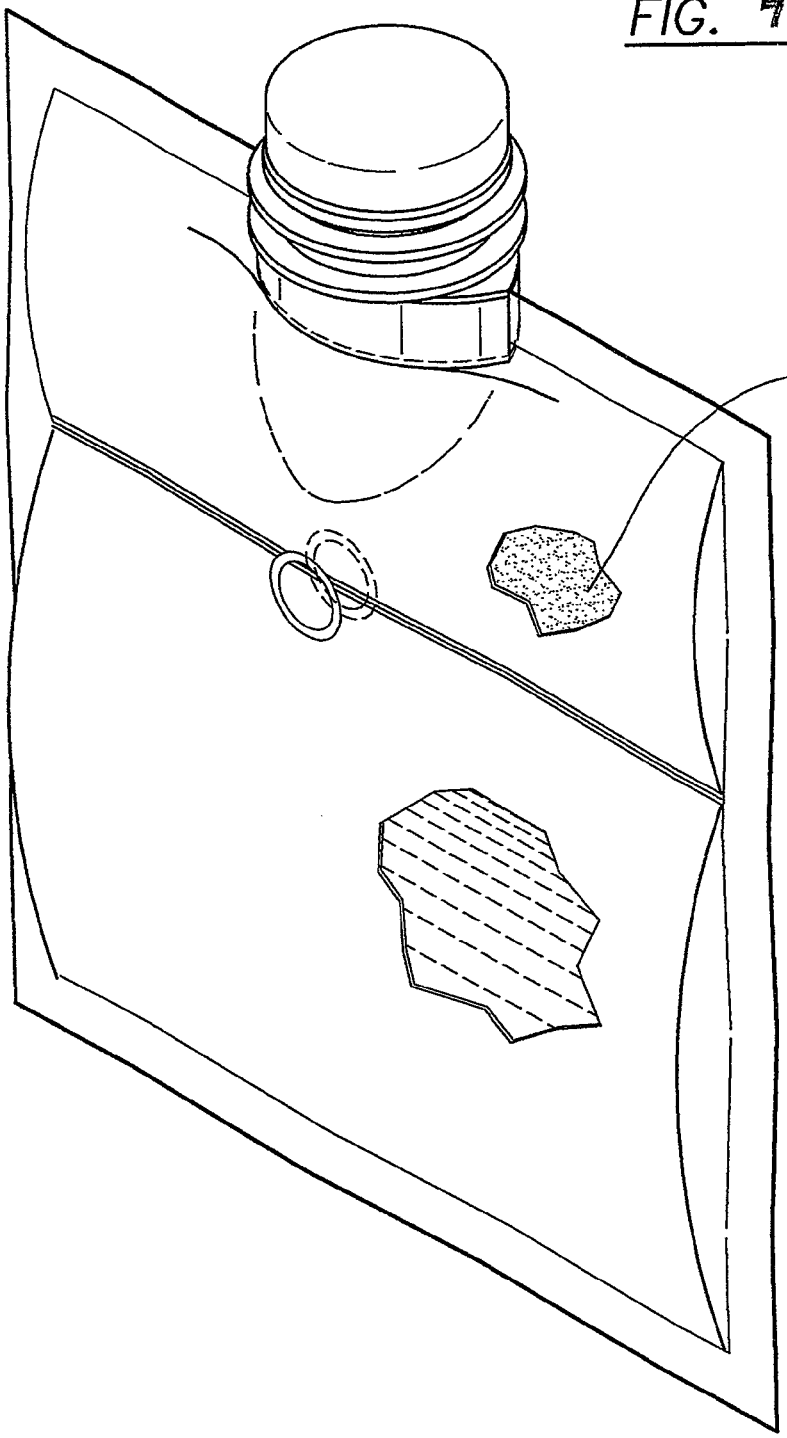
FIG. 44 shows the absorbent seal that is attached or part of the layer of a flexible material of a separation of ingredients.

Now referring to FIG. 34, a plugged bottom area for a dosing cap can be made out of a flexible or non-flexible material whereby absorbent materials can be added to the resin during manufacturing or applied after 45 and also shown in FIGS. 35 and 44.

Figure 36:
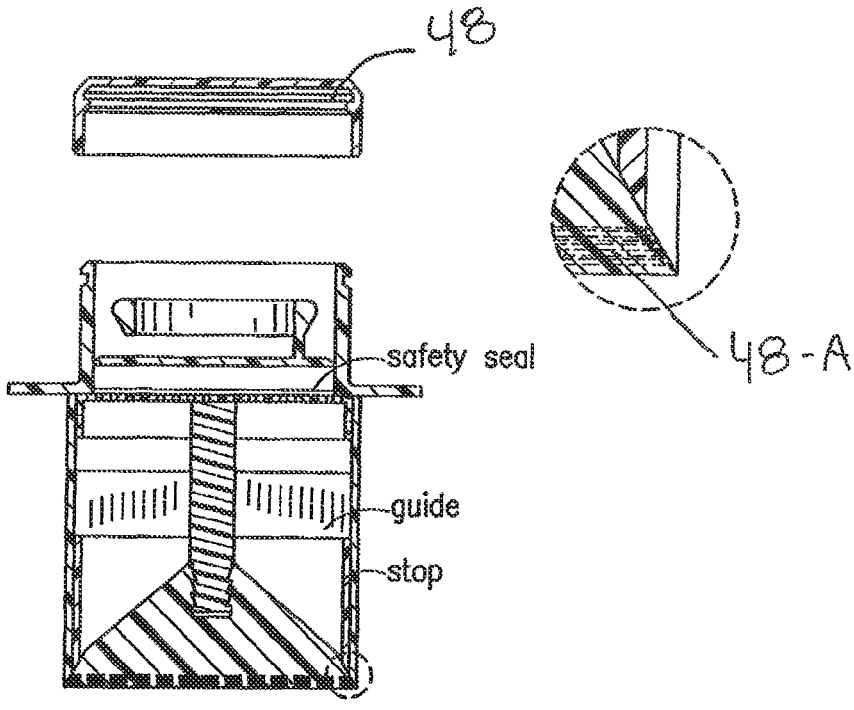
FIG. 36 shows a front sectional view whereby of the absorbent seal can be added to a dispensing capsule.
Figure 36:
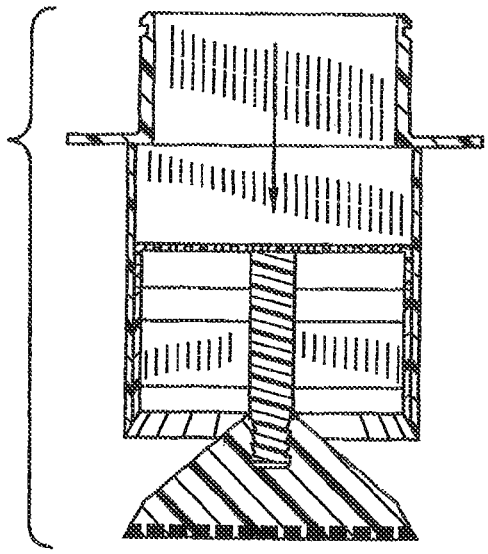

Now referring to FIG. 36, shows an absorbent seal 48 that can be attached on the inside area of a cap that is connected to a dosing cap and whereby an absorbent material can also be added in a bottom plunger-like device 48A.

Figure 37:
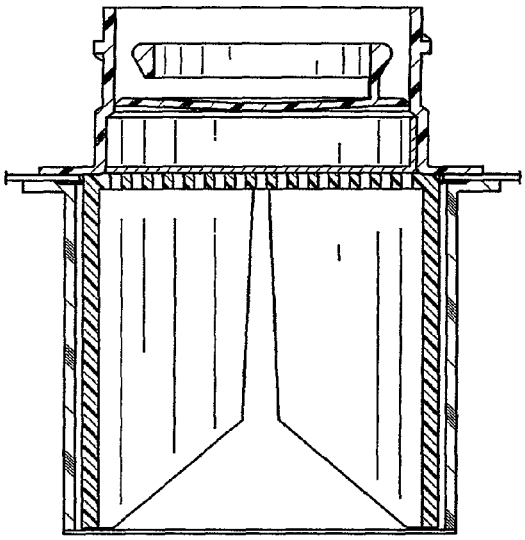
FIG. 37 shows a front view of a bottom of a dosing capsule made out of any material whereby the invention can be added.
Figure 37:
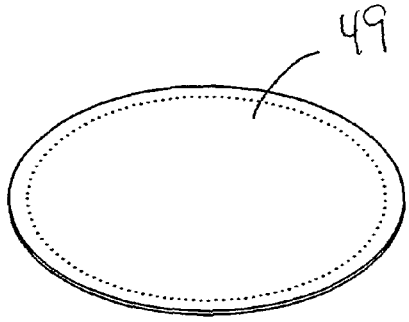

Now referring to FIG. 37, shows an absorbent seal that can be attached to the bottom of a split part dosing cap system.

Figure 38:
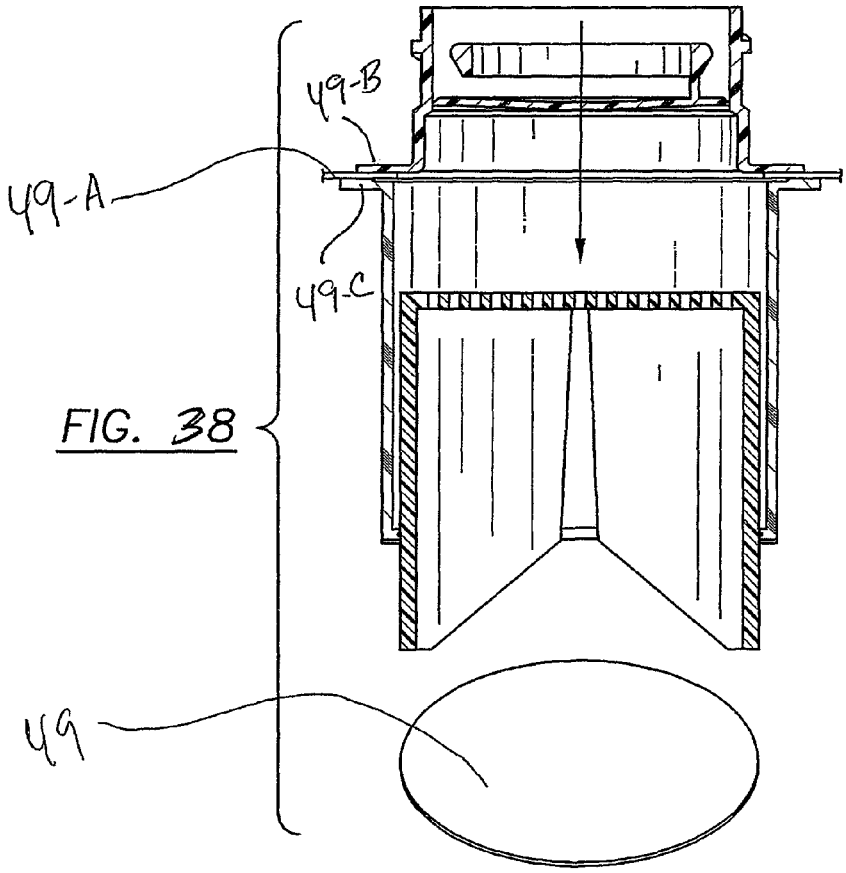
FIG. 38 shows the dosing cap after activated.

Now referring to FIG. 38, shows an absorbent seal 49 that can be attached to the bottom 49C a dosing chamber device that is attached to a flexible or non-flexible surface area 49A and the top portion of the dosing chamber 49B can be attached thereto.

Figure 39:
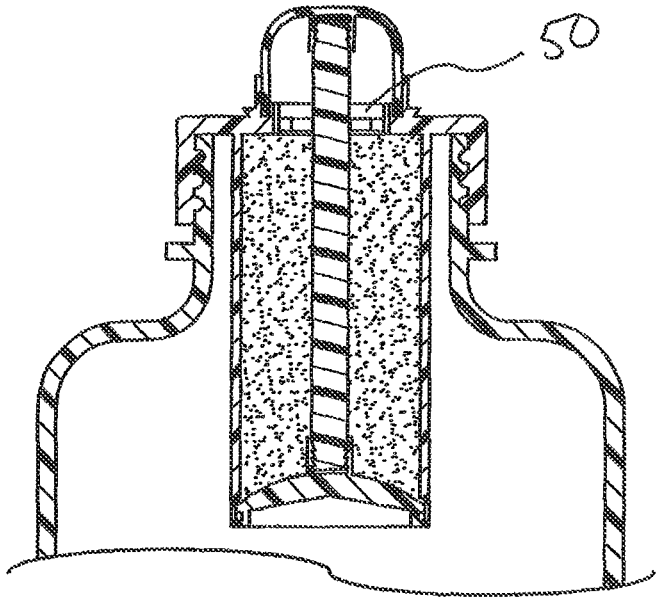
FIG. 39 shows a front sectional view whereby a dosing cap can have a flexible or non flexible top area with a pole or any other structure so when depressed the bottom opens to release ingredients stored inside.
Figure 39:
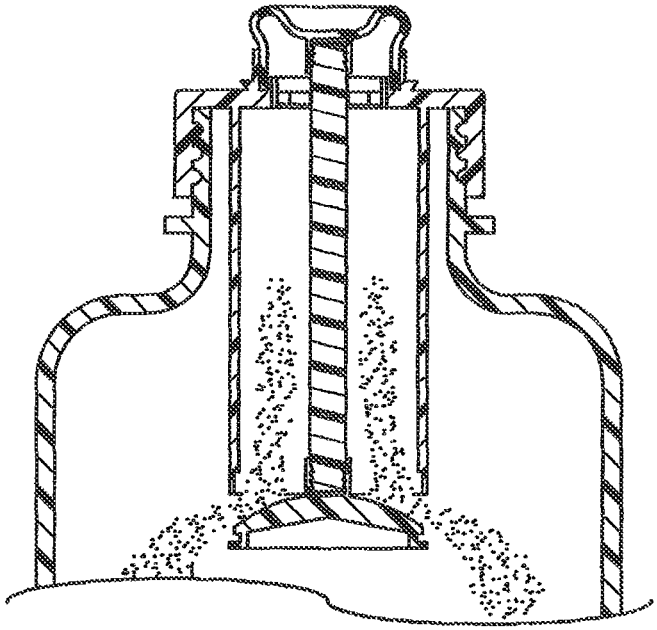

Now referring to FIG. 39, shows an absorbent seal that can have any sized hole surrounded by a pole-like device.

Now referring to FIG. 40, shows an absorbent material added to a bottom plunger-like device for a dosing chamber 51 that is embedded with absorbents as better shown in FIGS. 41 and 52.

Figure 42:
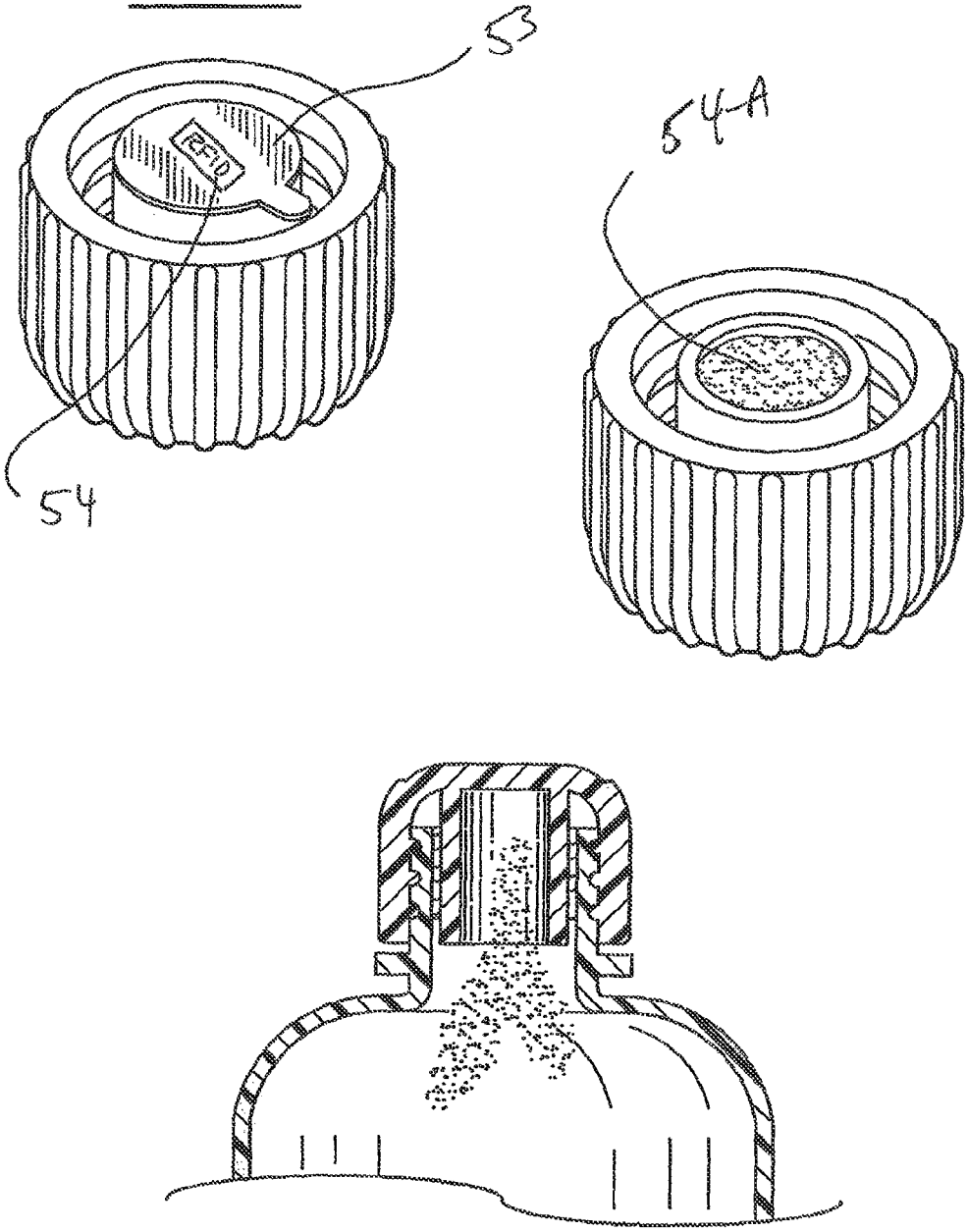
FIG. 42 shows a front view of the absorbent seal with an RFID whereby it can be attached to a dosing cap of a container and pealed off prior to use. The dosing cap is a chamber whereby a holding area connected to a normal cap with a sealed bottom.

Now referring to FIG. 42, shows yet another absorbent seal that can have a tracking or information device such as a bar code or RFID device 54 attached to the seal 53 whereby it is attached to a holding cap chamber where an individual can peel off the seal and screw or snap it onto a container.

Figure 43:
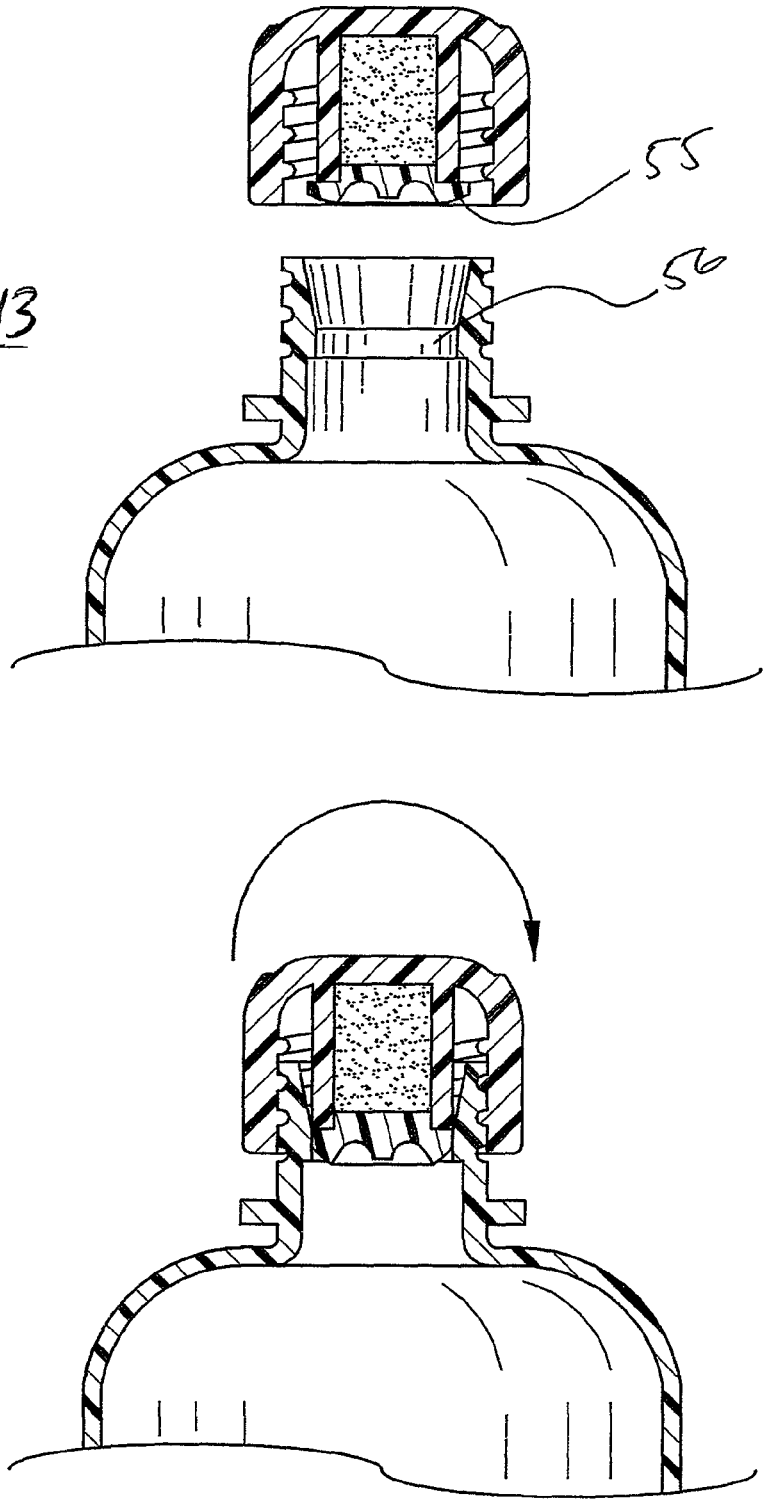
FIG. 43 shows a front sectional view of an absorbent plug like devise that has a one way click in position from the inside neck area of a bottle so when unscrewed manually the plug automatically is release and the ingredients fall in the container.

Now referring to FIG. 43, shows an absorbent seal plug for a dosing cap with absorbents that when the dosing cap is screwed onto a container the plug 55 will snugly fit past the indented area of the inside wall of a container 56, preferably pre-molded in a pre-form prior to a bottle being manufactured.

Now referring to FIG. 44, shows an absorbent pad area in a flexible container 57.

Figure 45:
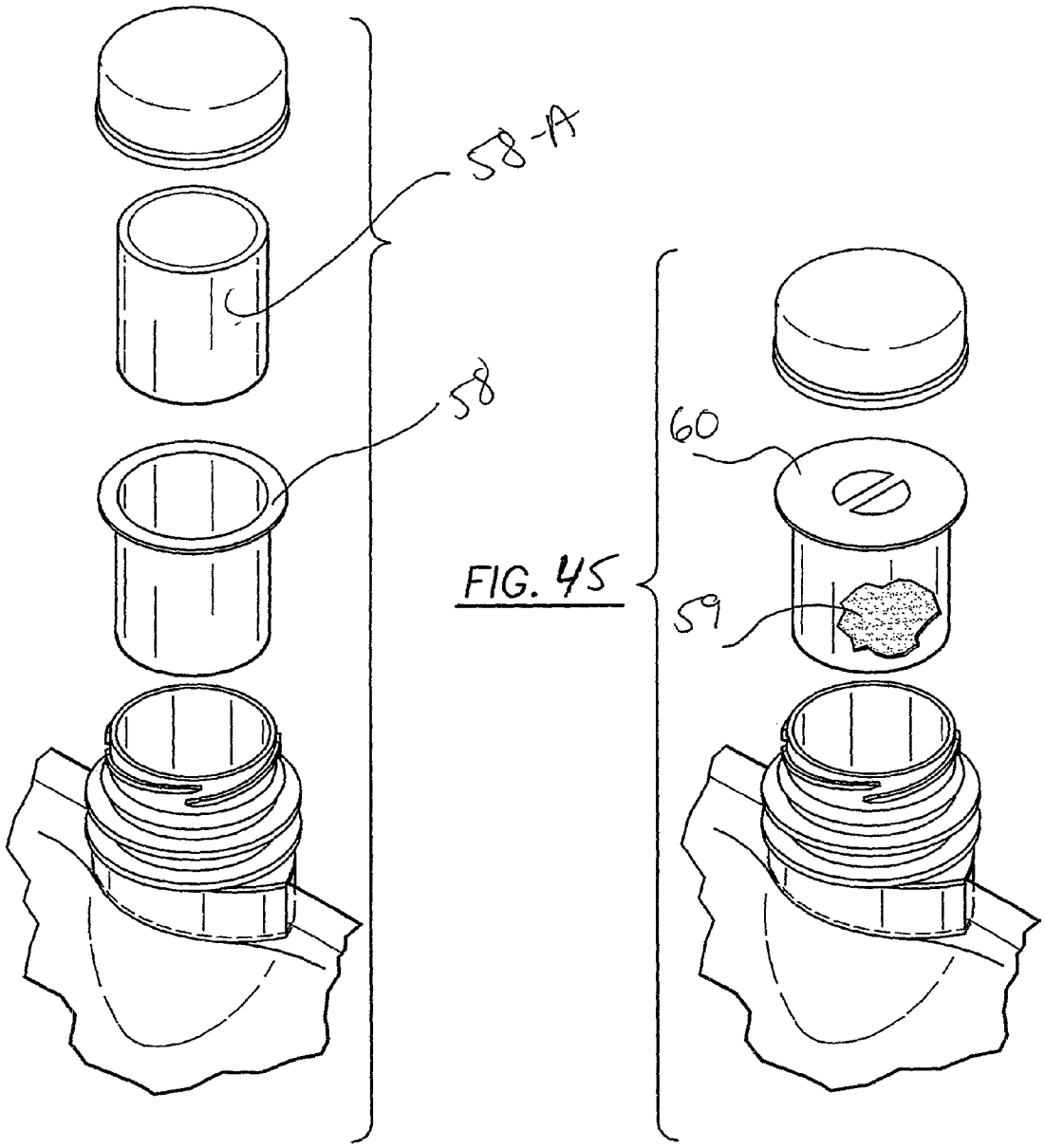
FIG. 45 shows a single serve half and half type of single serve container and an absorbent seal can be added and a sealable top can be attached

Now referring to FIG. 45, shows an absorbent seal pad or tape or sprayed 59 into a cup-like device 58 whereby a holding/dosing chamber 58A or ingredients itself can be put into the dosing chamber 58 and an absorbent seal 60 can be attached.

Figure 46:
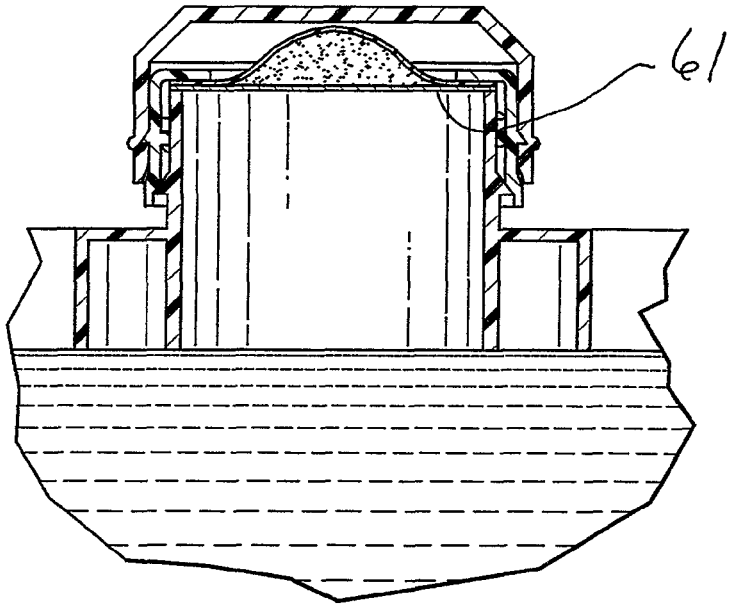
FIGS. 46 and 47 shows a front sectional view of a bubble like flexible top whereby an individual can manually activate by depressing the top portion to activate the ingredients inside into a container of any kind that and that can also be part of the liner of one or more layers of a container wall.
Figure 47:
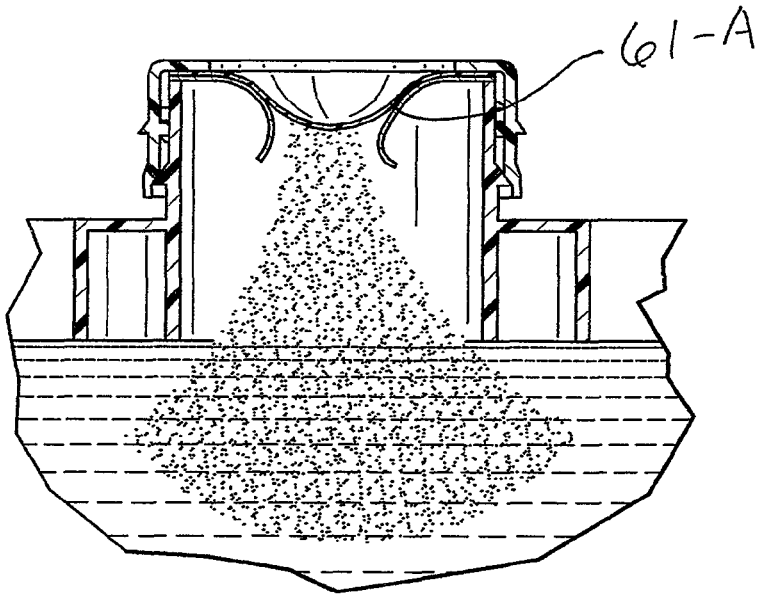

Now referring to FIG. 46, shows a flexible material in bubble-like shape that can be depressed and break the absorbent film 61 as better shown in FIG. 47 #61A.

Now referring to FIG. 48, shows an absorbent seal that can be attached to a dosing chamber device 62 and the cap can have printed or embossed or molded in of any height barcodes for identification and information 64 and whereby 64A can have a tracking device applied under a cap.

Now referring to FIG. 49, shows an absorbent stick-like pad 63 that can be placed on a hollow inner tube pole-like device that is attached to the inside of a dosing chamber device.

Figure 50:
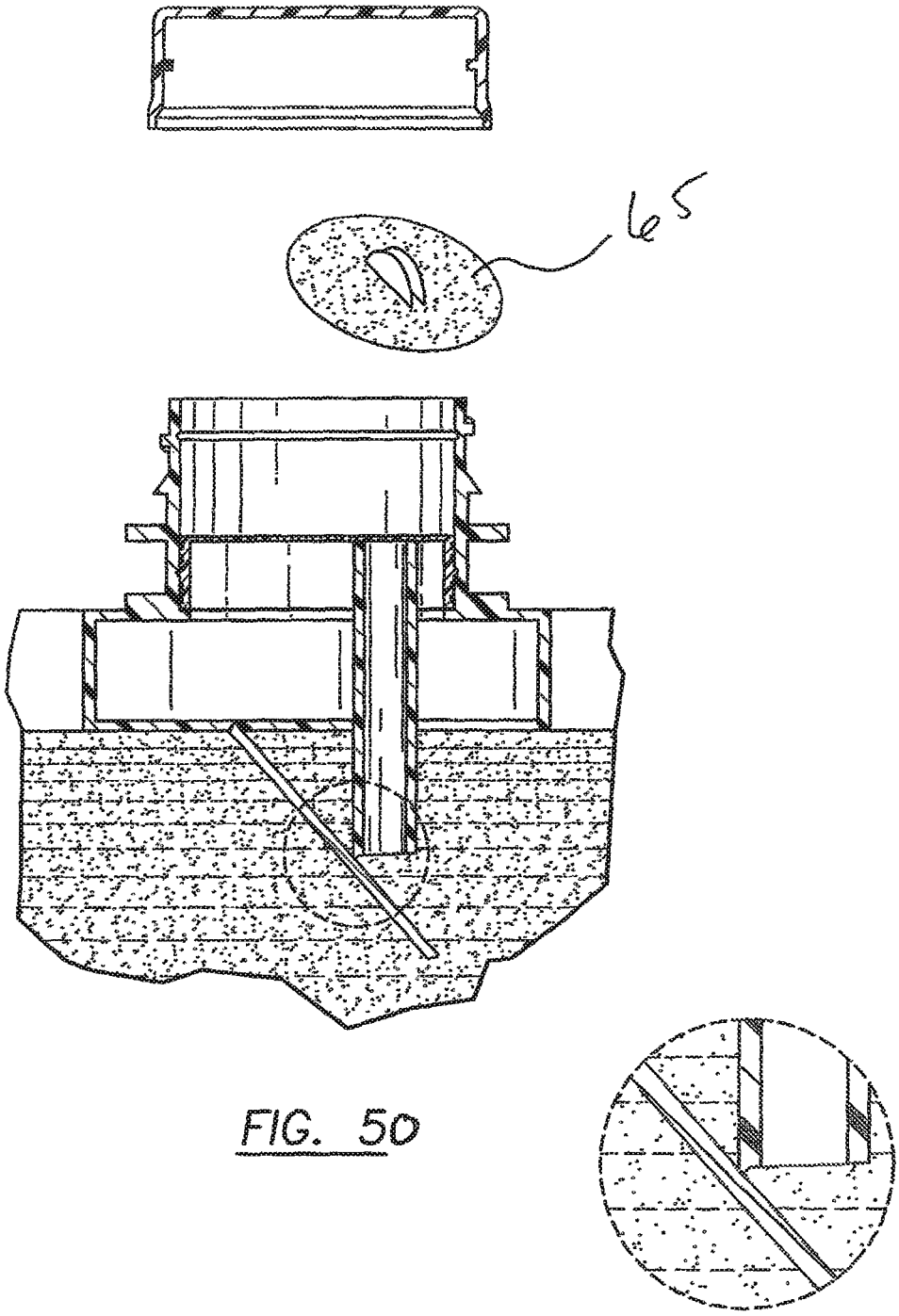
FIG. 50 shows a front sectional view whereby of a dosing fitment cap with an absorbent seal after activation.

Now referring to FIG. 50, shows an absorbent seal that can be placed on a dosing fitment device.

Figure 51:
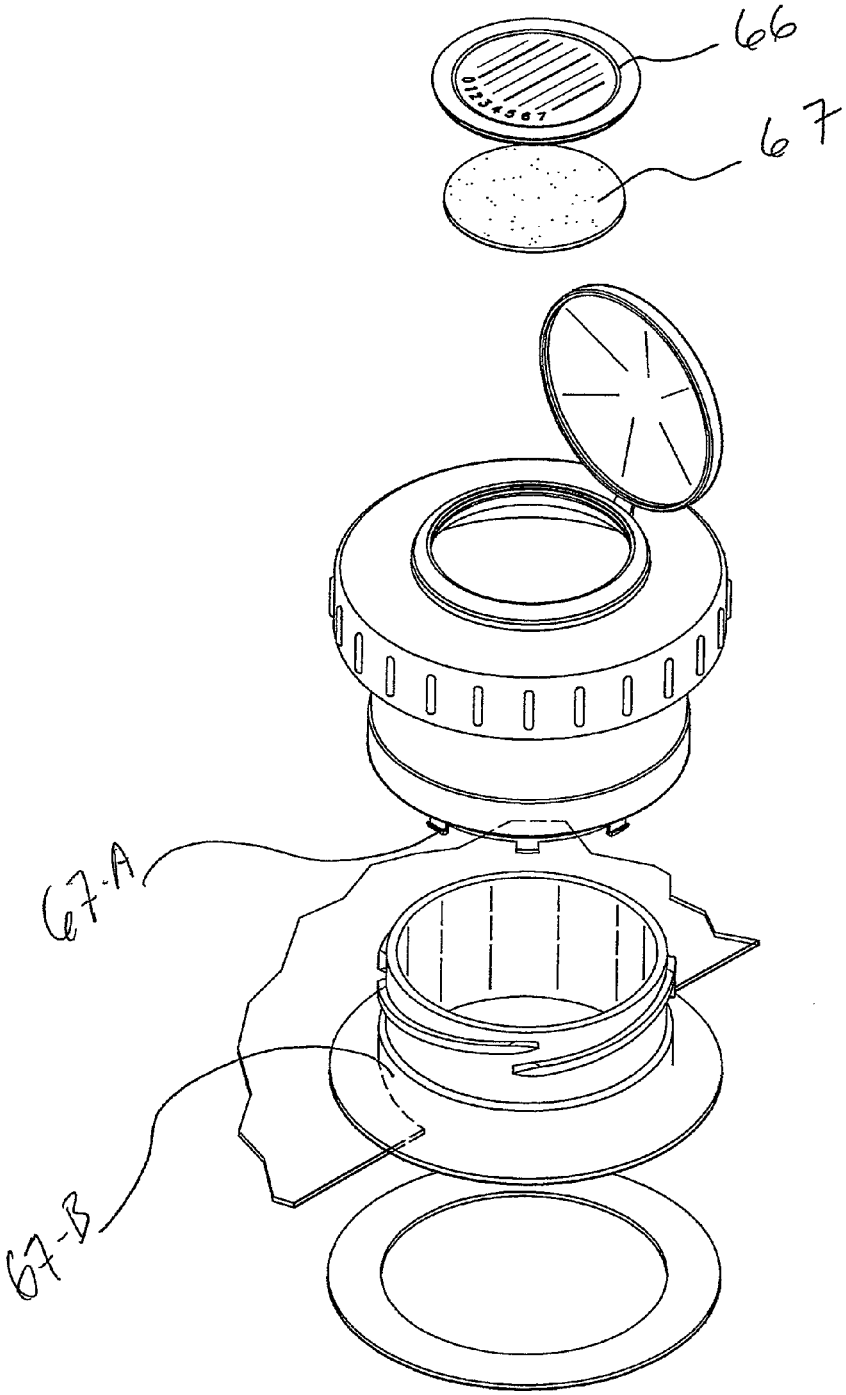
FIG. 51 shows a front view of a dosing cap with an absorbent seal and a bar code inner seal with RFID and information devise that can be added to a dosing cap whereby the bottom can open by manually unscrewing the doing cap.

Now referring to FIG. 51, shows an absorbent seal 67 and a barcode and/or tracking device that can be attached to a dosing chamber and when a consumer unscrews the dosing lid the bottom portion 67A catches on the inside rim of 67B to allow ingredients to be dispersed.

Now referring to FIG. 52, shows an absorbent seal pad 68 that can be attached to a plug-in like surface 68A where it can be snapped into position and then sealed and whereby the bottom area plug for a dosing cap can have absorbent materials added with click-in areas for a better seal 70.

Now referring to FIG. 53, shows when the dosing chamber is unscrewed 71 falls into a container 72.

Figure 54:
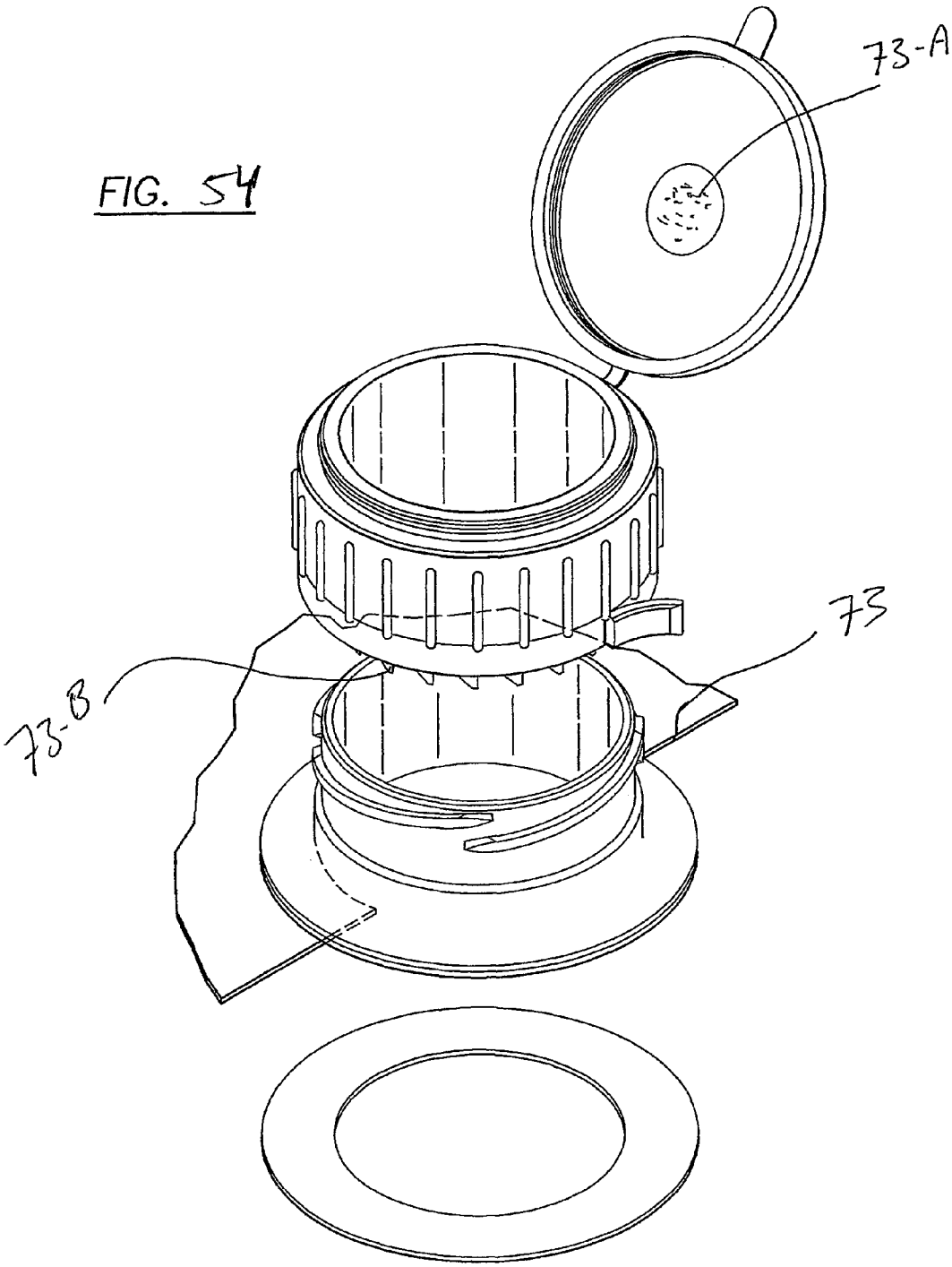
FIG. 54 shows a front view whereby an absorbent material can be added to the cap area and manually be unscrewed with a reverse screw like mechanism to open the flexible container to allow ingredients to be released

Now referring to FIG. 54, shows a dosing chamber that can have absorbents in a cap 73A and when screwed clockwise or counter-clockwise teeth-like bottom 73B rips open the container 73 to release ingredients.

Figure 55:
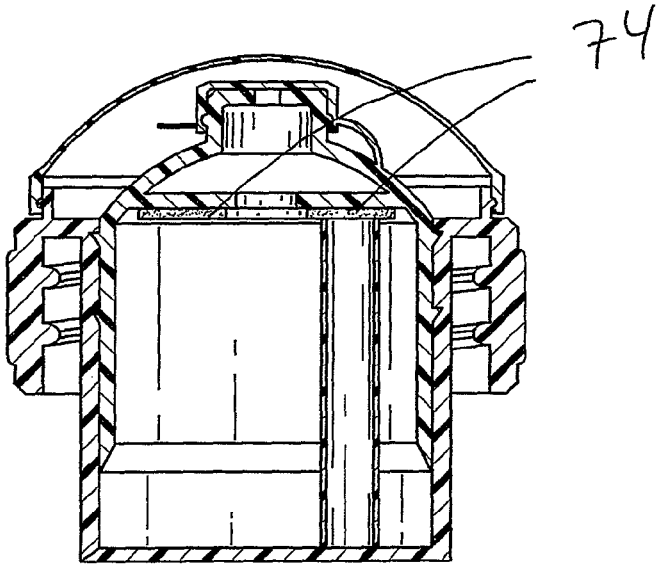
FIGS. 55 and 56 shows a front sectional view of a dosing cap with a screw on mechanism for a container that can be manually opened to release ingredients inside into a container by pushing downwardly the plunger area can be added to any location of a dosing cap.
Figure 56:
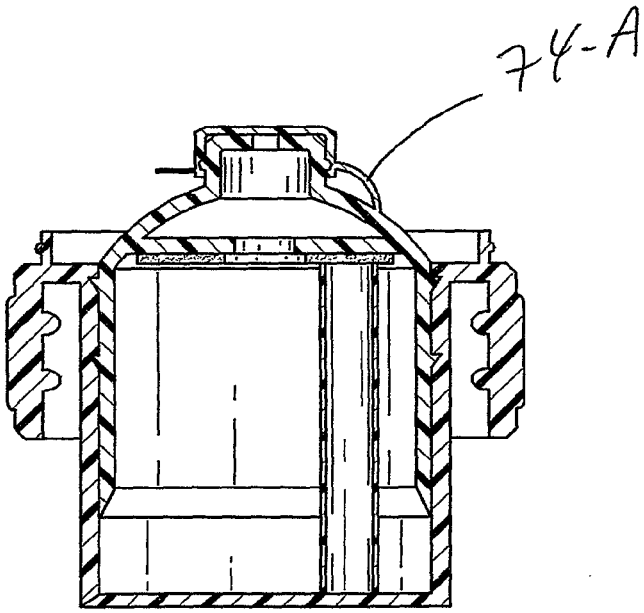

Now referring to FIGS. 55 and 56, shows an absorbent seal in a washer like shape 74 with a hole in the middle to allow liquid flow and the dosing cap after activation can have a hinge device for open and close mechanism.

Figure 57:
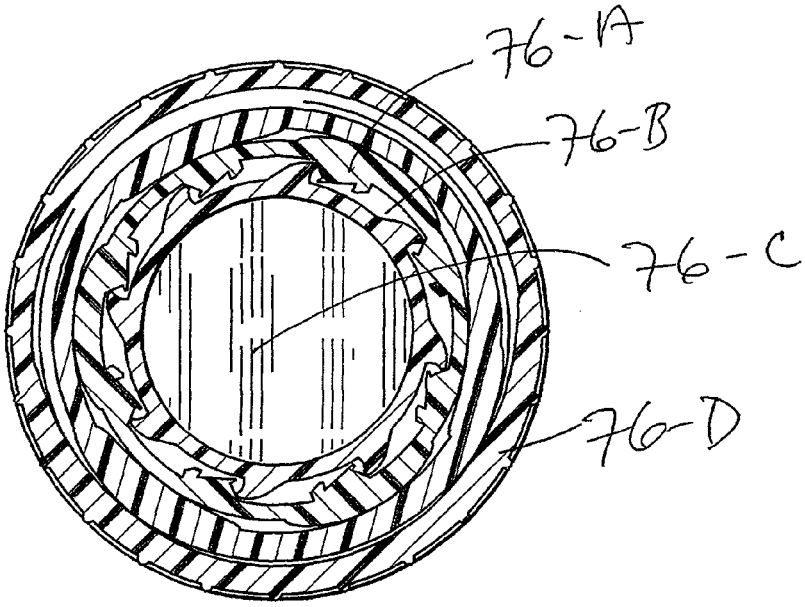
FIGS. 57 and 58 shows a front and upward view of reverse twisting mechanism whereby an individual can unscrew the outer cap area and the reverse inside area moves downwardly to open the bottom dosing cap to release powder added to the upper or lower area of a twisting type dosing cap.

Now referring to FIG. 57, shows a reverse screw-like mechanism holding chamber whereby unscrewing the outer cap 76D which the holding chamber 76C is part of the outer cap 76D whereby an absorbent seal can be applied 75 and when manually unscrewed 76B and 76A clockwise and counter-clockwise rips the bottom open with teeth-like devices 76E.

Figure 58:
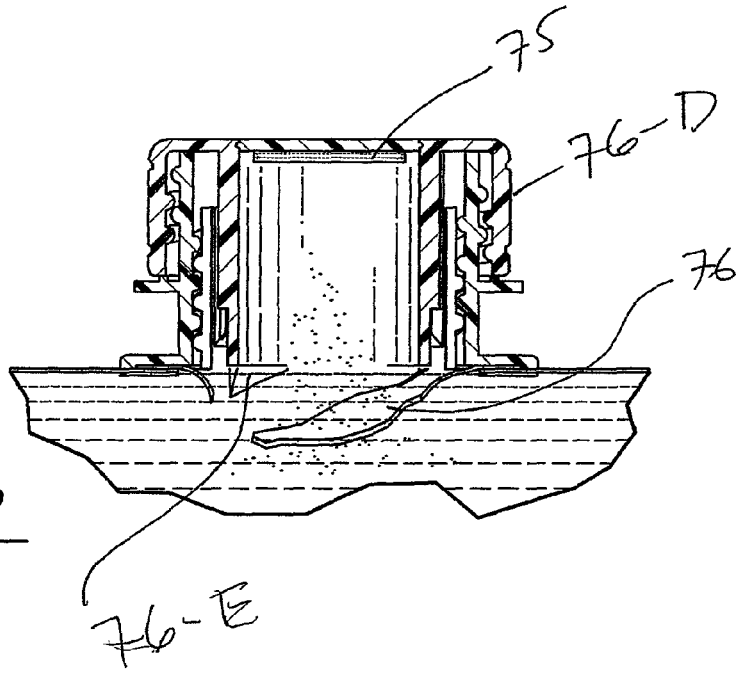

Now referring to FIG. 58, shows an absorbent material added in a dosing chamber described in FIG. 57 whereby when unscrewing normally the double reverse inside mechanisms allow 76E to tear open the bottom 76 to release ingredients.

Figure 59:
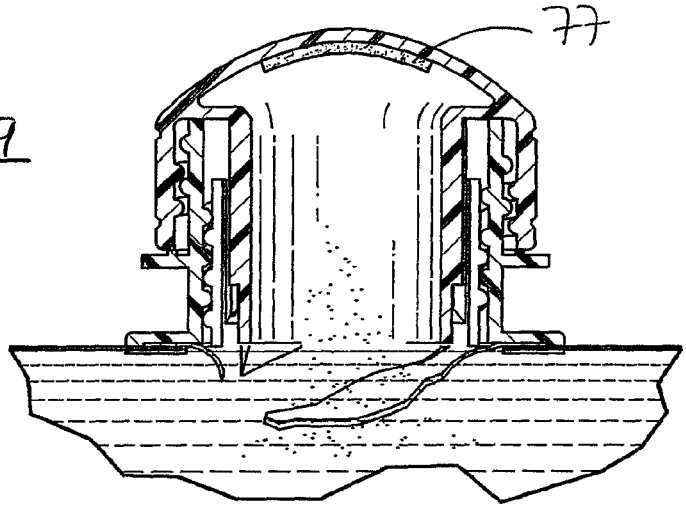
FIG. 59 shows a front sectional view of a domed or any shape dosing cap whereby the an absorbent seal can be attached as well as the bottom area of a dosing cap that can be attached to any flexible or non flexible surface.

Now referring to FIG. 59, shows an absorbent seal that can be attached on the inside dosing cap that can be of any shape.

Now referring to FIG. 60, shows an absorbent plug-like device whereby absorbent materials can be added or applied to the resin 78 and the material can also be made of expandable rubber with seal rings 79.

Now referring to FIG. 61, shows an absorbent pad attached inside of a dosing chamber whereby ingredients can be activated by unscrewing the cap and falling into a larger container as shown in FIG. 62.

Now referring to FIG. 63, shows an absorbent seal 81 that can be applied to or on a film 82B and whereby the dosing holding chamber can be opened by a flexible knife-like device 82A that bounces back into position after depressing 82C.

Figure 64:
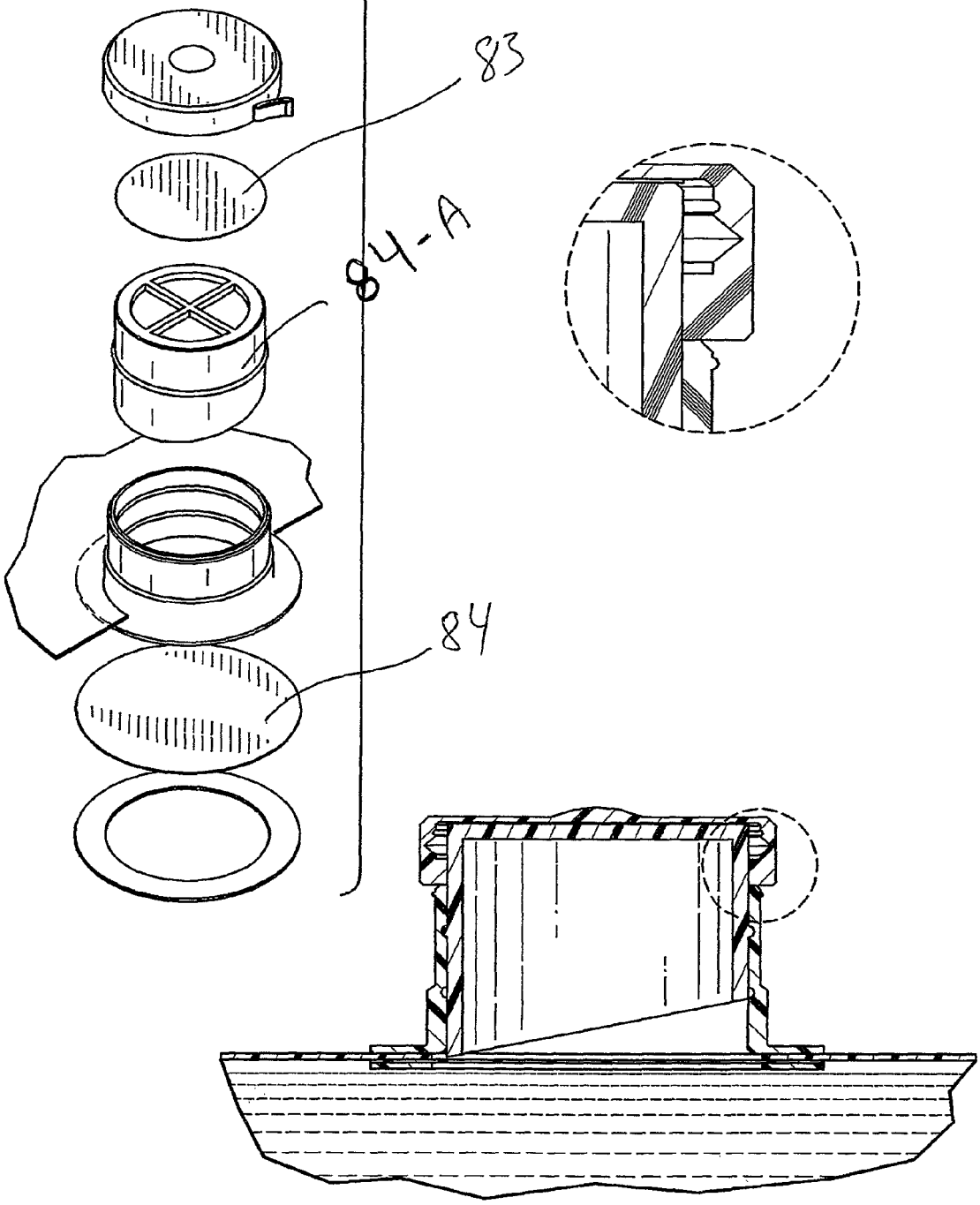
FIG. 64 shows a front sectional view of a dosing cap can be attached to a to a container of any kind that can be manually activated by a plunging mechanism and allowing liquid to flow through the opening o the top.

Now referring to FIG. 64, shows an absorbent seal that can be attached to a holding chamber 83 and 84 that can be manually activated by depressing 84A.

Figure 65:
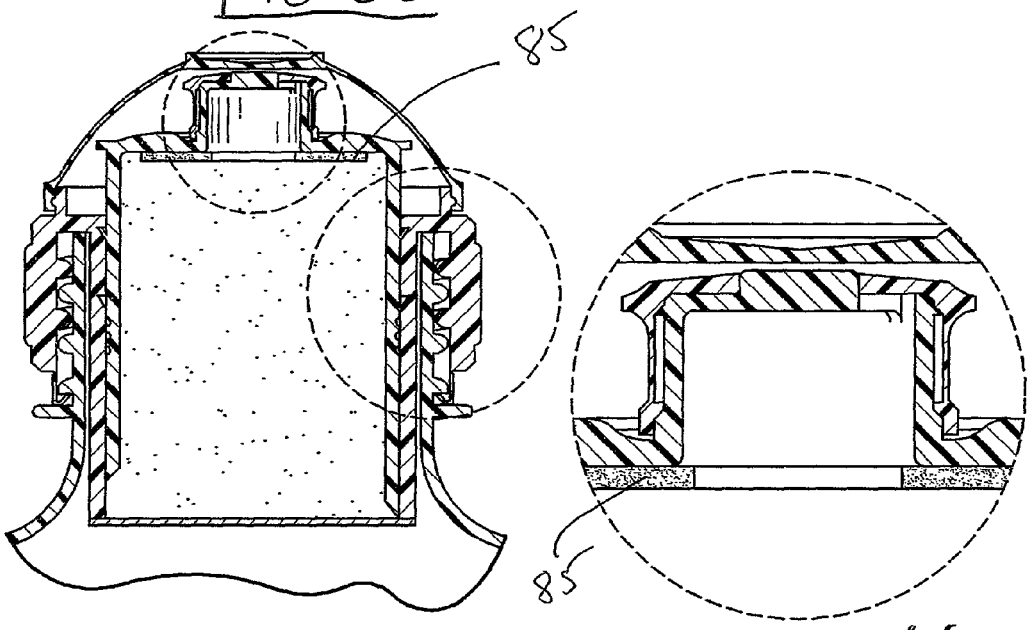
FIGS. 65 and 66 show a front sectional view of an absorbent seal that can be attached by leaving AREAS in the middle free to allow flow for substances.
Figure 66:
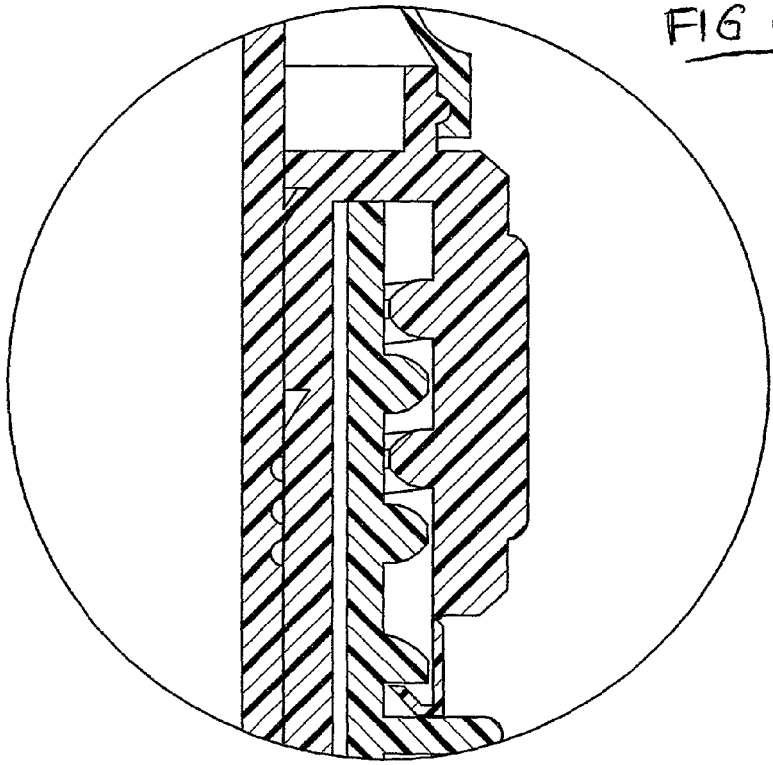

Now referring to FIGS. 65 and 66, shows a washer-like absorbent pad that can be attached to a dosing cap to allow liquid flow through a top opening 85.

Figure 67:
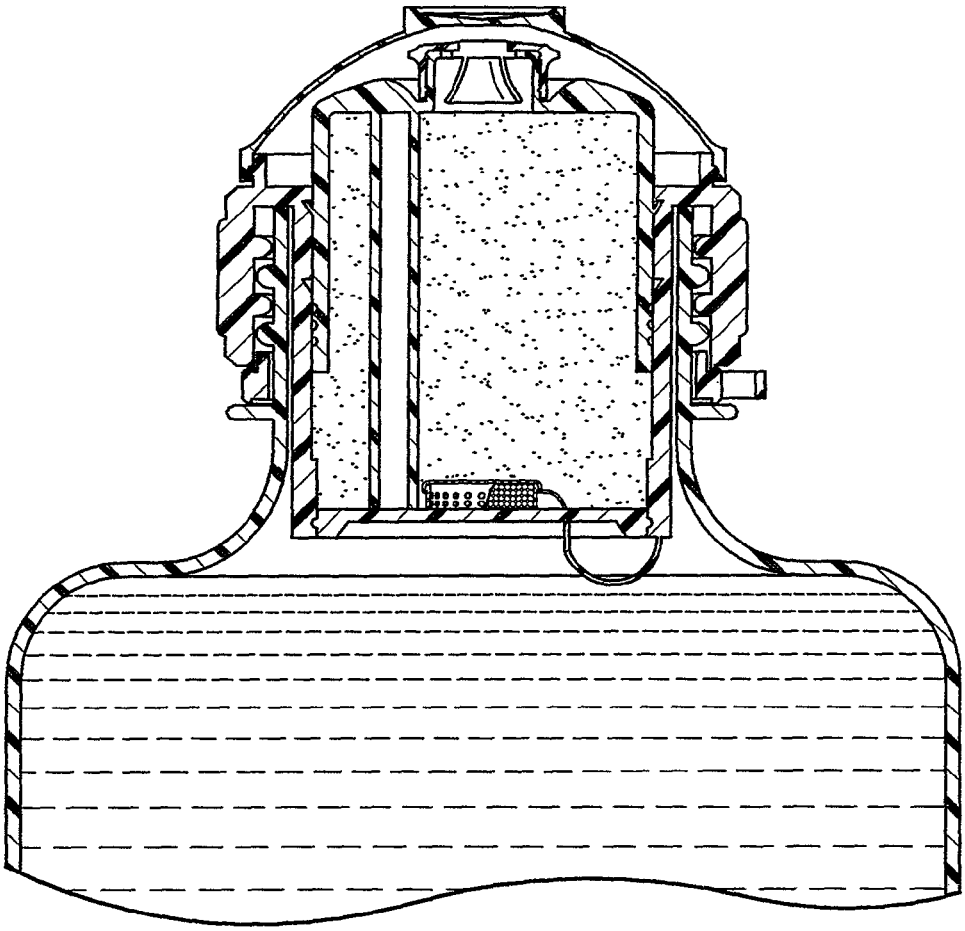
FIGS. 67, 68 and 69 show yet another type of embodiment of the invention whereby granules or a pouch like can be attached to a part of any container.
Figure 68:
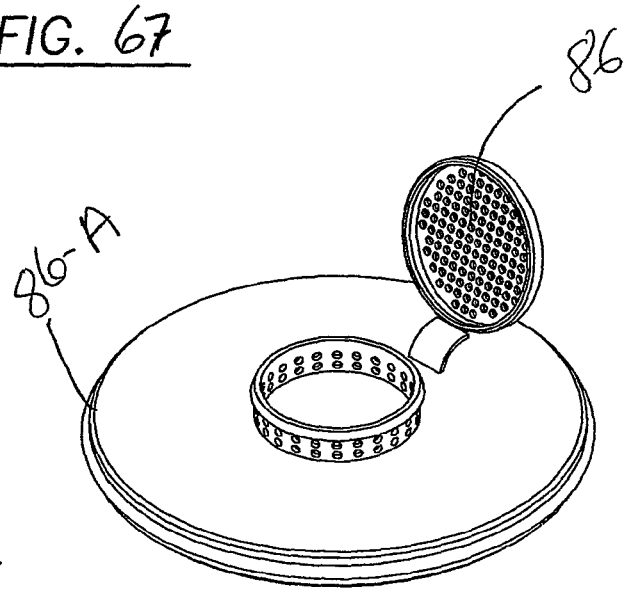

Now referring to FIGS. 67 and 68, shows a screen-like inner cap that is attached to a bottom of a dosing cap 86 that can be filled with absorbent materials and the bottom seal rings area 86A can be made of rubber or other expandable materials.

Figure 69:
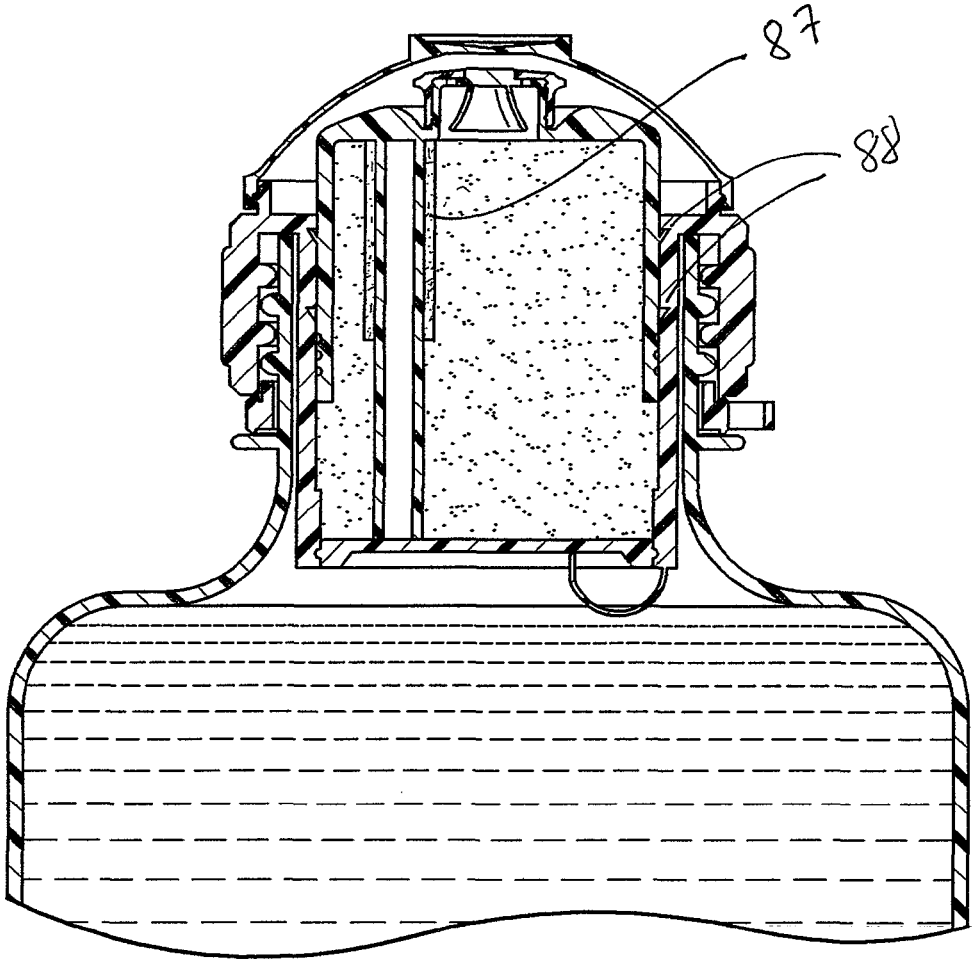

Now referring to FIG. 69, shows a dosing cap that can have an absorbent seal in any shape 87 whereby moisture rings can be added in the plunger dosing device 88 for freshness and UV ingredients can be added to the resin or applied to a dosing cap.

Now referring to FIG. 70, shows a venting system of one or more channels 15C that can be at any location of a plunging and or the body of a dosing body to allow air or gas to escape during assembly and molded in seal rings to allow a set fit and or a separate application of an expandable material seal 89 that can expand to tightly fit the plunger with the body of a dosing cap Now referring to FIG. 71, shows a bottom of a dosing cap that has hinge and or flange areas of one or more to allow the attached bottom to stay attached after activated by a consumer and a raised area on the bottom for a seal to be attached.

Multiple Specific Alternative Embodiments and Materials

1. Moisture and or oxygen absorbent materials of any kind in any amount including but not limited to in any combination and percentages can be to the seal or dosing cap including charcoal, Chitin, Ammonium Bisulfite Solution Ammonium Thiosulphate Solution Oxygen Scavenger, Sodium Thiosulphate sulfite base oxygen scavenger sodium sulfite $Na_2SO_3$, potassium sulfite $K_2SO_3$, sodium hydrogensulfite $NaHSO_3$, potassium hydrogensulfite $KHSO_3$ and the like. Also a polyamide composition which comprises a polyamide homopolymer, copolymer, or blends thereof, at least one polyamide reactive, oxidizable polydiene or oxidizable polyether, and an oxidation promoting metal salt catalyst. Also another method of production of a highly absorbent, polysaccharide-based material, wherein an aqueous solution containing a starting material including a cross-linkable polysaccharide-based polymer blend of an electrically charged polysaccharide-based polymer and an electrically uncharged polysaccharide-based polymer is subjected to cross-linking in order to obtain a water-swelled gel. The cross-linked, water-swelled gel can be dessicated with a polar solvent. characteristics and can have any combination of any other absorbents and charcoal along with starch-graft polymers and those also based on cross-linked polyacrylates The sodium acrylate and starch-graft polymers, also other chemistries, such as polyacrylamide, poly(ethylene oxide), poly(vinyl alcohol), polysuccinimides, and hydrolyzed polyacrylonitrile polymers can be used along with a multitude of other natural and synthetic materials. Other versions can be in the form of starch/acrylonitrile/acrylamide based polymers. Also cross-linked polyacrylates and modified cellulose ethers can be used with starch-grafted cross-linked polyacrylates. The SAP products utilized were based on cross-linked polyacrylates that had high moisture absorption characteristics and can have any combination of other absorbents and charcoal and starch-graft polymers and those based on cross-linked polyacrylates. Other materials are also used to make a superabsorbent polymer, such as polyacrylamide copolymer, ethylene maleic anhydride copolymer, cross-linked carboxy-methyl-cellulose, polyvinyl alcohol copolymers, cross-linked polyethylene oxide. Other active-oxygen scavenging activity of traditional herbal medicines can be used in any combination with the above include but not limited to for oxygen scavengers from natural resources are *Areca catechu* (methanol extract), *Dendrobium plicatile* (methanol extract), *Juglans regia* (water extract), *Paeonia lactiflora* (methanol extract), *Psychotria serpens* (water and methanol extracts), *Rhodiola sacra* (water and methanol extracts) and *Uncaria rhynchophylla* (water extract) especially showed strong scavenging activity against superoxide anion radical ($.O_2^-$), while *J. regia* (water and methanol extracts), *Morus alba* (water extract) and *Schisandra chinensis* (water extract) revealed strong scavenging activity against hydroxyl radical (HO.). (1), caffeic acid (3), protocatechuic acid (6), gallic acid (7), (−)-epigallocatechin 3-O-gallate (8), 3-O-galloylepigallocatechin-(4β→8)-epigallocatechin 3-O-gallate (10), heterodendrin (17) and gallic acid 4-O-β-D-glucopyranoside (19) were found to show mild or strong inhibitory activity against superoxide anion radical ($.O_2^-$), while 4-hydroxybenzoic acid (2), 3,4-hydroxycinnamic acid (4), 6-8 and 19 inhibited hydroxyl radical (OH.).

2. RFID chip, nano chip or any other means of a information and or tracking device that can be molded in or attached at any location and part the dosing cap at any location including the dust cover and can be added to the seal or dosing cap at any location that can be used in a storage cap container comprised of a molded body made from any material or materials.

3. All or part of a dosing cap structures in any percentage of any natural materials including from potato, maize, witch grass, Kenaf, Starch powder extracted from maize, vegetable oil sugar, Celluloid, wood, cotton, card board, wheat, tapioca.

4. Expandable rubber or plastic including seal ring absorbent expandable rings.

5. Absorbent materials of any kind taped or adhered on to the dosing cap area.

6. Dosing cap or RFID or SEAL can be added at any location of a container.

7. Expandable rubber or plastic or any other material seal rings.

8. High moisture barrier resin of any kind in any amount can be manufactured in the container material of any kind including coating.

9. The dosing cap can be made of any materials in any combination of one or more including but not limited to metals, plastics, rubbers, glass, cardboards and wood and including tracking and identification, dyes, metals and any ultra violate, radium. Phosphorescent, zinc sulfide or strontium aluminates other indemnification ingredients and inks.

10. Hologram tags can be part of a dosing cap at any location including the cap or a container.

11. Holograms designed especially for anti-counterfeiting measures by incorporating hidden images, micro imagery, bar codes and or other similar features.

12. Laser coding or molding that provides a permanent barcode, alphanumeric code, or other identifying mark on the package, including by burning or molding away ink in the relevant areas of a dosing cap, cap or container.

13. Color shifting inks or barcodes with chip devices applied over specific molded tagged areas.

14. Manufacturing of different resins can Including but not limited to Epoxy Resins, coating resin, Alkyd Resin, Plastic Resin, Polyethylene Resin, Polyamide Resin, Polyester Resins, Polyurethane Resin, Polyvinyl Resin, PVC Resin, Acrylic Resin, Aromatic Resin, Phenolic Resins, poly styrene, polyethylene, polypropylene.

15. Information, tracking and or payment devises of any kind and of any materials of any kind molded, lasered, printed, embossed, taped or adhered on a dosing cap or cap or a container area.

16. Bar Codes molded or printed in the dosing cap or seal in any location.

17. In the seal Laser coding or molding which provides a permanent barcode, alphanumeric code, or other identifying mark on the package, including by burning or molding away ink in the relevant areas.

18. On the dust cover or any location of a dosing cap laser coding or molding, which provides a permanent barcode, alphanumeric code, or other identifying mark on the package, including by burning or molding away ink in the relevant areas.

19. On the body of the Dosing Cap Laser coding or molding which provides a permanent barcode, alphanumeric code, or other identifying mark on the package, including by burning or molding away ink in the relevant areas.

20. Venting system of any width, height, dimension and or thickness can be at any location of the body or the plunging area of the dosing cap to allow gases and air to escape.

21. On the dosing cap one or more rings that forms together with the opposite side of the dosing cap to allow seal ability and safety.

22. An aromatic, nutritional, medicine and or flavor material of any king that material can be added to the dosing cap at any location to enhance the taste and smell to simulate the flavor of the scent including the resin.

23. An aromatic, nutritional, medicine and or flavor material of any king that can be added to the absorbent seal, surface at any location or resin at any location to enhance the taste and value and or smell to simulate the value, or flavor of the scent.

24. An anti bacterial, anti microbial agent of any kind can be added to any resin or material of the dosing cap and or seal in any amount.

25. Bar Codes molded or printed in a cap, bottle or seal at any location.

26. Other active-oxygen scavenging activity of traditional herbal absorbent medicines can be used in any combination with the invention including but not limited to for oxygen scavengers from natural resources such as *Areca catechu* (methanol extract), *Dendrobium plicatile* (methanol extract), *Juglans regia* (water extract), *Paeonia lactiflora* (methanol extract), *Psychotria serpens* (water and methanol extracts), *Rhodiola sacra* (water and methanol extracts) and *Uncaria rhynchophylla* (water extract) especially showed strong scavenging activity against superoxide anion radical ($.O_2^-$), while

*J. regia* (water and methanol extracts), *Morus alba* (water extract) and *Schisandra chinensis* (water extract) revealed strong scavenging activity against hydroxyl radical (HO.). (1), caffeic acid (3), protocatechuic acid (6), gallic acid (7), (−)-epigallocatechin 3-O-gallate (8), 3-O-galloylepigallocatechin-(4β→8)-epigallocatechin 3-O-gallate (10), heterodendrin (17) and gallic acid 4-O-β-D-glucopyranoside (19) were found to show mild or strong inhibitory activity against superoxide anion radical (.$O_2^-$), while 4-hydroxybenzoic acid (2), 3,4-hydroxycinnamic acid (4), 6-8 and 19 inhibited hydroxyl radical (OH.).

27. A dosing cap made from any materials with an absorbent seal made form any materials including but not limited to breathable surface, nylon or any other materials and barrier coating to allow moisture flow with a transmitting device, bar code, identification inks or laser, a venting system on the chamber and or body to allow air to escape, expandable seal rings for use with any chemicals or materials.

28. A dosing cap that can have an opening liquid flow area of a push pull, twist, button, one or more holes flip lid, pull off top, screw top or any other area on the top of a plunger are to allow liquid flow pre or post activation.

29. One or more hinge or flange areas on the bottom of a dosing cap to allow the bottom to stay attached to the bottom of a dosing cap after activation.

30. A bottom raised seal area on the bottom of a dosing cap to allow a seal to be attached.

31. A venting system of one or more channels at any location of a plunging and or the body of a dosing body to allow air or gas to escape with seal and or a separate expandable material for a body of a dosing cap.

32. A dosing cap that has hinge and or flange areas of one or more on the bottom of a dosing cap to allow the attached bottom to stay attached to the dosing cap after activated by a consumer.

33. A raised area on the bottom of a dosing cap for a seal to be attached.

34. A standard dosing cap body having interchangeable plunger tops that can have a sports top, twist top, flip top, of one or more hole mechanisms to allow liquid flow.

35. Embedded electronic sensors and or inks, which can be applied in or on the seal and or dosing cap or a container or cap.

36. Embedded electronic sensors and or inks with a transmitting device, identification inks or laser, cap laser coding or molding or embossment which provides a permanent barcode, alphanumeric code, or other identifying mark on a label made from any material including being printed on a container, including by burning or molding away ink in relevant areas including holograms designed especially for anti-counterfeiting measures by incorporating hidden images, micro imagery, bar codes and or other similar features in or an any portion of a dosing cap, seal, cap, container and or label areas.

37. Electrical resistance properties of any kind can be incorporated into the seal, bottle, dosing cap, cap or label.

38. A wireless network infrastructure for supporting RFID, tags, for dosing caps, seals, labels and or containers of any kind or any other form of transmitting devices that emit radio-level signals to the readers in distribution centers or stores which relay data to computers to indicate the location of shipments.

39. Non-stick agents can be added to the dosing cap by means of in the resin or coating.

40. An absorbent seal that can be attached to a dosing cap with mesh or screen like upper and bottom area for a even release of ingredients and can have a single serve cup like chamber to be placed under the dosing cap. The inside container can hold ingredients including but not limited to dissolvable or non dissolvable materials micro encapsulation of any combination including one or more ingredients, tea, coffee, bark, roots, sweeteners, colors or any other materials such as carbon, activated carbon, and KDF that can be stored in the holding chamber for specific release or filter of ingredients.

41. A bottom area or at any other location of a container that can hold any substance separate until time of use and a separate molded part of any material that can include the body area of a doing cap that can be applied to any type of container, pouch, bottle or brick pack.

42. A one piece molded bottom, top or side area of a container that can hold any substance and be molded part of any material that can include a bottom body that can be attached to any flexible of non flexible container to any type of container including but not limited to, pouch, bottle or brick pack.

43. A plug like devise on a bottom of a dosing cap with indented inner area are of a inside area of a container that has a one way click in position from the inside neck area of a bottle for a bottom of a doing cap to be connected at manufacturing.

44. A single serve half and half type of single serve container containing an absorbent seal can be added to be placed into a beck area of a container to be manually pulled off to pour ingredients into a container.

45. A bubble like flexible top whereby an individual can manually activate the ingredients stored inside by depressing the top.

46. A fitment dosing cap with a sealed bottom and or a line of weakening with an absorbent seal that can be attached to a pouch or carton with one or more seal areas for the attachment to a container with a bar code and RFID that can be attached to any area a dosing fitment capsule for a flexible or non flexible material.

47. A reverse twisting mechanism on the inside wall of the body with a reverse middle portion attached to the plunger screw top cap.

48. An absorbent seal of any shape that can be attached by leaving areas in the middle open to allow flow for substance.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A dosing cap for containing a first ingredient in a first separate storage ingredient container for combination with a second ingredient in a second container, said dosing cap comprising:

a dosing cap body having a first separate storage ingredient container constructed of a moisture and water impervious material including side walls and a base;

a seal for sealing the base of said first separate storage ingredient container to prevent air or moisture from being received in said first separate storage ingredient container;

said dosing cap connectable to the second container for sealing the contents of the second container;

an absorbent desiccant layer of material mounted inside said first separate storage ingredient container for absorbing any moisture in said first separate storage ingredient container;

an actuator for removing said base connected to said dosing cap body for dispensing the contents of said first separate storage ingredient container into the second container; and a product tracking device embedded in said absorbent layer for tracking said dosing cap and a discrete mesh layer connected to said absorbent layer.

2. A dosing cap as in claim 1, wherein:

said tracking device includes a RFID chip.

3. A dosing cap as in claim 1, including a tracking device comprising a permanent bar code placed on the dosing cap body.

4. A device for attachment to a dosing cap, comprising:

an absorbent material sized for attachment to the dosing cap;

an RFID identifier cap embedded in said absorbent material and sized for attachment to the dosing cap; and a discrete mesh layer connected to said absorbent material.

5. The device of claim 4, wherein said absorbent material is a desiccant.

* * * * *